US008998391B2

(12) United States Patent
Odin et al.

(10) Patent No.: US 8,998,391 B2
(45) Date of Patent: Apr. 7, 2015

(54) METHOD FOR STIMULATION RANGE DETECTION IN A CONTINUOUS INK JET PRINTER

(75) Inventors: Florence Odin, Montelier (FR); Jean-Pierre Arpin, Beaumont-Monteux (FR)

(73) Assignee: Markem-Imaje, Bourg-les-Valence (FR)

( * ) Notice: Subject to any disclaimer, the term of this patent is extended or adjusted under 35 U.S.C. 154(b) by 0 days.

(21) Appl. No.: 13/985,028

(22) PCT Filed: Feb. 10, 2012

(86) PCT No.: PCT/EP2012/052319

§ 371 (c)(1), (2), (4) Date: Oct. 23, 2013

(87) PCT Pub. No.: WO2012/107560

PCT Pub. Date: Aug. 16, 2012

(65) Prior Publication Data

US 2014/0049580 A1 Feb. 20, 2014

Related U.S. Application Data

(60) Provisional application No. 61/475,150, filed on Apr. 13, 2011.

(30) Foreign Application Priority Data

Feb. 11, 2011 (FR) ..... 11 51143
Dec. 16, 2011 (FR) ..... 11 61825

(51) Int. Cl.
*B41J 2/08* (2006.01)
*B41J 2/12* (2006.01)
*B41J 2/125* (2006.01)

(52) U.S. Cl.
CPC .. *B41J 2/125* (2013.01); *B41J 2/08* (2013.01); *B41J 2/12* (2013.01)

(58) Field of Classification Search
CPC ..... B41J 2/08; B41J 2/12
USPC ..... 347/73–82
See application file for complete search history.

(56) References Cited

U.S. PATENT DOCUMENTS 3,886,564 A 5/1975 Naylor et al.
3,898,673 A 8/1975 Haskell (Continued)

FOREIGN PATENT DOCUMENTS

CN 1365892 8/2002
CN 1431099 7/2003

(Continued)

OTHER PUBLICATIONS

International Search Report for International Patent Application No. PCT/EP2012/052319 dated May 21, 2012.

(Continued)

*Primary Examiner* — Huan Tran
(74) *Attorney, Agent, or Firm* — Knobbe Martens Olson & Bear LLP

(57) ABSTRACT

A method for determining the quality of a break-off of an ink jet of a CIJ printing machine is disclosed. In one aspect, this method includes: generating a first line of N1 drops, all charged by the charge means, at the same voltage $V_1$. Also included is: generating at least one drop G1, charged by the charge means, at a second voltage ($VG_1$), followed by at least one drop $G_2$, charged by the charge means, at a third voltage ($VG_2$) lower than $V_1$; generating a second line of N2 drops, all charged by the charge means, at a same voltage $V_2$; and measuring, using an electrostatic sensor, the charge variation of a non-deflected jet of drops including at least the first line of drops and the second line of drops, separated by the drops G1 and G2, during the passage of the jet in front of the sensor.

18 Claims, 31 Drawing Sheets

(56) References Cited

U.S. PATENT DOCUMENTS

| | | | | | |
|---|---|---|---|---|---|
| 4,150,384 | A | | 4/1979 | Meece | |
| 4,255,754 | A | | 3/1981 | Crean et al. | |
| 4,308,543 | A | | 12/1981 | Shultz | |
| 4,329,695 | A | | 5/1982 | Aiba | |
| 4,333,083 | A | | 6/1982 | Aldridge | |
| 4,434,428 | A | | 2/1984 | Horike et al. | |
| 4,551,731 | A | | 11/1985 | Lewis et al. | |
| 4,636,809 | A | | 1/1987 | Eremity | |
| 5,160,939 | A | * | 11/1992 | Bajeux et al. | 347/78 |
| 5,481,288 | A | | 1/1996 | Keeling et al. | |
| 5,523,778 | A | | 6/1996 | Fickling | |
| 5,867,194 | A | * | 2/1999 | Clark et al. | 347/78 |
| 6,357,860 | B1 | | 3/2002 | Rhodes | |
| 6,504,375 | B1 | | 1/2003 | Werner | |
| 6,758,555 | B2 | | 7/2004 | Bajeux | |
| 6,883,904 | B2 | | 4/2005 | Jeanmaire et al. | |
| 7,837,307 | B2 | | 11/2010 | Schmitt | |
| 8,226,199 | B2 | | 7/2012 | Hawkins et al. | |
| 8,511,802 | B2 | | 8/2013 | Odin | |
| 2002/0118258 | A1 | | 8/2002 | Bajeux | |
| 2003/0020777 | A1 | | 1/2003 | Su et al. | |
| 2004/0051155 | A1 | | 3/2004 | Oka | |
| 2005/0206688 | A1 | | 9/2005 | Gelbart et al. | |
| 2005/0280676 | A1 | | 12/2005 | Rybicki et al. | |
| 2006/0267578 | A1 | | 11/2006 | Ushijima | |
| 2007/0064066 | A1 | | 3/2007 | Piatt et al. | |
| 2007/0064068 | A1 | | 3/2007 | Piatt et al. | |

FOREIGN PATENT DOCUMENTS

| | | | |
|---|---|---|---|
| CN | 1500635 | A | 6/2004 |
| CN | 101031425 | A | 9/2007 |
| CN | 101258032 | A | 9/2008 |
| CN | 101678675 | A | 3/2010 |
| EP | 0 036 789 | | 9/1981 |
| EP | 0 362 101 | | 4/1990 |
| EP | 0 362 101 | B1 | 4/1990 |
| EP | 0 744 292 | | 11/1996 |
| EP | 1 079 974 | | 11/1999 |
| EP | 1 705 017 | A2 | 9/2006 |
| FR | 2 821 291 | | 8/2002 |
| JP | 2006-110853 (A) | | 4/2006 |
| WO | WO 99/59822 | | 11/1999 |
| WO | WO 2009/061899 | | 5/2009 |

OTHER PUBLICATIONS

International Search Report and Written Opinion for International Application No. PCT/EP2010/060942, dated Nov. 19, 2010, in 14 pages.

French Preliminary Search Report for French Patent Application No. 0955362 dated Apr. 19, 2010.

Chinese Office Action and Search Report for Chinese Application No. 2010800339553.8 dated Jan. 3, 2014.

French Preliminary Search Report for French Patent Application No. 1161825 dated Jun. 18, 2012.

Chinese Office Adtion dated Dec. 3, 2014 for Chinese Patent Application No. 201280017602.7 which shares priority of French Patent Application No. 11 51143, filed Feb. 11, 2011 *and* U.S. Appl. No 61/475,150, filed Apr. 13, 2011, with captioned U.S. Appl. No. 13/985,028.

* cited by examiner

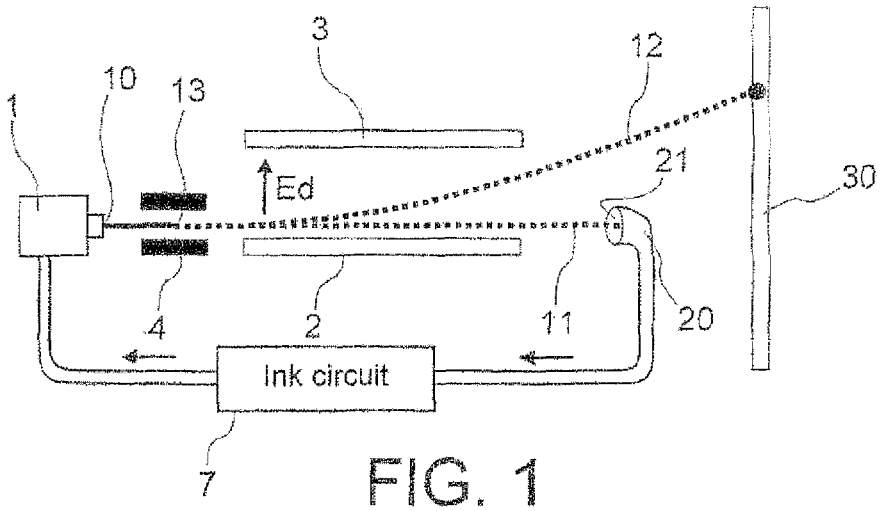
FIG. 1
FIG. 2a
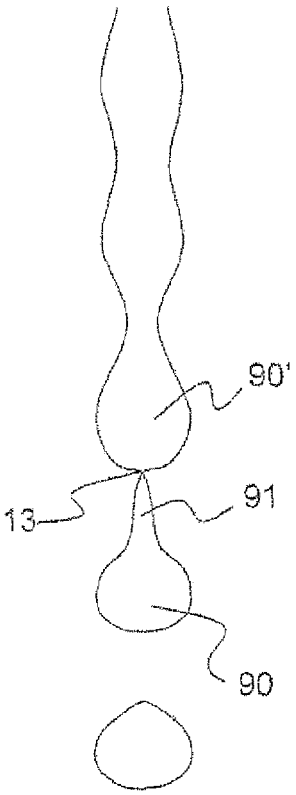
FIG. 2b
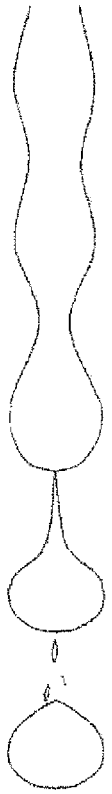
FIG. 2c
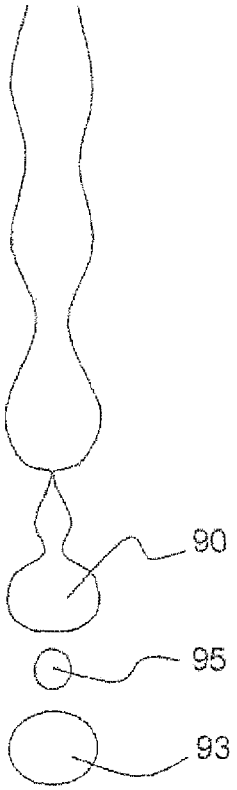

METHOD FOR STIMULATION RANGE DETECTION IN A CONTINUOUS INK JET PRINTER

RELATED APPLICATIONS

This application is a U.S. National Phase of International Application No.: PCT/EP2012/052319, filed Feb. 10, 2012, which claims the benefit of French Patent Application No. 11 51143 filed Feb. 11, 2011, U.S. Patent Application No. 61/475,150 filed on Apr. 13, 2011 and French Patent Application No. 11 61825 each of which is incorporated by reference in their entirety.

BACKGROUND

The invention relates to the field of continuous ink jet (CIJ) printers, and more particularly to a method and a device for regulating or adjusting the stimulation of the ink jet.

It makes it possible to obtain a robust operation and controlled printing quality despite the variability of the implementation conditions, identified by various parameters: environmental conditions (measured in particular by the temperature), deflection amplitude, nature of the ink . . . .

Deflected continuous ink jet printheads comprise functional means that are well known by those skilled in the art.

FIG. 1 diagrams such a printhead according to the prior art. This head essentially comprises the following functional means, described successively in the direction of progression of the jet:

- a drop generator 1 containing electrically conducting ink, maintained under vacuum, by an ink circuit 7, and emitting at least one ink jet 11,
- an individual charge electrode 4 for each ink jet,
- an assembly formed by two deflection plates 2, 3 placed on either side of the trajectory of the jet and downstream of the charge electrode 4,
- a gutter 20 for recovering ink from the jet not used for printing so it can be returned to the ink circuit and thus be recycled.

The functionality of these different means is described below. The ink contained in the drop generator 1 escapes from at least one calibrated nozzle 10, thereby forming at least one ink jet 11. Under the action of a periodic stimulation device placed upstream of the nozzle (not shown), for example made up of a piezoelectric ceramic placed in the ink, the ink jet breaks off at regular temporal intervals, corresponding to the period of the stimulation signal, in a precise location of the jet downstream of the nozzle. This forced fragmentation of the ink jet is usually caused at a so-called "break-off" point 13 of the jet by the periodic vibrations of the stimulation device. The distance between the outlet of the nozzle and the so-called "break-off" point depends on the stimulation energy. Hereinafter, this size will be called the "break-off distance" or "break-off length," and identified as BL. The stimulation energy is directly related to the amplitude of the electrical signal for controlling the ceramics.

At the location of this break-off point, the continuous jet turns into a line 11 of identical and regularly spaced drops of ink, at a temporal frequency identical to the frequency of the stimulation signal. For a given stimulation energy, any other parameter being stabilized moreover (in particular the viscosity of the ink), there is a precise (constant) phase relationship between the periodic stimulation signal and the break-off moment, which itself is periodic and has the same frequency as the stimulation signal.

This line of drops travels along a trajectory collinear to the ejection axis of the jet, which theoretically joins, by geometric construction, the center of the recovery gutter 20. The charge electrode 4, situated near the break-off point of the jet, is intended to selectively charge each of the drops formed at an electrical charge value that is predetermined for each drop. To that end, the ink being kept at a fixed electric potential in the drop generator, a voltage window with amplitude Vc, predetermined, is applied to the charge electrode. This window is generally different at each drop period. For the drop to be correctly charged, the moment at which the voltage is applied slightly precedes the fractionation of the jet, in order to take advantage of the electrical continuity of the jet and attract a given charge quantity at the end of the jet. The moment at which the charge voltage is applied is therefore synchronized with the method for fractionating the jet. The voltage is then maintained during the fractionation to stabilize the load until electrical insulation of the detached drop. The voltage still remains applied a little after the fractionation to take the hazards of the break-off moment into account.

The charge quantity taken on by the drop follows the relationship:

$$Q=-K*Vc$$

where K is a constant for the implementation conditions of the printer, which depends primarily on the permittivity of the medium, the width of the slit, and the volume of the drops. Hereinafter, a drop will be considered to be charged at Vc (e.g. 100 volts) and its charge will be −K*Vc volts (e.g. −K*100 volts).

The two deflection plates 2, 3 are brought to a fixed relative potential with a high value that produces an electrical field Ed substantially perpendicular to the trajectory of the drops. This field is capable of deflecting the electrically charged drops that engage between the plates, by an amplitude depending on the charge and the velocity of these drops. These deflected trajectories 12 escape the gutter 20 to impact the medium to be printed 30. The placement of the drops on the drop impact matrix to be printed on the medium is obtained by combining an individual deflection imparted to the drops of the jet with the relative movement between the head and the medium to be printed. These two deflection plates 2, 3 are generally planar.

The recovery gutter 20 comprises, at its inlet, an opening 21 whereof the cross section is the projection of its inlet surface on a plane perpendicular to the nominal axis of the non-deflected jet, placed just upstream of the contact with the gutter. This plane is called the inlet plane of the gutter. "Nominal axis of the non-deflected jet" refers to the theoretical axis of the jet when all of the subassemblies of the head are manufactured and placed relative to each other nominally once the head is assembled.

It is known that the control of the operation of a continuous jet printhead requires, in addition to the functional means described above, the implementation of a certain number of complementary means making it possible to master, on one hand, the deflection of the drops (which is determined in large part by the electrical charge and the velocity of the drops) and on the other hand, to monitor the proper operation of the recovery of the non-printed drops.

To best master the deflection of the drops for printing, the following conditions should be met.

The break-off process of the jet should be done stably and reliably, at a predetermined distance from the nozzle corresponding to the inside of the charge electrode.

Furthermore, the synchronization of the charge with the break-off moment is adjusted on the proper phase.

Lastly, the velocity of the jet is adjusted to a predetermined value, the best thing being to measure this value and make it subject to an instruction by acting on the pressure of the ink.

To that end, the printheads according to the prior art generally comprise a device for measuring a representative size of the charge taken on by the drops. This measuring device is arranged downstream of the charge electrode.

Thus, document EP 0 362 101 describes a device making it possible to detect the charge phase, measure the jet velocity, and know the distance between the nozzle and the break-off of the jet. It involves a single electrostatic sensor placed between the charge electrode and the deflection plates as well as the processing of the associated signal. The sensitive core of this sensor and the circulation space of the charged drops in front of this sensitive core are protected from electrostatic disruptions by electrostatic shielding. The exploitation of the obtained signal, upon passage of specifically charged drops, called test drops, the presence of which is sensed by their electrostatic influence on the sensitive core of the sensor, makes it possible to take very precise measurements of the charge level of these drops and to define the entry and exit moments from the sensor, so the transit time dT, of these drops in the detection area of the sensor. Knowing the effective length L of the space passed through, it is then possible to deduce the average velocity V=L/dT of the drops passing through the sensor.

Document EP 1 079 974 describes a device made up of two electrostatic sensors arranged in two relatively distant locations, close to and along the nominal trajectory of the jet. The level of the signal on one of the sensors provides information on the quantity of charges taken on by a test drop and the temporal shift between the signals of the two sensors makes it possible to obtain the velocity of the drop.

Document U.S. Pat. No. 4,636,809 describes a detection of the current produced by the flow, at the gutter, of the charges contributed by a succession of test drops. The amplitude of the current provides information on the average charge level of the drops, and the time between the charge of a group of drops at the charge electrode and the detection of the current produced when this group reaches the gutter makes it possible to calculate the velocity of the jet.

Knowing the velocity of the jet via one of the methods described above, it is possible to check the velocity of the jet by periodically measuring that velocity and making its value subject to a sign by acting on the pressure of the ink.

The method usually adopted to choose the synchronization moment of the charge relative to the break-off, and which makes it possible to satisfy the synchronization of the charge with the break-off moment, consists of proceeding with a succession of charge trials with charge moments (also called "phases") differently distributed over a drop period, and for each phase, measuring the charge level taken on by the drop; this electric charge level being representative of the effectiveness of the charge process of the drops and therefore, the appropriateness of the charge synchronization. Certain phases produce a mediocre or even very poor charge synchronization, but in general, a certain number of phases make it possible to obtain a maximal charge.

The charge phase that will be used during printing will be chosen from the latter.

This technique is taught, for example, in EP 0 362 101. This document also describes a method also making it possible to know the precise moment of the charge of a test drop that corresponds to the break-off moment of the jet (to within a phase) and therefore, knowing the jet velocity Vj determined via one of the methods described above, to be able to deduce the time of flight Tv between the break-off of the test drop and its entry into the sensor.

Knowing, by construction, the distance D between the nozzle and the sensor inlet, the distance BL is deduced between the nozzle and the break-off of the jet: $BL=D-Vj\times Tv$.

To obtain a break-off of the jet that can be used under good conditions, on one hand one verifies that the break-off is within the field of the charge electrode, therefore at a determined distance from the nozzle (break-off position); and on the other hand, one ensures that the break-off of the jet is done stably and reliably (break-off quality: which will be specified below). This is done through an optimal adjustment of the stimulation that occurs practically by acting on the stimulation energy.

In a known manner, the stimulation energy is controlled by the level VS of the periodic voltage signal applied to the stimulation device (piezoelectric).

A break-off is considered stable and reliable (good quality) when it makes it possible to guarantee an optimal charge of the drops in an operating field of the printer characterized in particular by a temperature range (conditioning the viscosity of the ink) for a given ink.

Concretely, just before the break-off, the drop 90 is connected by a tail 91 to the following drop 90' being formed (see FIG. 2*a*). The shape of this tail determines the quality of the break. The shapes most characteristic of a problematic break-off are the following:

- very fine tail 91 (see FIG. 2*b*), which risks breaking unstably (the surface tension cohesion forces become weak relative to the electrostatic forces). When a very significant electric field exists between two successive drops charged at very different values (case of a strong charge followed by a weak charge), a stress concentration effect phenomenon at the tail creates electrostatic forces such that particles of charged matter are pulled from the very fine tail of the highly charged drop and rejoin the weakly charged drop by transferring charges. As a result, the drops no longer have their nominal charge, the deflection is thereby disrupted, and the printing quality deteriorates.
- tail having a lobe between two narrow portions (see FIG. 2*c*), which can break in two places and create a satellite 95 isolated from the drop, this satellite takes on part of the charges intended for the concerned drop:
- if its velocity is faster than the jet (fast satellite), the satellite 95 and its charges will rejoin the concerned drop 93 before deflection and reconstitute a nominal situation without noticeable consequences for the printing quality,
- if the velocity of the satellite is identical to that of the jet (infinite satellite) or does not rejoin the concerned drop before deflection thereof, it will be poorly charged and the satellites will be violently deflected at the risk of dirtying the printhead, if it rejoins the following drop 90 (case of a slow satellite) it will transfer, to the following drop 90, charges from the concerned drop 93 and thus disrupt the deflection.

The shape of the break-off, aside from the rheological characteristics of the ink, is related to the stimulation level (excitation intensity). In general, the break-off shape changes, when the excitation increases, to go from a break-off with slow, then infinite, then fast satellites (under-stimulation) to a break-off without satellites whereof the shape of the tail evolves, then the break-off returns to a slow satellite regime (over-stimulation). At the same time, the position of the break evolves following the curve of FIG. 3. The latter shows the profile of the characteristic f yielding the Break-off distance BL as a function of the Stimulation voltage VS (BL=f (VS)).

When the stimulation excitation increases (from a low value), the nozzle/break-off distance (BL), which starts from a high value (natural break-off of the jet), decreases and goes through a minimum called "turning point" (Pr) corresponding to an excitation voltage VPr and a break-off distance DPr, then elongates again. The shape and the actual position of this curve depend on several parameters, in particular characteristics of the drop generator, the nature of the ink, and the temperature. The printhead is designed so that the functional part of this curve is located, at least in part, in the field of the charge electrode despite the variability of the mentioned parameters. On the other hand, there is a functional zone related to the break-off quality in which the printing is satisfactory (the charge of the drops is correct).

The intersection of the correctly positioned zone and the break-off quality functional zone corresponds to the operational stimulation range, which is characterized by an entry point (Pe) on the left corresponding to a piezoelectric excitation voltage VPe and a break-off distance DPe, and an exit point (Ps) on the right, corresponding to a piezoelectric excitation voltage VPs and a break-off distance DPs as indicated in FIG. 3.

In certain techniques of the prior art, the position of the operational stimulation range is estimated relative to the point where the satellites are infinite and/or at the turning point, these two characteristic points being detected indirectly, but the actual range is not known (U.S. Pat. No. 5,196,860, U.S. Pat. No. 4,631,549).

One significant difficulty is determining the optimal operating point (Pf in FIG. 3) in the stimulation range, i.e. the optimal stimulation level (VPf), to obtain nominal printing under given use conditions (type of ink, average temperature, . . . ) taking into account the variability of the parameters during the usage session of the printer (in fact, between 2 stimulation adjustments). The break-off distance DPf of the operating point is always greater than or equal to that of the turning point DPr.

The positioning of the optimal operating point Pf is generally done empirically, in the vicinity of the turning point Pr, rather towards its left on the curve or for a slightly lower excitation, which corresponds to a slight under-stimulation.

One of the known methods for determining the optimal operating point involves referring to the curve BL=f (VS) and positioning the operating point relative to the shape of the curve, represented by its drift, near the turning point:

U.S. Pat. No. 5,481,288 discloses the fact that the optimal charge synchronization phase depends on the position of the break-off modulo the number of phases defined per drop period. When the nozzle/break-off distance evolves, the phase rolling (velocity and direction of evolution of the phases) is representative of the drift of the curve BL=f (VS). The zone of the turning point is identified when the drift passes below a certain threshold and the operating point is positioned in that zone, following an empirical law established experimentally, in document WO 2009/061899 the slope of the curve BL=f (VS) is used directly to determine the optimal operating point. The curve BL=f (VS) being determined, the operating point is positioned where the slope of the curve has a given value, established experimentally. A negative value of the slope places this point to the left of the turning point, and the lower the absolute value, the closer the operating point comes to the turning point. Here the determination of the break-off distance is done in a manner similar to that described in EP 0 362 101 already cited above.

The methods for determining the operating point as described above are not fully satisfactory because the measurements done do not make it possible to characterize the break-off quality and therefore its robustness relative, in particular, to the high charges. Indeed, these measurements are based on the determination of the best charge phase to deduce BL; these measurements being done by very slightly charging the drops used for the test.

Another method for determining the operating point is taught in document EP 0 744 292. It consists, for each excitation level of the stimulation scanning, of emitting, repetitively, sequences of drops comprising a charged test drop, preceded and followed by at least one uncharged drop (guard drops). The test drops are then spatially separated from the guard drops by deflection, to be oriented towards a sensor yielding a size representative of the average charge of the test drops (only). The test drops being charged at a maximum useful value, if the charge process is optimal (case of a break-off exploitable under those conditions), the sensor will detect a quantity of maximum charges on the test drops. If charges are transferred from the test drop towards the following guard drop (due to the presence of satellites having become slow), the sensor will detect a smaller quantity of residual charges on the test drops. At the end of the stimulation scanning one can identify the operational stimulation range that corresponds to the zone where the quantity of charges taken on by the test drops is maximal.

This method improves the preceding one because the positioning of the operating point, placed empirically in that range, takes the break-off quality present under the test conditions into account. Indeed, the test is done under conditions where strong charges are used.

This solution does, however, pose the following problems.

First, the test and guard drops must be separated, as the usable sensors (with a reasonable design complexity and production cost) cannot discriminate, in a same line of drops, between a situation where the charge of the test drop alone is optimal and a situation where the same charge is distributed over two successive drops in the event of a charge transfer, because the average number of charges seen by the sensor remains unchanged in both situations.

Moreover, the test drops must be deflected to be detected, but also recovered and returned to the ink circuit because the test operation is generally done outside printing; it is therefore necessary to implement a second gutter provided with a second sensor. The solution proposed in EP 0 744 292 requires a specific deflection electrode for that function. This entire dual-gutter system and dual-deflection system is complex and costly.

Moreover, during scanning of the stimulation excitation, the break-off goes through states where the risk of the appearance of infinite satellites exists. These charged satellites will be violently deflected by the deflection field due to their low mass and will dirty the elements of the head (in particular the deflection plates, at the risk of making the deflection field generator switch), which will require a maintenance operation.

Moreover, a repetitive sequence of a set of drops whereof a charged drop preceded and followed by an uncharged drop does not represent the worst case of using a CIJ printer where one can find successions of highly charged drops creating electrostatic conditions that are more restrictive regarding the transfer of charges.

The main drawbacks of the prior art can be summarized as follows:

The methods based on the detection of the turning point and/or the point where the satellites are infinite does not take into account the break-off quality, with the result that the operating point can be chosen outside the functional stimulation range.

The stimulation range determined at a low charge voltage and a nominal temperature is not that which guarantees an optimal printing quality at a high charge voltage and in the operating temperature operational range.

The curve BL=f (VS) determined by the methods of the prior art can be only partial, the turning point being outside the operational field of the detecting means used. Choosing the operating point relative to the operating point is then not possible.

In the method measuring the actual charge of the test drops, it is necessary to spatially separate the test and guard drops, which leads to a complex and costly system.

The repetitive sequences of an assembly formed by a charged drop preceded and followed by a guard drop do not take into account the reality where, in certain cases, a succession of drops can all be highly charged and create a more restrictive electrostatic environment than the test situation.

SUMMARY OF CERTAIN INVENTIVE ASPECTS

The invention aims to resolve these problems.

The invention, according to one aspect thereof, relates to a method for determining the quality of a break-off of an ink jet of a CIJ printing machine, this method including:

a) generating a first line (or stream or series) of N1 drops (e.g. N1≥10 or 20 or 40), all charged by the charge means, at a same V1, e.g. greater than or equal to 150 V or 200 V or 250 V, b) then generating at least one drop G1, charged by the charge means, at a second voltage VG1, following by at least one drop G2, not charged or charged by the charge means, at a third voltage VG2, less than V1, c) then generating a second line (or stream or series) of N2 drops (e.g. N2≥10 or 20 or 40), all charged by the charge means, at a same voltage V2, d) measuring, via an electrostatic sensor, the charge variation of a jet of non-deflected drops including at least the first line of drops and the second line of drops, separated by the drops G1 and G2, during the passage of that jet in front of said sensor.

In one example |VG1−VG2|>V', V' being a minimum value, with V'>100 or 150 V; VG2 is for example less than 50 V; for example V'>160 V or >175 V or >200 V or >225 V.

Such a method may also comprise comparing said charge variation with a threshold value to determine whether a coalescence of the drop G2 and the drop G1 occurs upstream of the detector, or downstream of the inlet thereof, or whether a separation or a tearing of material out from one of the charged drops occurs.

The implementation of the method on a continuous ink jet printhead can be done without any fundamental material alteration of an existing printhead.

In general, this test of the break-off quality is done under the worst implementation conditions (highly charged consecutive drops), which guarantees significant robustness of the method.

Such a method can be managed automatically by a printer.

The test of the break-off quality corresponding to an excitation level of the stimulation is done from one or more drops, at least one of which may be charged or weakly charged, or even uncharged, in a line of drops continuously charged at a high value.

The conditions present in the jet make it so that the weakly charged drop coalesces with the preceding drop before the sensor when the break-off is of good quality and does not coalesce before the sensor when the break-off, of poor quality, causes a charge transfer between the drops.

The sensor measures the influence of the distribution distortion of the charges in a portion of a line of drops containing the test drop(s) in the middle of strongly charged drops.

The distribution distortion of the charges is significant when the test drop coalesces with the preceding drop and weak when the coalescence does not occur.

Preferably, the distance (d) between the break-off point of the drops and the upper part of the sensor is at least equal to 15 mm or 20 mm.

A plurality of voltage values can be applied to the drop generating means and steps a-d can be carried out for each voltage of that plurality of voltages.

According to one particular embodiment, a voltage of the drop generating means is determined for which a tearing out of matter occurs at least for the last drop of the first line of drops, this voltage being considered the exit voltage (Vs) of the functional range of the jet.

Moreover, it is possible to determine a break-off distance of the entry point (Pe) of the functional range of the jet, as a function of the turning distance (Dr).

For example, the break-off distance of the entry point of the functional range of the jet can be given by a formula of the type $Dpe=\alpha Dr+\beta$.

We also describe a continuous ink jet-type printing machine, this machine including:

a) means for generating:

a first line (or stream or series) of N1 drops, all charged by the charge means, at a same voltage greater than or equal to a first voltage V1, at least one drop G1, not charged or charged by the charge means, at a second voltage VG1, then at least one drop G2, charged by the charge means, at a third voltage GV2, less than V1, then a second line (or stream or series) of N2 drops, all charged by the charge means, at a same voltage V2, which may be greater than or equal to the first voltage V1, b) means for measuring the charge variation of a jet of non-deflected drops including at least the first line of drops and the second line of drops, separated by the drops G1 and G2.

Such a device can also comprise means for comparing said charge variation with a threshold value and for determining whether a coalescence of the drop G2 and the drop G1 occurs upstream or downstream of the inlet of the measuring means, or whether a separation or a tearing out of matter from one of said charged drops.

In one example |VG1−VG2|>V', V' being a minimum value, with V'>100 or 150 V; VG2 is for example less than 50 V; for example V'>160 V or >175 V or >200 V or 225 V.

Such a machine can include means for applying a plurality of different voltages to the drop generating means, for example a plurality of increasing or decreasing voltage values.

According to one example, such a machine also includes means for determining a break-off distance of the entry point (Pe) of the functional range of the jet, as a function of the turning distance (DPr).

For example, means can be provided for determining the break-off distance of the entry point of the functional range of the jet using a formula of the DPe=αDPr+β type.

In a method or a device as described above, N1 and N2 are preferably such that the first line of drops and the second line of drops have a length greater than the length of the sensitive zone of the means for measuring the charge variation of a jet of drops.

In a method or device according to the invention, various combinations of voltages can be considered, for example:

$V_2$-$V_1$.

and/or $VG_1$-$V_1$, and/or |VG1−VG2|≥V', V' being a minimum value, with V'≥100 V or 150 V.

and/or $VG2<V_1<VG_1$;

and/or 150 V≤$V_1$≤300 V, $VG_1>V_1$ and 40 V≤$VG_2$≤90 V, or 100 V≤$V_1$≤200 V, $VG_1>V_1$ and 20 V≤$VG_2$≤60 V;

and/or $VG_1$ being comprised between 125 V or 170 V on the one hand, and 200 V or 300 V on the other hand.

In a method or device according to the invention, the drop G1 and/or the drop G2 can be charged, by the charge means, with a cyclical ratio of the charge signal comprised between 30%, or 50%, and 100%.

One of the aspects of the invention makes it possible to determine the actual stimulation range (i.e. taking into account the maximum charge of the drops and their most restrictive arrangement in the jet). The knowledge of the actual operating range makes it possible to place the optimal operating point, which will guarantee nominal printing over a large temperature range.

BRIEF DESCRIPTION OF THE DRAWINGS

FIG. 1 is a diagram of a deflected continuous jet printhead,

FIGS. 2*a*-2*c* illustrate various break-off configurations, FIG. 2*a* showing a good quality break-off, FIG. 2*b* showing a fine tail break-off (with risk of tearing out of matter), and FIG. 2*c* showing a lobe break-off (with risk of satellites)

DETAILED DESCRIPTION OF SPECIFIC EMBODIMENTS

Figure 3:
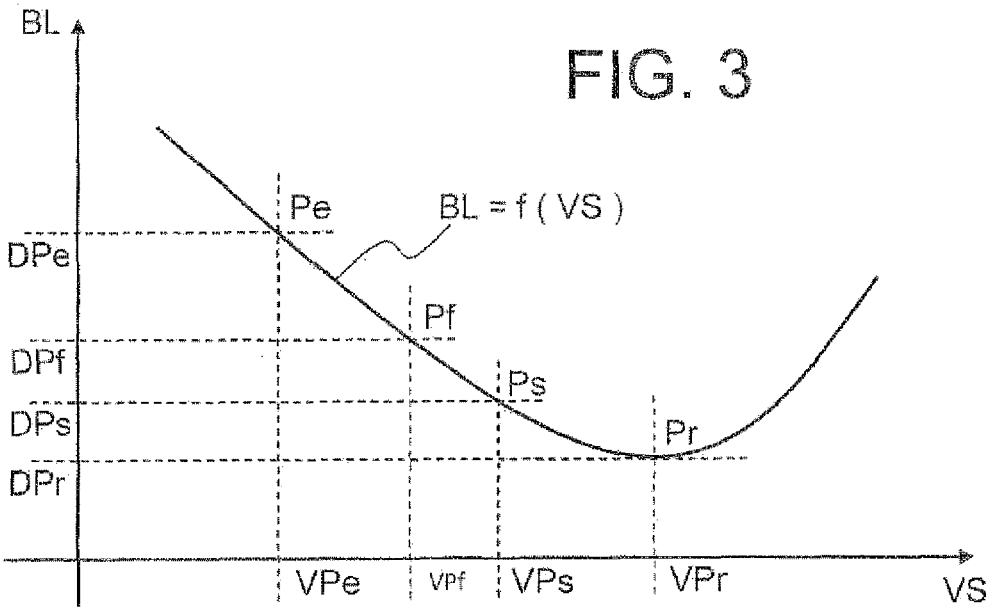
FIG. 3 is a curve indicating the evolution of the break-off distance as a function of the stimulation excitation.

A device for carrying out an example of a method for detecting an operational stimulation range in a printer will be described using FIG. 4. The operational simulation range is the range where the break-off quality is such that no transfer of charges between two successive drops of the jet occurs.

Numerical references identical to those of FIG. 1 designate identical or similar elements here.

This device therefore includes:

a drop generator 1 containing electrically conducting ink, kept pressurized, by an ink circuit, and emitting at least one ink jet 11, a charge electrode 4 for each ink jet, the electrode having a slit through which the jet passes, an assembly formed by two deflection plates 2, 3 placed on either side of the trajectory of the jet and downstream of the charge electrode 4, a gutter 20 for recovering the ink from the jet not used for printing in order to be returned towards the ink circuit and thus be recycled.

The operation of this type of jet has already been described above relative to FIG. 1. We will simply recall here that the ink contained in the drop generator 1 escapes from at least one calibrated nozzle 10 thereby forming at least one ink jet 11. Under the action of a periodic stimulation device placed upstream of the nozzle (not shown), for example made up of a piezoelectric ceramic placed in the ink, the ink jet breaks off at regular temporal intervals, corresponding to the period of the stimulation signal, in a specific location of the jet downstream of the nozzle. This forced fragmentation of the ink jet is usually caused at a so-called "break-off" point 13 of the jet by the periodic vibrations of the stimulation device.

Aside from the above means, such a device can also include means for checking and regulating the operation of each of these means considered individually, and the applied voltages. These means are described more precisely below in connection with FIG. 27.

Means can also be provided for supplying or bringing the various electrodes 2, 3, 4 to the various desired voltages. These means in particular include voltage sources.

On the trajectory of the jet, arranged downstream of the charge electrode 4 is a measuring device 6, e.g. an electrostatic sensor, which will make it possible to supply a signal of the type explained below.

Such a sensor is for example described in document EP 0 362 101, in which case it is placed between the charge electrode 4 and the deflection plates 2 and 3. It includes a conductive central element, preferably protected from the influence of outside electric charges owing to an insulating thickness and an outer conducting element, called guard electrode, connected to the mass.

Figure 4:
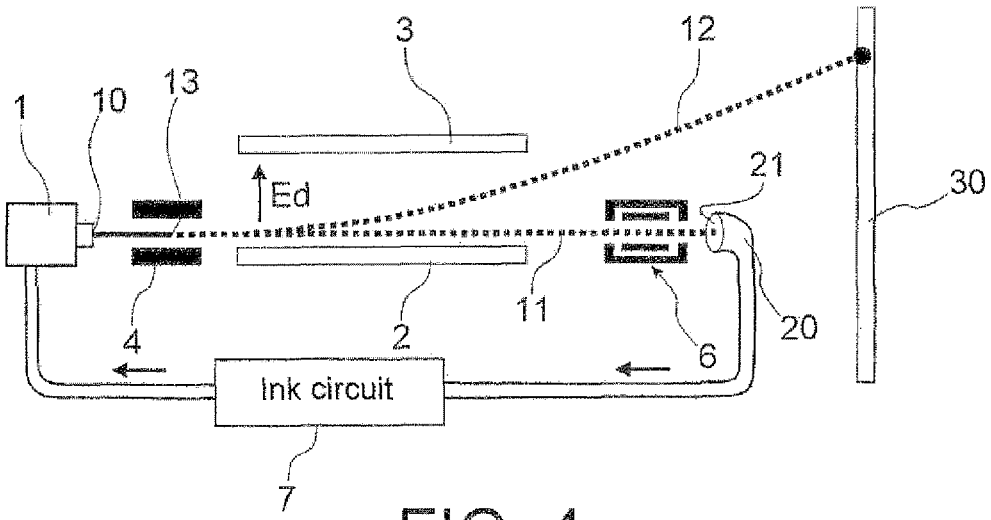
FIG. 4 is a diagram of a device for implementing one aspect of the invention.

It can also be of the type described in application WO2011/012641, in which case the sensor is advantageously positioned near the gutter, under the deflection plate 2 kept at 0 volt, as shown in FIG. 4. This sensor is shown in longitudinal cross-section in FIG. 5A. These 2 sensors provide signals of the same type.

Figure 5A:
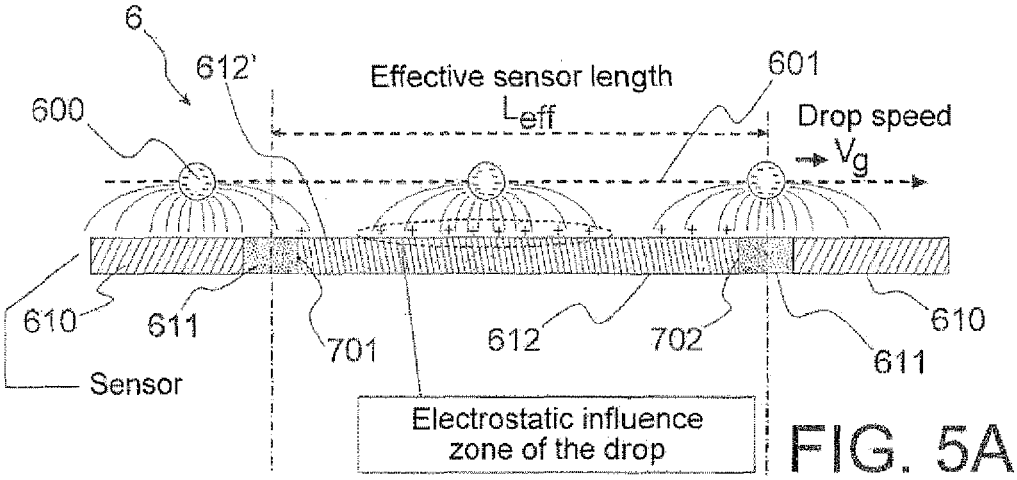
FIGS. 5A-5C show on one hand, a sensor structure and, on the other hand, a signal obtained with this type of sensor when a charged drop passes in front of it.

The sensor of FIG. 5A includes a portion made from electrically conducting material that constitutes the sensitive zone 612, separated from a portion made from an electrically conducting material and connected to the mass in order to produce electrical shielding, called shielding zone 610, through a portion made of an electrically insulating portion called insulating zone 611. These three zones 610, 611, 612 delimit a continuous planar surface. The planar surface 610, 611, 612 of the sensor is arranged near and in a plane parallel to the trajectory 601 of the drops 600. The upstream 701 and downstream 702 edges of the sensitive zone 612 relative to the direction of progression of the jet are substantially perpendicular to the nominal trajectory of the non-deflected jet.

Figure 5B:
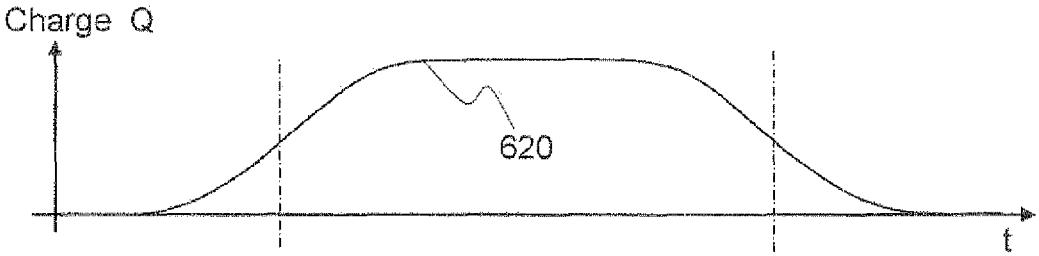

The passage of a charged drop 600 near the sensor 6 causes, thereon, a variation of the charge quantity. This charge variation is illustrated on the curve 620 as a function of the relative position of the charged drop in its direction of movement (FIG. 5B).

Figure 5C:
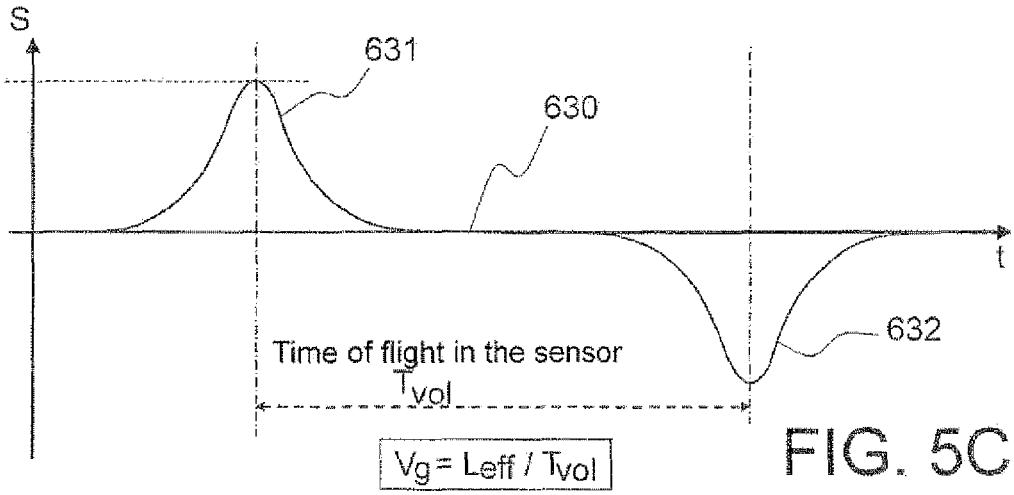

The signal produced by the sensor, which is the derivative of curve 620, yields a representative curve 630 (FIG. 5C) having an entry peak 631 and an exit peak 632 with a polarity opposite the first. The polarity of the entry peak is not necessarily positive as in the example of FIG. 5B; it depends on the polarities of the different electrical parameters, chosen in the implementation of the check of the head such as the charge voltage and the potential of the deflection plates, in particular.

The dynamics and the level of the signals depend on multiple factors, and in particular the distance between drops and sensor, the velocity of the drop, the width of the insulation, the sensitive zone surface present in the electrostatic influence zone of the drop. This electrostatic influence zone, illustrated in FIG. 5A, represents the domain of the area surrounding the drop, significantly influenced by the charges of that drop.

In the case where several drops of the jet are charged, the sensor adds, at each moment, the influences of all of the charged drops placed in its measuring field (which slightly protrudes on either side of the zone with width $L_{eff}$ identified in FIG. 5A, this zone essentially includes the portion 612). The resulting signal will evolve dynamically as a function of the charges that enter and exit its measuring field, but also as a function of the moments at which these charges enter and exit. The value of the signal is therefore sensitive to the inter-drop distances in the jet. The sensor is sensitive to the charge density variation (amplitude and velocity of that variation) present in a spatial zone delimited by the measuring field of the sensor.

For example, the physical dimensions of the different elements (size of the sensor, drop/sensor distance, . . . ), are such that the sensor integrates the influence of about 10 to 40 consecutive drops of the jet, separated from each other by a distance that can for example be between 150 μm and 500 μm, depending on the velocity of the jet, for example between 19 and 24 m/s, and the frequency of the drops, for example between 50 and 120 kHz. The jet passes at a distance of a few hundred micrometers, for example 700 μm, from the surface 612' of the sensor that faces the drops. When the high voltage THT of the deflection plates 2, 3 is stopped, the line of drops coming from the nozzle follows the nominal trajectory of the jet, regardless of the charge of the drops. The drops are steered towards the gutter and pass in front of the sensor.

It is known, in electrostatics (mirror charges), that the electric charges placed near a mass plane are attracted by that plane, due to the existence of "image" virtual charges, having a sign opposite that of the electric charges in question. These virtual charges are placed symmetrically to the latter, relative to said plane. This phenomenon occurs for the charged drops passing in front of the grounded deflection plate 2; they therefore undergo a slight deflection (called "Clarion" effect) which, in the practical case, will correspond to about a half-diameter of a drop for charge voltages in the vicinity of 300 V applied to the drops (or about −70 μm for a flight distance opposite the plate at the mass of about mm); these numerical values are provided for information, as they depend on the size of the printhead. While this phenomenon explains the slight trajectory variations of certain drops, it has no influence on the implementation of the described method.

If a single drop charged at a given value, present in a continuous line of uncharged drops, passes in front of the sensor, the latter will provide a signal integrating the effect produced by all of the drops present observed through the influence window of the sensor (measuring field), or a number of drops between 10 and 40. If the same charge as the sole drop of the preceding case is distributed over two consecutive drops of a line of drops, following, for example, a charge transfer, the sensor will integrate the effect of the assembly and it will be observed that the signal produced is practically identical to that of the preceding situation. This system is not capable of discriminating between the two situations and therefore cannot characterize the quality of the break-off, i.e. the presence or absence of a charge transfer.

To test the break-off quality according to one embodiment of the invention, each drop of a line of drops, with a length greater than that of the sensor, is charged at a significant voltage value (voltage of about 300 V, for example, and, more generally, a voltage for example between 200 and 350 V. The electrostatic repulsion forces between drops in flight are then powerful, but it is observed that the coherence of the line of drops is maintained. An equilibrium is established between the inertial, aerodynamic, and electrostatic forces: the appearance of the line of drops in flight is identical irrespective of whether it is charged. These conditions are very restrictive to test the quality of a break-off and its robustness relative to the charge transfer between consecutive drops. Usually, the tests intended to detect the operational stimulation range are done at a much lower voltage or a higher voltage but with isolated charged drops.

After a violent transitional reaction related to the passage of the initial edge of the line of drops charged at 300 V, the electrostatic sensor 6 before which the drops pass returns to equilibrium and provides a zero value, since it no longer detects charge variations (each drop at 300 V leaving the sensor's influence zone is replaced by a drop at 300 V entering the zone).

One of the drops of the line of drops will be charged at a value lower than that of the other drops. The electrostatic forces will therefore unbalance around the drop with the lower charge and the spatial distribution of the drops will change in the line. In one embodiment, the charge difference between the weakly charged drop and its surrounding drops, which are highly charged, is significant (for example, at least 100 V or 150 V or 175 V or 200 V or 225V or 250 V, as a function of the chosen size of the head); it is then observed that the less charged drop coalesces, or mixes, during flight, with the preceding drop, which is highly charged, for example under a voltage of 300 V.

The set of drops spatially repositions itself along its path to find a new equilibrium; when this new set passes in front of the sensor 6, the latter detects a strong overall charge variation.

It is observed that with the same implementation conditions, if the break-off quality is not sufficient, the tearing out of matter from the tail of the highly charged drop, which precedes the weakly charged drop, causes a transfer of charges towards the latter. Indeed, the new charge of this drop, which is stronger, modifies the forces in play and it is observed that the coalescence does not occur before reaching the sensor. The relative positions of the drops of this set rearrange themselves in the jet to meet a new equilibrium and one sees that the passage of this set in front of the sensor 6 causes a signal that is detectable, but has a low amplitude.

This behavior makes it possible to discriminate between the presence and absence of a charge transfer and therefore to characterize the break-off quality under very restrictive conditions.

The preceding general explanations will be reiterated with an example of a concrete embodiment.

We will first consider a set of adjacent drops charged at 300 V.

Figure 7A:
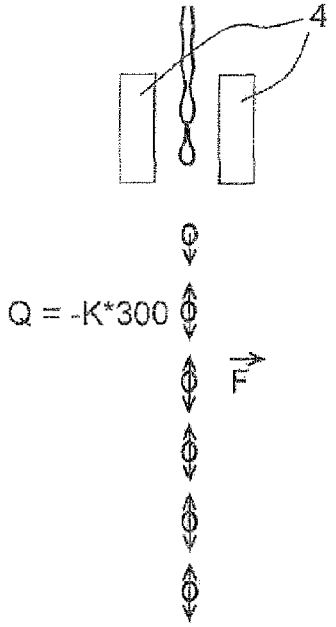
FIGS. 7A-7D show various lines of drops charged at several hundred volts, without a weakly charged intermediate drop (FIG. 7A), and with a weakly charged intermediate drop (FIGS. 7B-7D)

As illustrated in FIG. 7A, upon passage in the charge electrode 4, each drop charged at 300 V generates a repulsion force F towards the drop preceding it and the drop following it.

All of the drops take on the same charge quantity Q=−K*300V, so the forces balance out, the drops remaining equidistant from each other with a distance equal to λ (wavelength), with:

$$F=Q_1*Q_2/\lambda^2=Q^2/\lambda^2$$

where $Q_1$ represents the charge of a first drop, while $Q_2$ represents the charge of a second drop. An example of a value for λ is about 310 μm, but can assume values between 150 μm and 500 μm depending on the size of the head, which in particular defines the speed of the jet and the frequency of the drops.

Figure 8A:
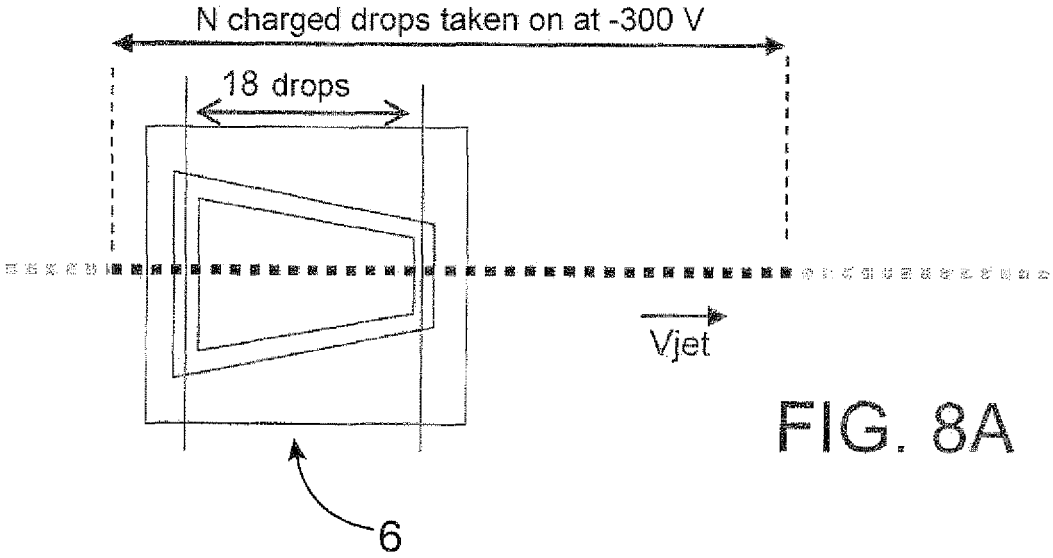
FIGS. 8A to 8C show a line of drops passing in front of a sensor and the obtained signals, this line being substantially larger than the length of the sensor.

As illustrated in FIG. 8A, the drops are still equidistant when they pass by the sensor 6 (in the example used: λ=310 μm).

When the initial edge of the set of charged drops passes in front of the sensor 6, the charge quantity caused (the charges are negative here) at the surface thereof increase to stabilize at a constant value, while all of the drops seen by the sensor transport the same charge (−K*300 V), and the equidistance between the drops is respected. Then the charge quantity induced decreases when the final edge of the line crosses the active zone of the sensor. We therefore have a curve of the type shown in FIG. 8B. The theoretical current signal generated by the sensor (Ic=dQ/dt) is shown in FIG. 8C: the signal remains null between the significant disruptions of the entry and exit of the set of charged drops.

Figure 9:
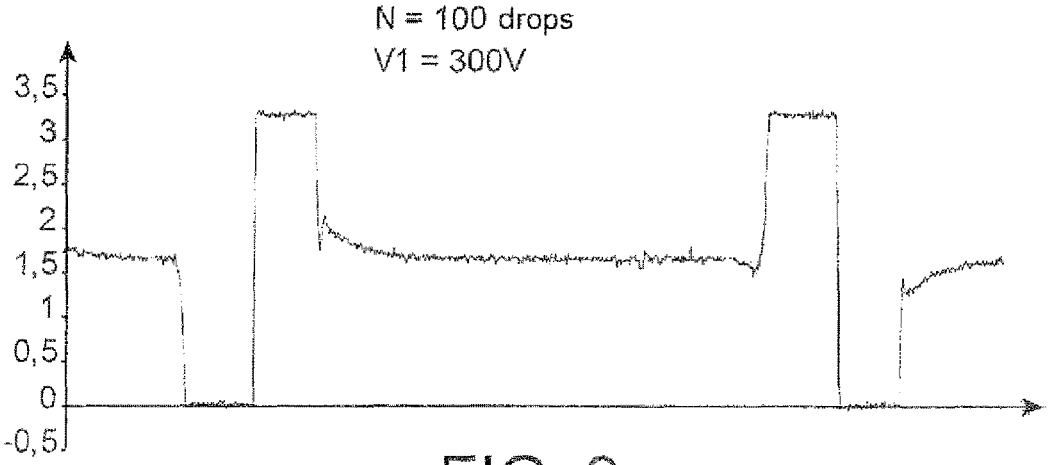
FIG. 9 shows an example of an actual signal obtained during the passage of a line of drops charged at 300 V.

FIG. 9 shows an example of an actual signal obtained during the passage of a line of about one hundred drops highly charged, at about 300 V.

Figure 8B:
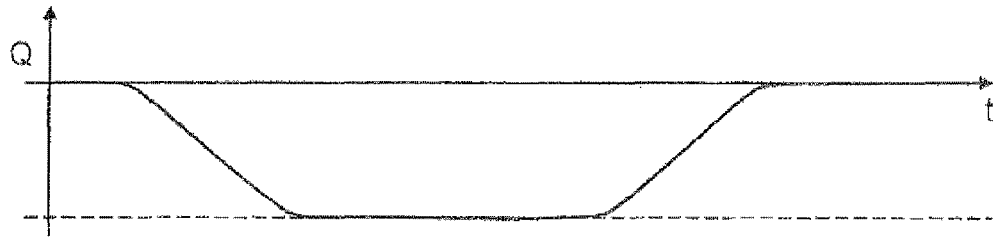
Figure 8C:
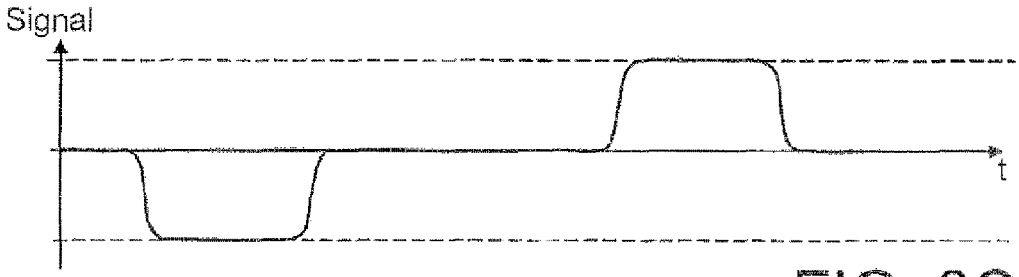

According to the preceding explanations relative to FIGS. 8B and 8C, the signal should include a peak upon passage of the initial edge of the line of drops and a peak with inverse polarity upon passage of the final edge. However, the charge quantity causes a very strong stress of the sensor and its amplifier. The amplifier saturates, then desaturates during the passage of the edges, which generates, for each edge, the illustrated bipolar signal; however, when the charge quantity is stabilized, the amplifier returns to a normal operation and the signal becomes null again despite the charges present opposite the sensor.

Figure 6:
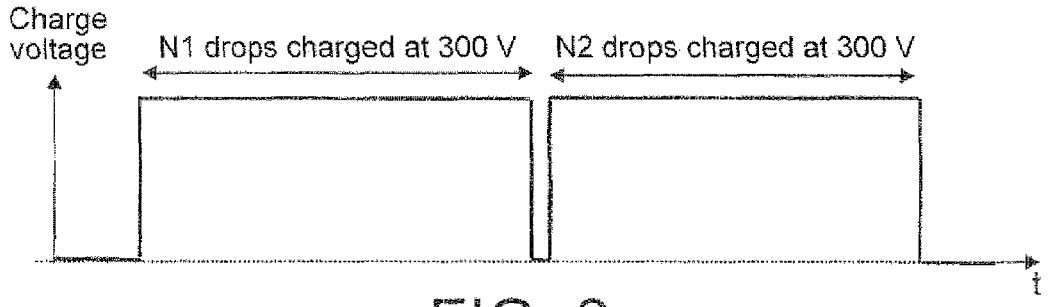
FIG. 6 shows a measurement voltage sequence applied to a line of drops, one drop being at 0 V, preceded by N1 drops charged at 300 V and followed by N2 drops also charged at 300 V.

FIG. 6 shows a measuring voltage sequence applied to a line of drops, one or several drop(s) being at 0 V or being weakly charged. Below we will use the example of a single drop charged at 0 V. The cyclical charge ratio is chosen at 50%. To correctly charge a drop, one first determines the charge phase (i.e. the moment of the charge start in the drop period), and then applies the charge window for a time shorter than the drop period. Here we have chosen to apply the charge voltage for 50% of the drop period. This value is the value that appears to yield the best results, initially.

This drop is preceded by N1 (N1>50) drops charged at 300 V and followed by N2 (N2>50) drops, which are also charged at 300 V.

N1 and N2 are preferably chosen to be substantially greater than the number of drops present, at a given moment, in the field of the sensor, in order to be able to better isolate the useful part of the signal from the transitional parts, which occur during the entry and exit from the sensitive or influence zone of the sensor, of the line of highly charged drops. In one example of a chosen head size, N1 and N2 are substantially greater than 20. Practically, we have used a value of N1=N2=50.

The voltages of FIG. 6 are those that are applied to the charge electrode 4 of the device of FIG. 4: it is these voltages that will make it possible to charge, or not charge, the drops.

Figure 7B:
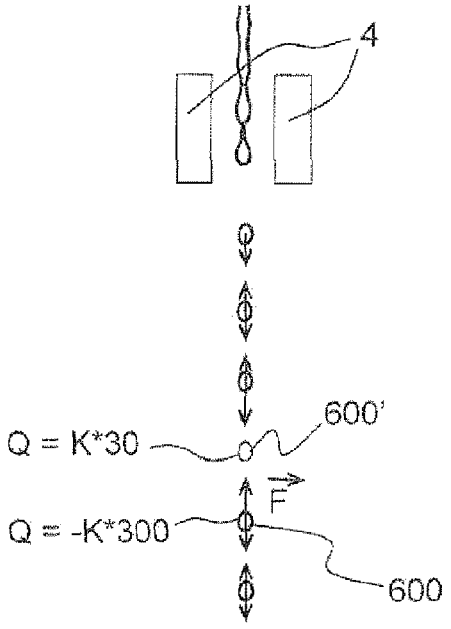

FIG. 7B shows the situation of the drops in flight shortly after the break-off and the charge of the drops in the charge electrode 4. A drop 600', called test drop, which is weakly charged (or charged at a low voltage V2, which can be equal to 0 V, in which case the drop is not charged at all), is placed between two lines of highly charged drops, as explained above relative to FIG. 6.

The test drop 600', even charged at 0 V, despite everything takes on a so-called "historic" charge of about K*30 V. This phenomenon is explained by the fact that the preceding drop, which is highly charged, behaves like a charge electrode relative to this test drop and generates a charge of the test drop corresponding to about 10% of its own charge, and with an inverse polarity, or K*30. The equilibrium of the forces that existed in the line of drops charged at 300 V is broken. The drops, on either side of the weakly charged drop, are pushed back towards the test drop by the other highly charged drops. A spatial imbalance of the drops is initiated.

The further the line of drops gets from the break-off, the more the imbalance increases.

From a certain distance between the break-off of the jet and the test drop (typically 20 mm), the latter coalesces with a highly charged drop, preferably with the one that precedes it, due to aerodynamic effects.

The spatial imbalance is then maximal, because the situation can be likened to the disappearance of a drop in the jet. The distances between drops are therefore no longer equal to the concerned jet portion.

For highly charged drops, under a voltage of 300 V, and a weakly charged drop, under a voltage of 0 V, it was possible to view the progression of the spatial imbalance of the drops when they move away from the break-off; if d is the distance between the break-off and the observed drops:

- at a distance d between 15 mm and 18 mm, we see a spatial imbalance of the line of drops without coalescence,
- at a distance d of about 19.5 mm, we see a spatial imbalance of the line of drops with the beginning of coalescence between the weakly charged drop and the highly charged drop preceding it,
- at a distance d of about 20 mm, we see a spatial imbalance of the line of drops with coalescence of the weakly charged drop and the highly charged drop preceding it,
- at a distance d between 20 mm and 22 mm, we see a spatial imbalance of the line of drops with coalescence of two drops.

The coalescence of two drops, under the conditions indicated above (one at about −K*300 V and the other at about K*30 V), appears from about 20 mm under the break-off. If the inlet of the sensor 6 is placed at, for example, 30 mm from the break-off (or, more generally, a distance greater than 20 mm), the coalescence and its detection are ensured.

Under these conditions, it was also possible to see that the spatial imbalance concerns about 7 to 8 drops.

It is also possible to observe the "Clarion" effect, described above, on the charged drops passing near the deflection electrode 2 put at the voltage of 0 V. Before arriving in front of the sensor 6 in the head configuration shown in FIG. 4, they are slightly attracted by this electrode 2 and therefore undergo a slight deflection. But the coalesced drop being heavier, it is slightly less deflected: the difference between the two deflections at the sensor is about a half-diameter of a drop.

Figure 10:
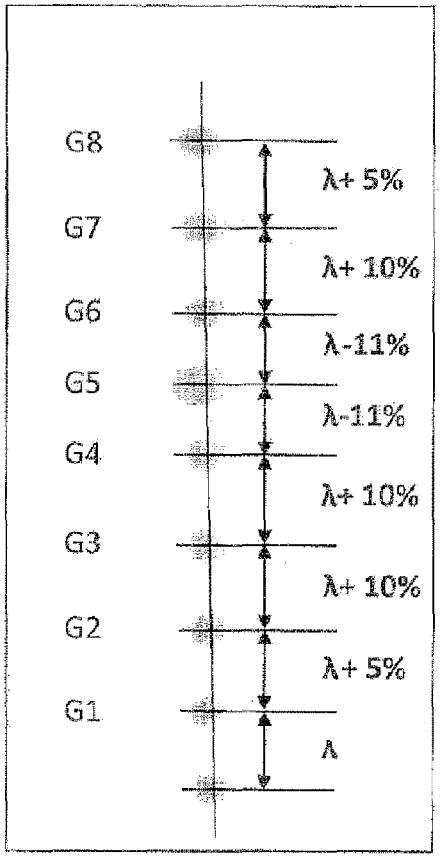
FIG. 10 is an image of a line of drops with a spatial imbalance between the drops in the case of a coalescence of 2 drops.

FIG. 10 is a print illustrating the measurement of the spatial imbalance opposite the sensor when the coalescence occurs. In this figure, letters G1-G8 identify each of the 8 drops concerned by the imbalance, G5 being the drop resulting from the coalescence of two drops; it has a cumulative charge of the same order as the other drops. The distances measured between two successive drops, relative to the distance λ, is also shown.

It is shown that the coalescence of two drops frees up space in the line of drops, and makes it possible to increase the distance between two successive drops, the repulsion forces balancing out differently.

The spatial imbalance starts with:

- the increase of the distance between G1 and G2, G2 and G3, G3 and G4 (this distance is then strictly greater than λ, for example between λ+5% and λ+10%),
- the reduction of the distance between G4 and G5, and G5 and G6 (to a value for example substantially between λ−5% and about λ−10%, here λ−11%),
- then, again, an increase is seen in the distance between G6 and G7, and between G7 and G8 (this distance is then strictly greater than λ, for example between λ+5% and λ+10%).

We will now explain, in more detail, the signal observed during the spatial imbalance on 8 drops.

The signal starts with the strong disruption related to the initial edge of the N1 drops having a strong charge taken on at, for example, −K*300 V. This group of drops will be called "Group 1."

The passage of the initial edge of this "group 1" in the sensor 6 causes a double signal peak, as explained above relative to FIG. 10.

When all of the drops seen by the sensor are at −K*300 V, the measured signal becomes null. The sensor only sees drops charged at 300 V with a regular spacing of λ.

The signal remains null as long as the drops, which exit and reenter the sensitive zone of the sensor, are at the same potential and are equidistant.

Indeed, the charges that leave the sensitive zone are replaced by the same charges and at the same speed: there is therefore no signal variation.

Figure 12:
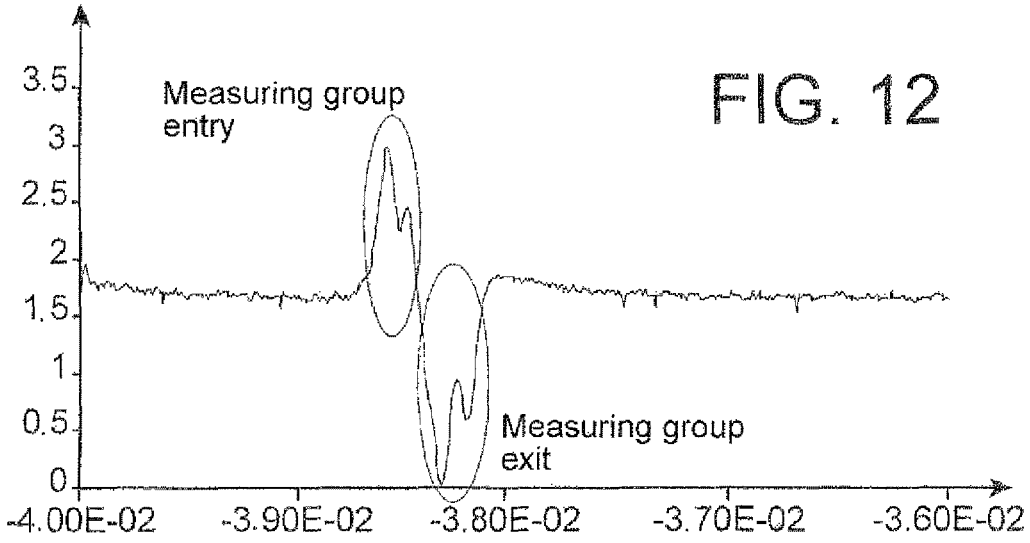
FIG. 12 is a signal measured during the passage, in front of the sensor, of a group of drops having a spatial imbalance in the case of a coalescence of two drops.

As illustrated in FIG. 12, the entry of the group of 8 drops (called "measuring group") in the sensitive zone of the sensor 6 will create a variation of the sensor's signal: indeed, the drops in "group 1" exit the sensor, but are no longer replaced at the same rhythm because the "measuring group" has drops that are not equidistant relative to each other, even if the charges are substantially identical, as explained above.

Globally, the 8 drops in the "measuring group" are further from each other than those of group 1, which therefore creates a positive signal peak (the charge density decreases).

In FIG. 12, the double peak on each of the parts corresponding to the entry of the measuring group in the sensor 6 and the exit of the measuring group from the sensor 6 is related to the expansion (first peak) over three inter-drops (G1 to G4), then the contraction (dip) over two inter-drops (G4 to G6), then a new expansion (second peak) over only two inter-drops (G6 to G8).

This type of measurement is obtained when the break-off is of good quality and there is no charge transfer between the drop at 0 V and the one preceding it, charged at 300 V.

We will now explain the signal observed with a break-off favoring the transfer of a charge between two drops, one of which is highly charged, for example at 300 V, and the other of which is weakly charged, for example at 0 V.

Figure 7C:
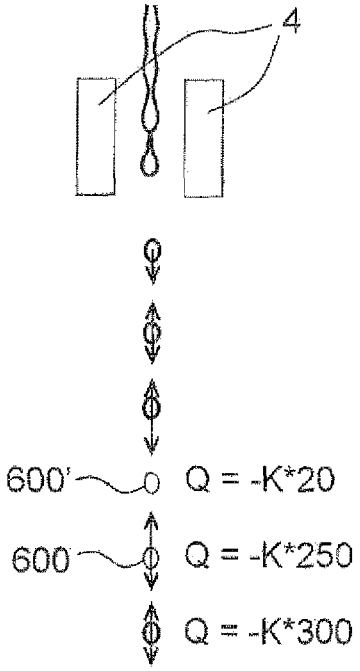

The situation is then as illustrated in FIG. 7C.

When the tearing out of matter occurs (in the case of a poor break-off quality), the highly charged drop 600 transfers a charge quantity to the drop 600', which is weakly charged, that follows it.

It was estimated that the transferred charge quantity was in the vicinity of K*50 V. Therefore, the drop 600 loses a charge of −K*50 V and the drop 600' gains a charge of −K*50 V. In this case, the group of 8 drops includes a drop 600 whereof the charge has become −K*250 V and a drop 600' that has recovered a charge of −K*50 V in addition to the historic charge of about K*30 V, or a resulting charge of −K*20 V.

The electrostatic forces brought into play are no longer of the same order as before and the spatial imbalance is also no longer the same.

Figure 11:
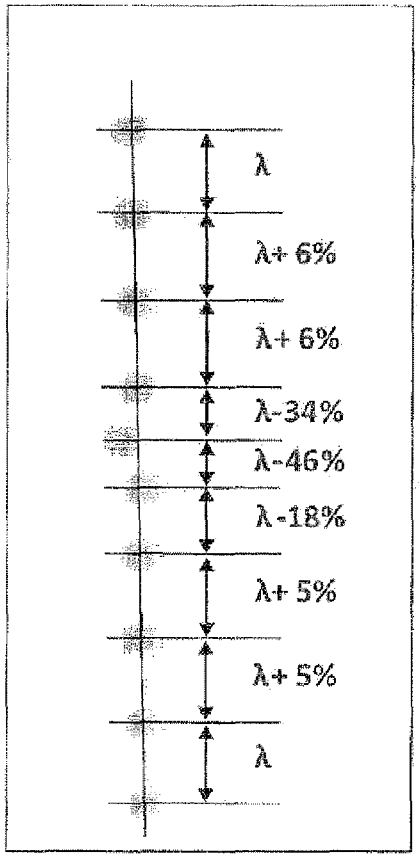
FIG. 11 is an image of a line of drops with a spatial imbalance between the drops when the coalescence does not occur.

At the sensor, the drops do not coalesce anymore. The spatial imbalance still exists, but is very different. It can be observed on the print of FIG. 11, which shows the particular position of the uncharged drop and the distribution of the other drops in the jet.

Figure 13:
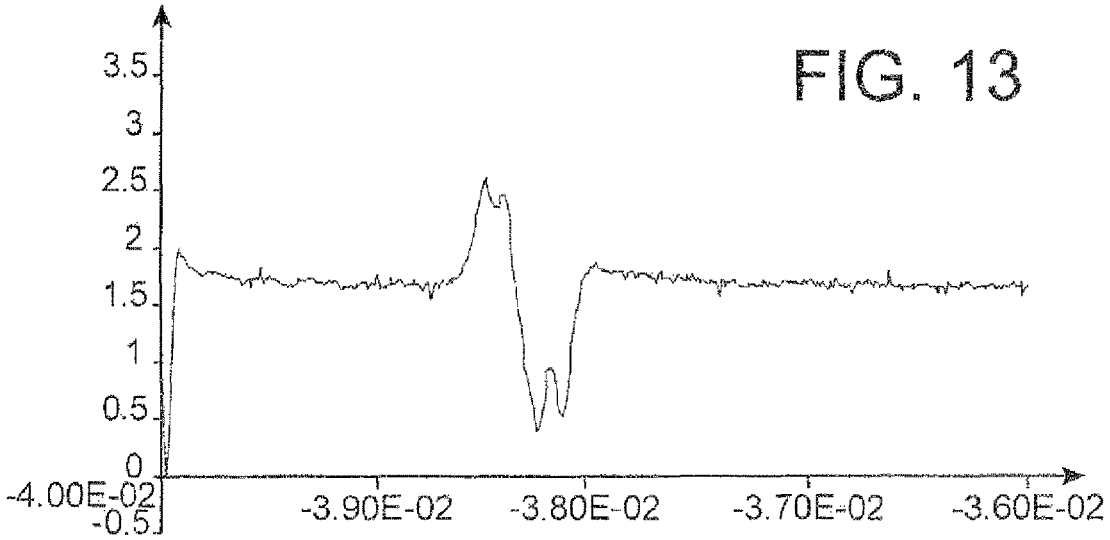
FIGS. 13 and 14 are, respectively, signals measured during the passage, in the sensor, of a group of drops without coalescence and a group of drops in which a tearing out of matter has occurred on all of the highly charged drops.

FIG. 13 shows the signal then measured by the sensor 6.

Two parameters cause a variation of the measured signal:

the presence of a spatial imbalance, the modified charge of the two drops 600, 600' that did not coalesce, at, respectively, −K*250 V and −K*20 V (−K*50 V+historic charge).

The signal variation, upon passage of the measuring group, is lower than in the presence of a coalescence; it is possible to see a difference of about 40% between the maximum values of the signal.

The transition from the coalescence regime without charge transfer to the non-coalescence regime with charge transfer, both of which are described above, will depend on the quality of the break-off, which itself depends on the voltage applied to the piezoelectric means.

The explanations above therefore clearly show that the response difference between the situation with coalescence and the situation without coalescence of the drops makes it possible to discriminate between the voltage values applied to the piezoelectric means that may or may not lead to a tearing out of matter with charge transfer.

Figure 14:
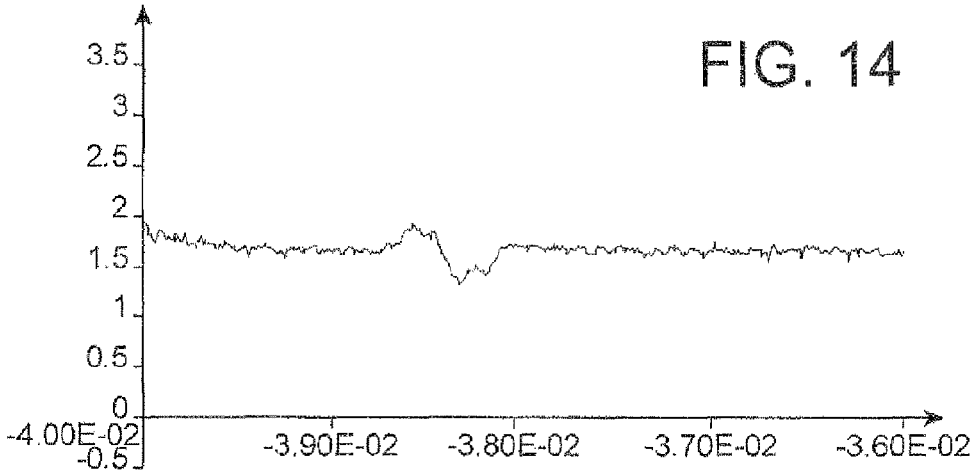

A third type of behavior has been observed corresponding to a break-off favoring the tearing out of matter on all of the drops charged at 300 V in the line of drops. FIG. 14 shows the signal then obtained by a test as described above. One can see that the signal clearly has a much lower intensity than in the situations previously described.

Figure 7D:
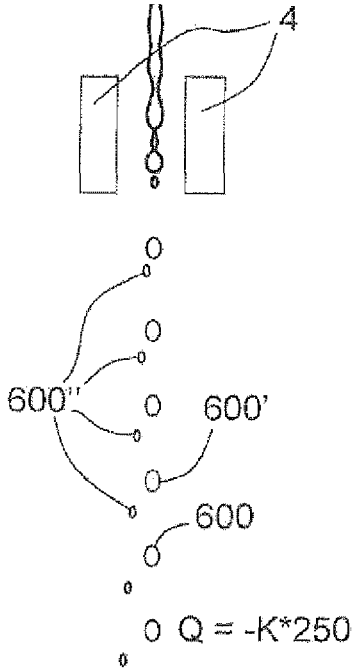

This new situation, illustrated in FIG. 7D, corresponds to the case where the excitation voltage of the piezoelectric means is greater than a threshold value: the shape of the break-off is then such that a tearing out occurs on all of the highly charged drops. Given the electrostatic forces in action, the particles cannot combine with the surrounding highly charged drops.

The jet never being perfectly centered in the charge electrode, the particles 600" resulting from the tearing out of matter undergo an electrostatic force that is low, but sufficient in light of their mass, which deflects them towards the closest face of the charge electrode.

These particles 600" then dirty one of the deflection plates towards which they are deflected.

The drops, which are initially highly charged, e.g. at 300 V, take on a lower charge quantity, which can be estimated at −K*250 V.

The electrostatic forces are then decreased relative to the situations of FIGS. 7B and 7C described above. The repulsion forces undergone by the drops are therefore weaker, as well as the spatial imbalance between the drops; the measured signal level is therefore also lower, which is shown by FIG. 14.

It can be seen that the coalescence of the drops is not necessary to differentiate between the two situations: even without coalescence, the rearrangement of the drops in the jet remains different enough between the two situations to tell them apart; but, in general, the level deviation is low and the detection is delicate to do reliably.

Figure 15:
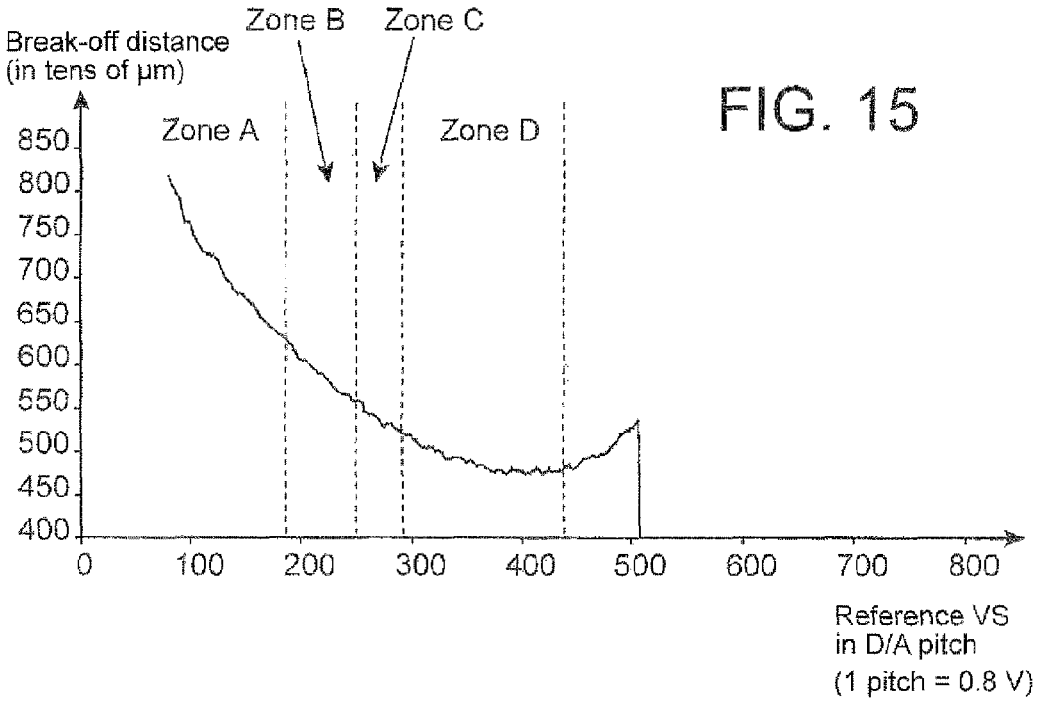
FIG. 15 is a curve indicating the evolution of the break-off distance as a function of the excitation of the stimulation, with the mention of different operating zones A-D, FIG. 16 diagrammatically illustrates two voltage levels, one (V1) applied to the highly charged drops, the other (V2) applied to the weakly charged drops.

FIG. 15 connects the curve BL=f (VS), which provides the break-off distance BL, as a function of the voltage VS applied to the piezoelectric means. It summarizes the three situations detected by measuring the spatial imbalance of the drops and the distribution of their charges, as explained above. It will be recalled that the break-off distance measures the deviation between the position of the break-off and the ink ejection nozzle.

The curve of FIG. 15, like others that will be presented later, was obtained with actual means; the units used on the axes are defined as follows: BL is measured in tens of microns (700 equals mm) and VS is defined in number of pitches of a digital/analog converter, one pitch being equal to 0.08 volt.

Corresponding to each of these situations is one of the zones defined by the range of voltages applied to the piezoelectric means:

zone A, which is the non-functional under-stimulation zone where the printing is of poor quality: the break-off then has a regime in which slow satellites appear, zone B, functional, which corresponds to correct printing: the spatial imbalance is maximal and results from a coalescence of the test drop with the preceding one and a maximal measured signal, zone C corresponds to printing that is not correct: a tearing out of matter then occurs on the drop that follows the test drop and a charge transfer occurs between those two drops. The coalescence does not occur and the spatial imbalance is lower than in the preceding zone, the amplitude of the measuring signal decreases, zone D also corresponds to a printing that is not correct: one then sees a tearing out of matter on all of the drops, and a very low spatial imbalance: the coalescence of the drops does not occur and the measuring signal is very weak. Moreover the electrodes become dirty.

It is understood that zone B corresponds to the desired stimulation range.

Figure 16:
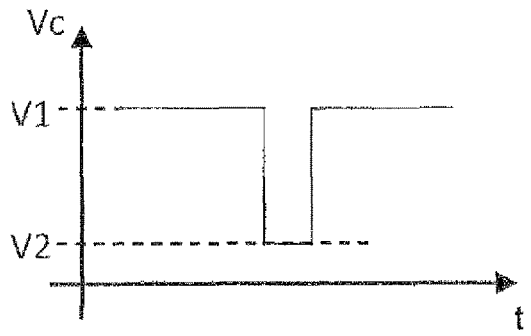

In the results that will be described below, the notations V1 and V2 are used for the highest voltage applied to the line of drops, and the lowest voltage, which is applied to the drop isolated between two lines of charged drops, respectively. These voltages are shown diagrammatically in FIG. 16.

Tests have been carried out with different voltages V1 and V2 in order to identify the value ranges producing a measuring signal that can be used reliably.

It was possible to see that, for the highest charge voltage V1 applied to most of the drops, it is preferable to select a minimum value of 200 V to 250 V, preferably still close to 300 V.

It was also possible to see that the adjustment of the voltage V2 of the isolated drop 600' makes it possible to best ensure the coalescence of the measuring drops. The tests done to define V2 are explained below:

First, the stimulation voltage is positioned in the good printing zone (zone B) and this situation is verified using printing tests.

Then, the amplitude of the signal peak is measured (in volts at the output of the amplification chain of the sensor) as a function of the voltage deviation between V1 and V2 (in volts), for V1=300 V and V2 varying from 250 V to 0 V.

For each measurement of the signal with the sensor 6, one verifies whether the coalescence of the drops is present.

Figure 17:
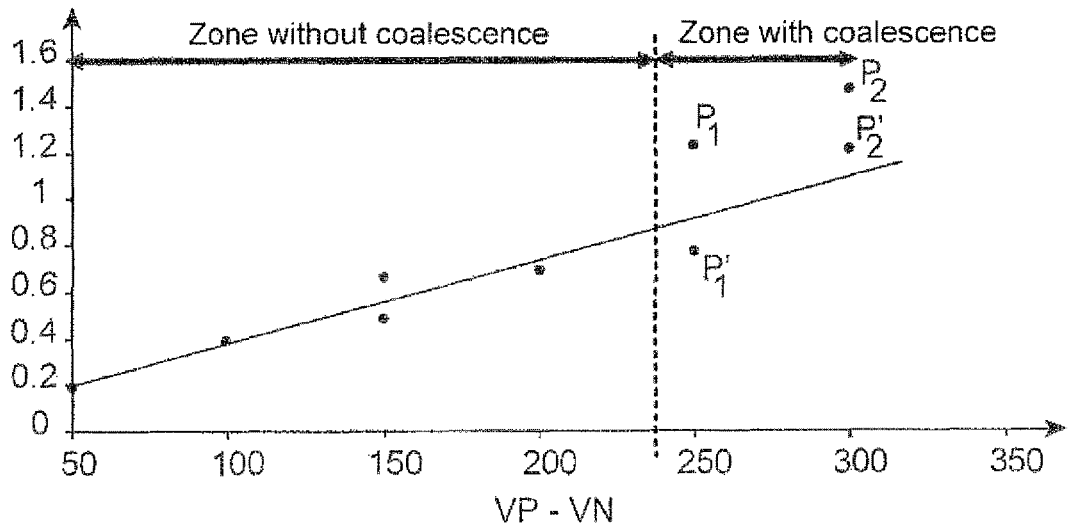
FIGS. 17 and 18 show the evolution of the maximum of the measured signal as a function of V1−V2.

FIG. 17 provides the results of these measurements done in zone B. In this figure, the points corresponding to the absence of coalescence line up substantially on a straight line obtained by linear regression. For points P1 and P2, corresponding to the appearance of the coalescence, we see a net shift of the signal levels relative to that line.

It can be concluded from this graph that, to best ensure the coalescence, it seems preferable that VD=|V1−V2| or, at minimum, around 250 V.

A value of VD=300 V seems to ensure the maximum spatial imbalance when the break-off is correct.

The coalescence moment of the drops not being a temporally stable and controllable phenomenon, a fluctuation of the amplitude of the signal is seen on successive measurements. Indeed, the spatial rearrangement of the drops from the measuring group is not completely identical upon each measurement, even when the situation is identical. These fluctuations cause the presence on the graph of FIG. 17, of two measuring points (P1, P'1 and P2, P'2) for two different voltages V2 representing the amplitude of the fluctuations.

The preceding measurements were also done for three piezoelectric excitation voltages (each of them corresponds to a previously defined zone B, C and D, cf. FIG. 15 and the corresponding comments).

Figure 18:
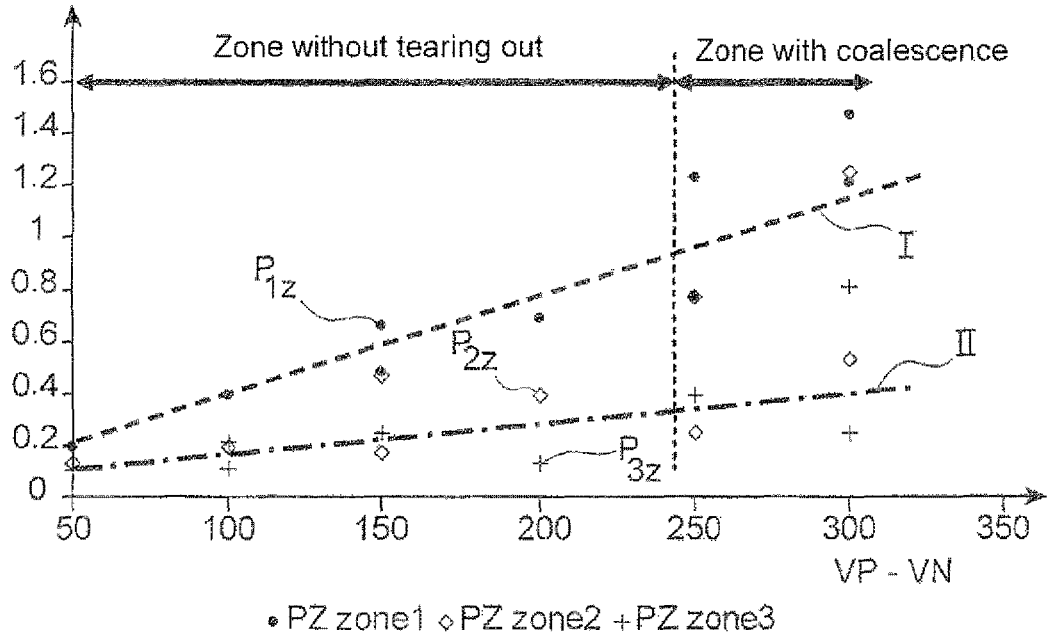

The measurements obtained are reported in FIG. 18, in which there are three sets of points corresponding to the three excitation voltages tested. It is specified that two points situated on the same x-axis indicate a fluctuation interval:

- points, identified by black circles (one of them is referenced $P_{1Z}$) correspond to points of zone B of FIG. 15, the points of the domain where there is no tearing out of matter aligning on line I,
- points, identified by diamonds (one of them is referenced $P_{2Z}$), correspond to points of zone C of FIG. 15, the measurements fluctuate considerably,
- points, identified by plus signs (one of them is referenced $P_{3Z}$), correspond to points of zone D of FIG. 15, the points of the domain aligning on line II.

Still in FIG. 18:

- line I represents the signal measured in zone B, when the drops charged at 300 V take on their charge completely,
- line II represents the signal measured in zone D, when the drops charged at 300 V lose part of their charge.

If there was no loss of charge on all of the drops in zone D, the two curves I and II would be close. However, this is not the case. This therefore confirms the tearing out of matter, without charge transfer, on all of the drops in zone D.

Figure 19:
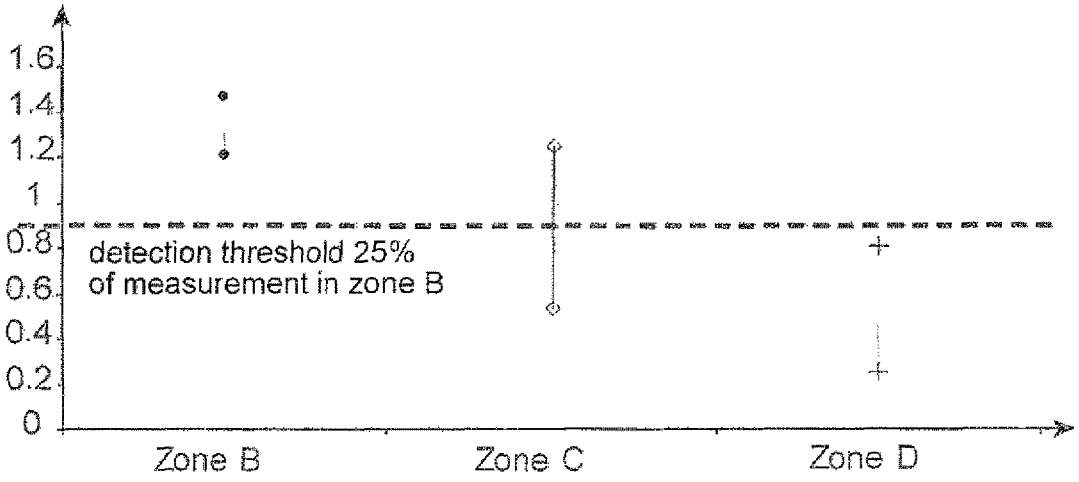
FIG. 19 shows the fluctuation range of the maximum of the signals for the three zones B to D and for V1−V2=300 V.

If we look at the points of the x-axis VD=V1−V2=300 V of FIG. 18, which corresponds to V1=300 V and V2=0 V, we see that the three zones B, C and D are identified by fluctuation domains separate from the measuring signal. These three domains are reported in the graph of FIG. 19.

They overlap in part. But, by placing a detection threshold at about 25% below the domain of the signal of zone B, we unambiguously identify zone B (when all of the measurements are above the threshold), zone C (when a significant proportion of the measurements are below the threshold), and zone D (when all of the measurements are below the threshold).

This result can be used to detect the tearing out of matter when a stimulation voltage is tested, because despite the fluctuations on the measurement, the levels of the signal drop significantly to be discriminating.

Figure 20:
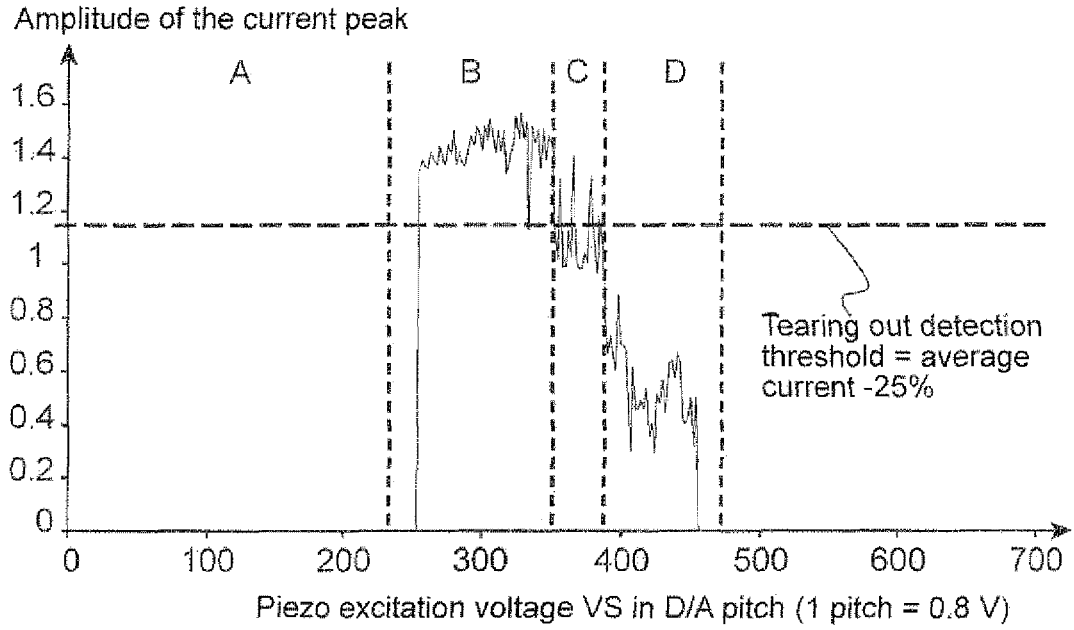
FIG. 20 shows the evolution of the maximum amplitude of the measured signal as a function of the voltage applied to the piezoelectric means.

The graph of FIG. 20 provides, for an example of a given printer configuration, the evolution of the level of the signal (in volts at the output of the measuring chain) as a function of the piezoelectric excitation voltage VS (in D/A converter pitch). To that end, an increasing scanning of VS is done from a value close to the entry point Pe of zone B. Zones A to D are shown by vertical strips as in FIG. 15. In the graph, the good printing range (zone B) is situated substantially between 220 and 350 D/A pitch, in the example shown. The measurement was done up to a turning point (here situated at about 450 D/A pitch). The printing quality is poor starting at about 360 D/A pitch.

This FIG. 20 shows that:

- in the good printing zone B, the measurement of the level of the signal is maximal and evolves around an average value,
- once the tearing out appears, certain level measurements of the signal are below at least 25% (threshold) relative to the preceding measurements (note that the 25% deviation here corresponds to about 0.3 volt).

To do away with the measurement fluctuation, upon each level measurement of the signal, the new measurement obtained can be compared with the average of the preceding measurements. Once the deviation is above the detection threshold (here 0.3 volt), the tearing out of matter that corresponds to the entry into zone C is detected. The piezoelectric stimulation voltage for which the tearing out is detected for the first time makes it possible to choose the value of VPs.

Preferably, the scanning of VS is stopped once the tearing out is detected, in order to prevent dirtying the head.

Figure 21:
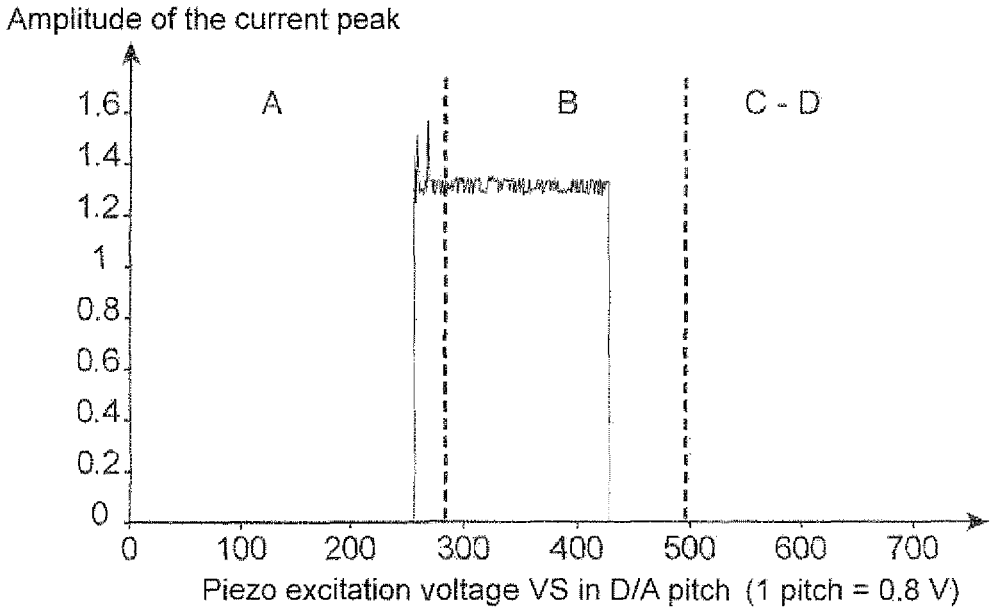
FIG. 21 shows the evolution of the maximum amplitude of the measured signal as a function of the voltage applied to the piezoelectric means, in the absence of tearing out of matter before the turning point.

FIG. 21 shows the graph of the evolution of the level of the signal as a function of the piezoelectric excitation voltage in another configuration where the tearing out of matter does not occur before the turning point. It therefore involves the measurement obtained when the printing quality is correct until the turning point or even beyond. There again, the correct printing zone B is represented by a vertical strip, located substantially at the middle of the graph, and delimited, here, by values of VS between a lower value substantially below 300 D/A pitch and an upper value that is equal to about 500 D/A pitch. In this case, the evolution of VS (scanning) is stopped when VS reaches the stimulation voltage VPr corresponding to the turning point. Indeed, stimulation voltage values greater than VPr lead to less robust behaviors of the break-off.

The preceding explains the method for detecting the exit point Ps of zone B.

If the treating out of matter test is launched for an excitation voltage value V below VPe (the excitation voltage of the entry point of zone B (i.e. in zone A)), the head may be dirtied. One then seeks to determine the value of VPe, then to perform the tearing out of matter test for various values of the excitation voltage, from the value VPe.

We will now describe a method for determining the entry point Pe. It is understood, for example according to the structure of the curve of FIG. 3, previously established, that it is possible to determine either the voltage VPe applied for this point, or the break-off distance DPe for that same point. It is recalled that the break-off distance is the distance between the break-off point and the outlet of the nozzle 10 producing the jet.

For a given ink and regardless of the temperature, a connection has been shown between the distance DPr of the turning point and the break-off distance DPe of the entry point. One will therefore look experimentally for the law that connects DPr and DPe3 for each ink or group of inks having the same law. To that end, one tries, experimentally, for each ink, and for several test printers (to take the manufacturing dispersion into account), the turning point Pr, and the entry point of the stimulation range Pe for several operating temperatures.

Figure 22:
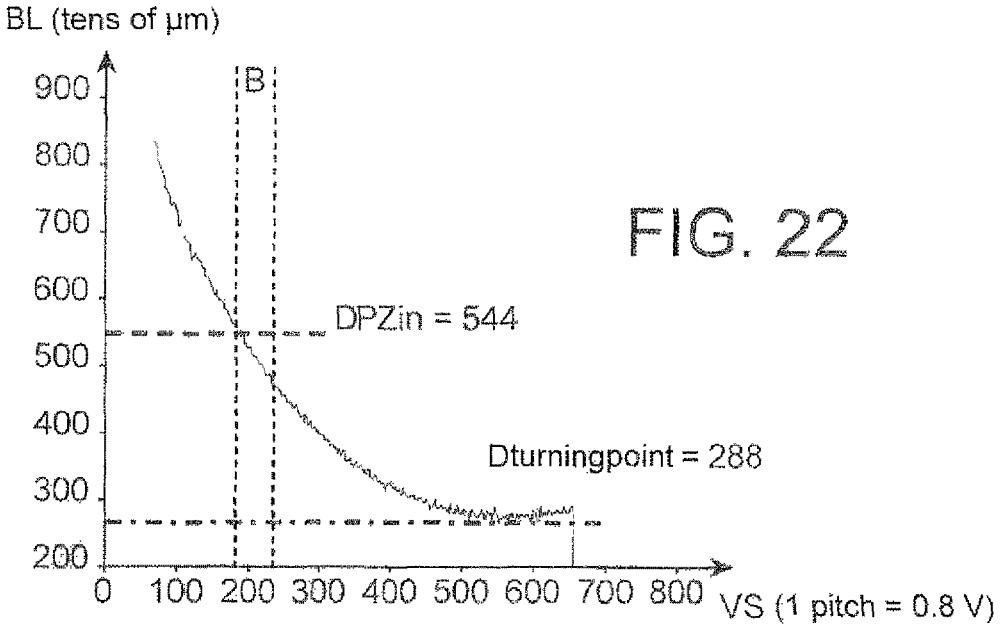
FIGS. 22-24 are curves of the evolution of the break-off distance as a function of the excitation of the stimulation, for different types of ink.
Figure 23:
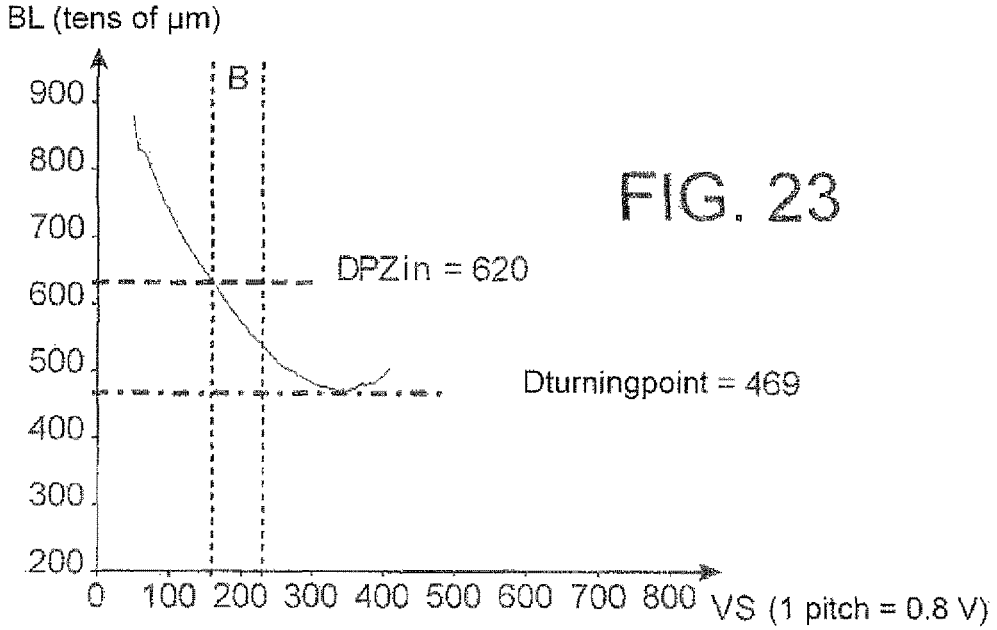
Figure 24:
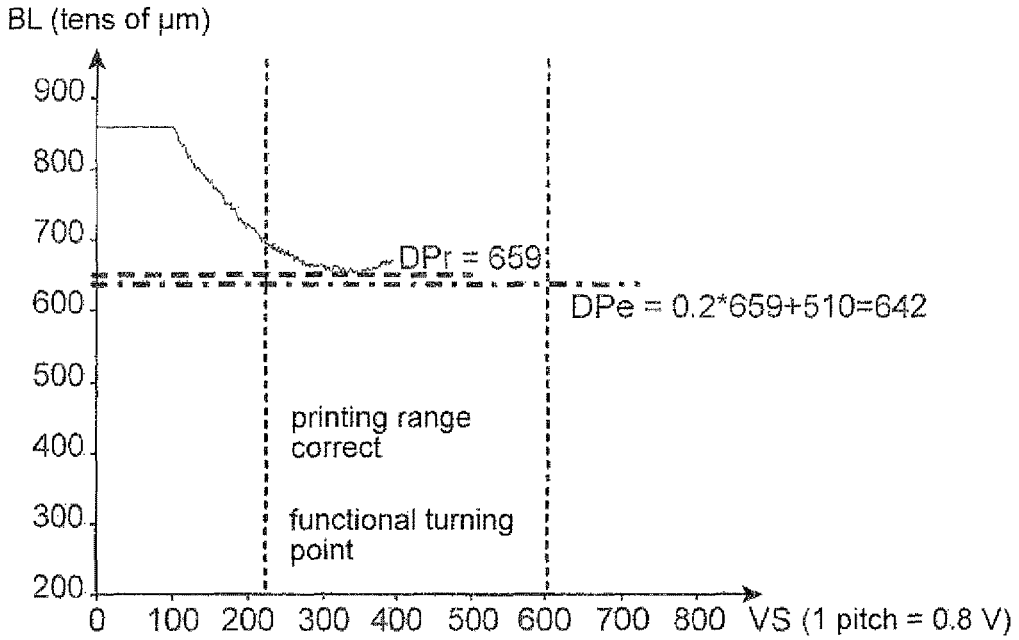

Thus, FIGS. 22, 23 and 24 represent the evolution of the break-off distance in tens of μm, as a function of the excitation voltage VS, D/A converter pitch, respectively, for 3 different inks referenced E1, E2 and E3:

- ink E1, at 0° C., and for a jet velocity of 20 m/s,
- ink E2, at ambient temperature, and for a jet velocity of 20 m/s,
- ink E3, at ambient temperature, and for a jet velocity of 20 m/s.

It will be noted that the same data can be obtained for jet velocities other than 20 m/s, if the configuration of the printer is different, and in particular if the jet velocity is different from 20 m/s.

A compilation of results obtained at different temperatures with around twenty test printers makes it possible to deduce, by linear regression, the law yielding the break-off distance of Pe (DPe) as a function of the distance of the turning point DPr:

$$DPe=\alpha*DPr+\beta.$$

Certain inks have behaviors close to each other and form a group of inks Ge; their data is then concatenated to establish the law. For information, for the ink examples tested above, we found:

$\alpha$=0.2, $\beta$=510 D/A pitch

The validity domain of this law stops when the distance DPr becomes higher than the value of DPe evaluated by the law. Beyond this value (obtained via the resolution of DPr=0.2*DPr+510), the calculation of DPe becomes incoherent because DPe<DPr, which is meaningless since Pe is the lowest point of the curve.

This is case shown in FIG. 24: indeed, the turning point distance is equal to 659 (indicated in tens of μm on the curve) while the calculated value of DPe yields 642 (<659) (same unit as above).

When this situation arises, it has been verified in the different cases encountered that the turning point was systematically in the functional stimulation range (Zone B). In that case, it is not necessary to test the tearing out of matter and the operating piezoelectric excitation voltage VPf is arbitrarily adjusted to a value below VPr making it possible to have a break-off distance defined by:

$$DPf=DPr+10$$

Figure 25:
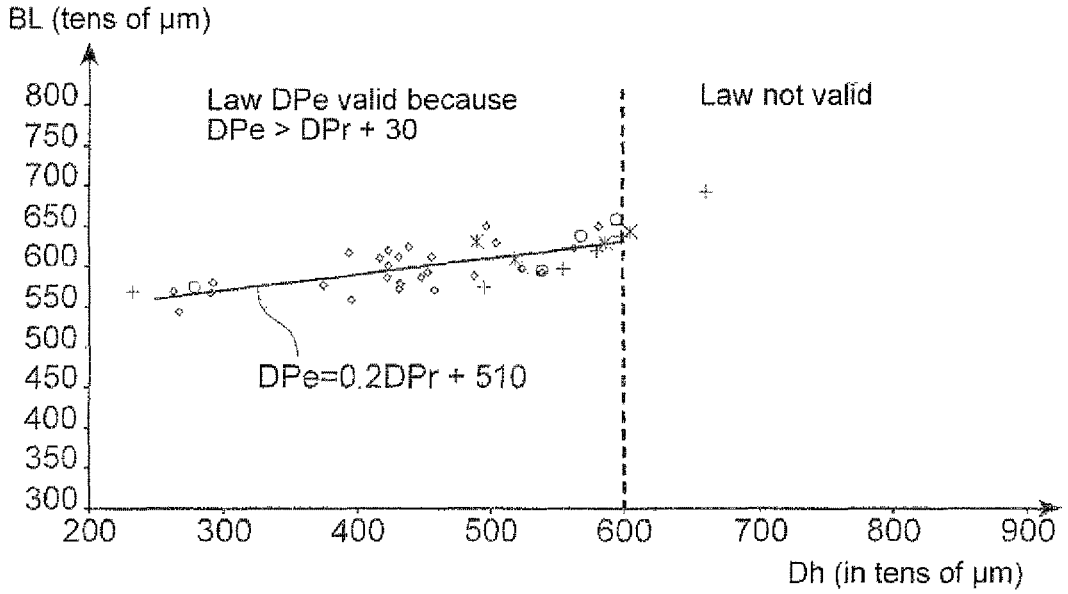
FIG. 25 shows the evolution of the break-off distance of the entry point as a function of the turning distance.

The graph of FIG. 25 shows the measurements used to establish the law concerning 5 different inks having the same behavior and belonging to the same group of inks Gel, at 20 m/s.

The determined law (DPe=$\alpha$*DPr+$\beta$), which on one hand includes a slope $\alpha$ and on the other hand a constant $\beta$, is obtained by linear regression. This creates a certain imprecision of the point DPe determined using the method relative to its actual value. In practice, DPe is determined with an uncertainty corresponding to an imprecision of +/−30 D/A pitch on VPe. Moreover, it has been noted that when the turning point was functional (no tearing out of matter), then the range defined between the turning point VPr and the excitation voltage corresponding to at least DPr+$\lambda$, was also functional. $\lambda$ is the distance between drops in the jet and is equivalent to about 300 μm, or 30 units on the ordinates of the curves. To define the validity limit of the law: the relationship DPe=$\alpha$*DPr+$\beta$ will be used if $$(\alpha*DPr+DPr+30 \text{ units.}$$

In the contrary case, the operating stimulation voltage VPf will be adjusted to a value below VPr making it possible to have a break-off distance defined by:

$$DPf=DPr+10.$$

In the particular case used as an example in FIG. 24, DPr=659. The calculated value of DPe=642 (0.2×659+510) and the limit of the validity domain of the law is 689 (659+30). Since the law is not valid (642<689), an operating stimulation voltage VPf is directly applied that corresponds to a break-off distance DPf=DPr+10, or 669 units.

Table I, below, provides, for information, the parameters $\alpha$ (Slope) and $\beta$ (Constant) established experimentally for different ink groups Gel to Ge4 and 2 jet velocities (20 m/s and 23 m/s).

TABLE I

| Ink | 20 m/s | | 23 m/s | |
|---|---|---|---|---|
| group | Slope | Constant | Slope | Constant |
| Ge1 | 0.2 | 510 | 0.25 | 590 |
| Ge2 | 0.2 | 530 | 0.25 | 560 |
| Ge3 | 0.05 | 630 | 0.25 | 560 |
| Ge4 | 0.15 | 530 | 0.3 | 460 |

In other words, above we have described a technique for determining the entry point Pe, implementing, for a given ink, the determination of the turning point and the calculation of the break-off distance DPe of the entry point as a function of the turning point distance (DPr).

Other aspects of a method of the type described above can be mentioned.

First, the deflection voltage (THT) is cut before carrying out such a method.

Thus, such a method does not require the use of a recovery gutter for the charged drops in addition to the usual gutter for recovering non-deflected drops.

Moreover, the charge phase can be determined beforehand using a method of the prior art such as that described in EP 0 362 101.

Initially, this appeared to ensure a correct charge of the weakly charged drop among the highly charged drops.

The charge level of the weakly charged drop can make it possible to adjust the sensitivity of the detection of the stimulation range by acting on the triggering of the coalescence. This level can depend on the ink used, which can be more or less open to coalescence. The principle explained above can be extended to the use of two (or more) test drops instead of a single one; the adjustment of the relative voltages of these drops can make it possible to monitor the coalescence triggering sensitivity.

A sufficient duration of flight favors good coalescence. It has been observed that it can in particular occur at about 30 mm from the nozzle (exit orifice of the ink jet), or 10 mm before the sensor 6 (in the preferred embodiment of the invention). In other words, the coalescence zone can preferably be located up to at least 30 mm from the nozzle, as well as from the sensor 6. It is clear that a printer incorporating a sensor situated higher (i.e. less than 30 mm from the nozzle) would not be able to implement the method described above.

The optimal operating point Pf can be determined relative to Pe and Ps (for example in the middle: 50/50% ratio). It is possible to consider placing the operating point in a ratio between Pe and Ps that depends on the ink, a predicted evolution of the temperature, the difference between the turning point and Ps.

According to one aspect of the invention, Ps is determined by performing an increasing scanning of the stimulation excitation from Pe; and, for each excitation level pitch of the scanning, a break-off quality test is done.

Pe is the first point of the scanning corresponding to a positive test and Ps is the scanning point preceding the first point, from Pe, producing a negative test.

Figure 26:
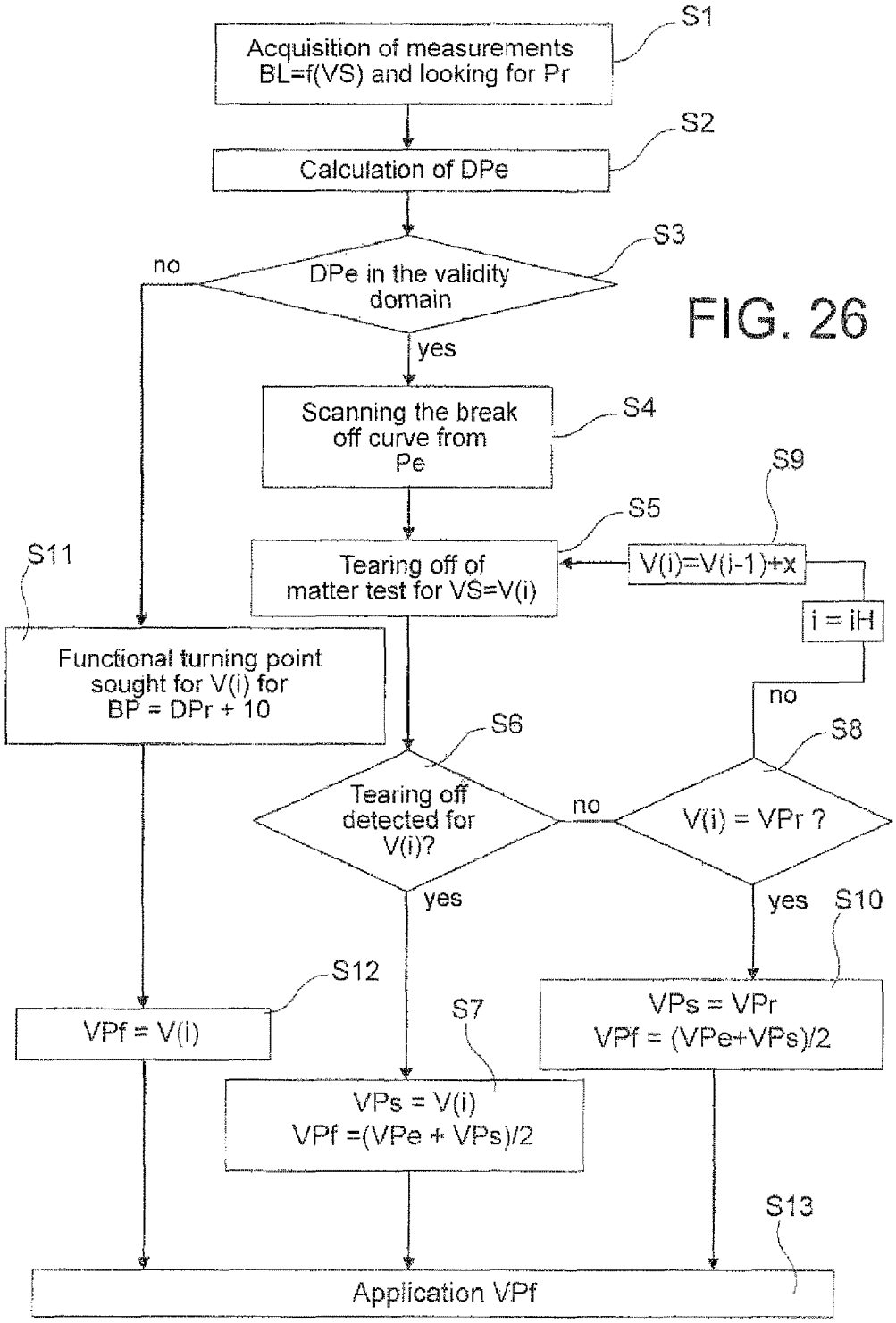
FIG. 26 shows an example of the progression of a method according to the invention.

FIG. 26 represents a complete algorithm implementing the methods described above.

In this figure, step S1 corresponds to the step for developing the curve BL=f (VS) and determining the excitation level of the turning point (VPr).

During the following step S2, one calculates Pe, using the appropriate formula, which yields the break-off distance DPe at point Pe as a function of the turning point distance DPr (this function is substantially an affine function, of the type of formula DPe=α*DPr+β indicated above).

One then determines (S3) whether this value DPe belongs to the validity domain of the law by verifying that DPe>DPr+30:

If this is not the case (DPe DPr+30), one knows that the turning point is functional (no tearing out of matter), one looks (S11) on the curve BL=f (VS) for the excitation voltage corresponding to DPr+10 and this value is allocated to the chosen operating point VPf. This voltage is applied to the piezoelectric means (step S13).

If DPe belongs to the validity domain (DPe>DPr+30), then one initializes (S4) an increasing scanning of the piezoelectric excitation voltage V(i) starting from VPe and incrementing by x (S9) upon each iteration.

For each of these values V(i), a tearing out of matter test is done (step S5).

If this test is positive, it is considered that the last tested value constitutes the value of VPs, and an operating value VPf of the activation voltage can be taken equal to the average of VPe and VPs.

This voltage is applied to the piezoelectric means (step S13).

If the tearing out of matter test is negative, one assesses whether the value of V(i) is equal to the value VPr at the turning point (step S8).

If this is the case, it is considered that the last tested value constitutes the value of VPs.

It is then possible to determine an operating point as a function of Pe and Ps, for example one takes the value of the reference voltage of this operating point is equal to the average of VPe and VPs.

This voltage is applied to the piezoelectric means (step S13).

If this is not the case, the value of V(i) is incremented by a scanning pitch x (step S9), and the test S5 is resumed with V(i+1)=V(i)+x (step S5).

The operational stimulation range is characterized by an entry point Pe that can be evaluated (step S2) by using the method described above or by another method such as, for example, the allocation of a fixed value or a value tabulated as a function of the temperature and/or of the ink type, the tables being established experimentally. The determination of Pe is not completely precise and it is possible for Pe to be determined in zone A (on the edge of zone B) or inside zone B.

In the first case, the first tearing out of matter test (in S5) with a piezoelectric excitation voltage VPe yields a positive result it is then necessary to shift VPe, one or several times, by a positive value sufficient for Pe to be found in zone B and continue the algorithm.

In the second case, the value VPe is used as a starting point for the scanning because the experiments show that a better precision in the determination of the limit between zones A and B does not provide any significant improvement in the determination of VPf.

Figure 27:
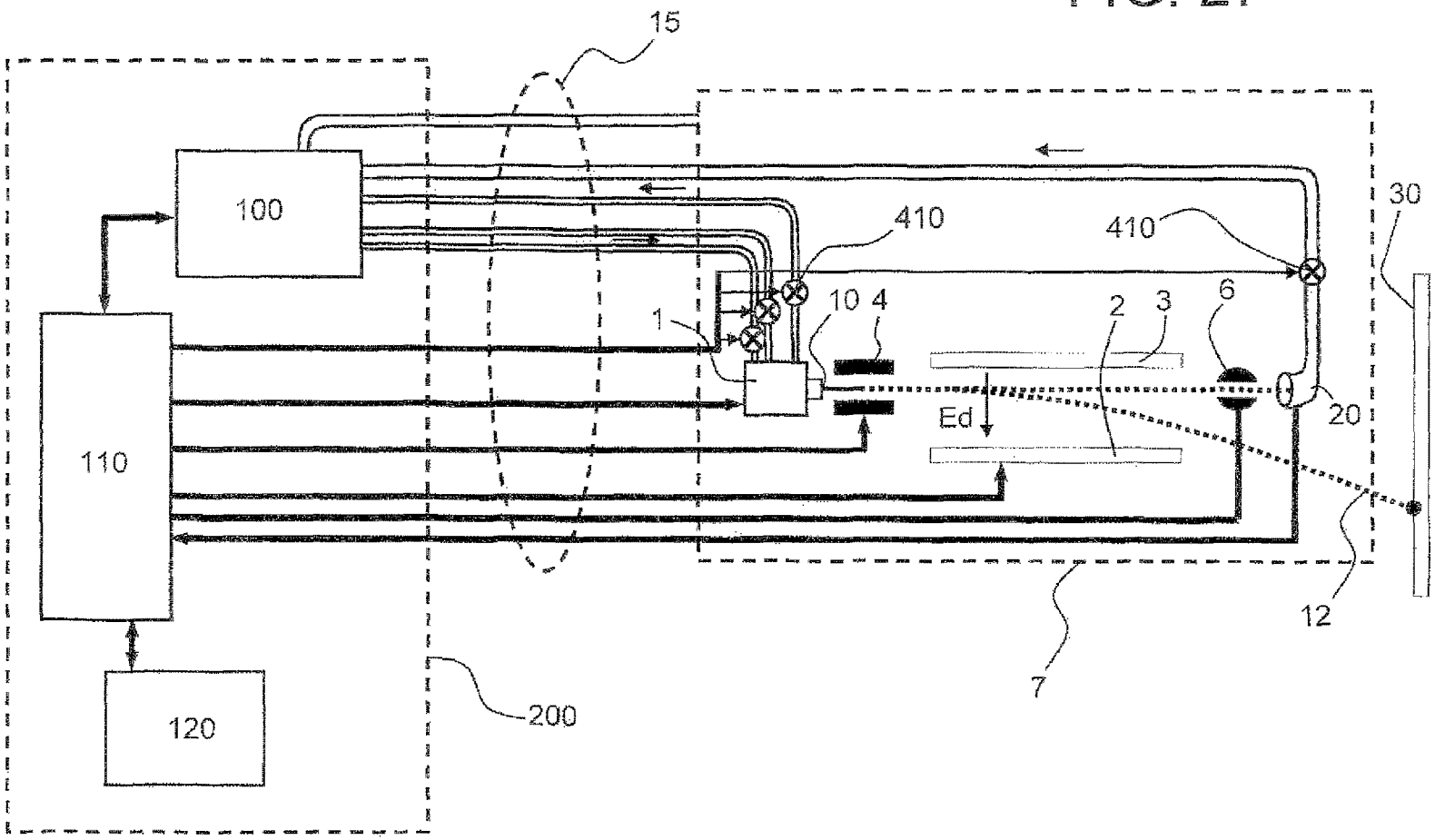
FIG. 27 is an example of the architecture of a printing machine.

The means described above relative to FIGS. 4 and 5A are generally contained in a printhead. As shown in FIG. 27 (case of a multi-deflected continuous ink jet printer), this head is offset, in general by several meters, relative to the body of the printer, also called console, in which the hydraulic and electrical functions are developed that make it possible to operate and check the head.

References 410 designate valves making it possible to check the flows of fluids between the head and the ink circuit 7.

The console contains the ink circuit 7 and a checker 110 connected to the head by a cord 15.

The checker 110 includes circuits, which make it possible to send the head the voltages making it possible to steer the latter, and in particular the voltages to be applied to the electrodes 2, 3 and 4 as well as the piezoelectric excitation voltage.

It also receives descending signals, coming from the head, in particular the signals measured using the sensor 6, and can process them and use them to check the head and the ink circuit. In particular, to process the signals coming from the sensor 6, it may comprise analog amplification means for a signal from that sensor, digitization means for that signal (A/D conversion converting the signal into a digital sample list), means for denoising it (for example, one or more digital filters for the samples), means for seeking the maximum thereof (the maximum from the sample list).

The checker 110 communicates with the user interface 120 to inform the user about the state of the printer and the measurements done, in particular of the type described above. It includes storage means for storing the instructions relative to the data processing, for example to perform a process or carry out an algorithm of the type described above.

The checker 110 includes an onboard central unit, which itself comprises a microprocessor, a set of non-volatile memories and RAM, peripheral circuits, all of these elements being coupled to a bus. Data can be stored in the memory zones, in particular data for carrying out a method according to the present invention, for example one of the methods described in the form of an algorithm above.

The means 120 allow a user to interact with a printer according to the invention, for example by configuring the printer to adapt its operation to the constraints of the production line (rhythm, printing speed, . . . ) and more generally of its environment, and/or to prepare it for a production session to determine, in particular, the content of the printing to be done on the products of the production line, and/or by presenting real-time information for monitoring the production (status of consumables, number of products done, . . . ). These means 120 can include viewing means in order to verify, in particular, the evolution of the performance of tests according to the present invention.

It has been observed that the adjustment algorithm described above malfunctions at low temperatures and has reliability problems at ambient temperature for certain inks: this has resulted in a degradation of the printing quality under certain circumstances.

This situation has led to a more in-depth study of the phenomena involved. To that end, the following tests were first developed:

- determination of the experimental stimulation range (actual operational stimulation range);
- evaluation of the transferred charge quantity in charge voltage equivalent Xtr (in volts), i.e. the charge voltage Xtr of the drop that would give it the transferred charge;
- determination of the charge phase in a highly charged environment;
- simulation of a charge transfer between two successive drops G1 and G2.

Thus, the experimental, or real, stimulation range can be measured experimentally under the chosen test conditions (for a given ink and temperature). This real stimulation range corresponds to the zone B as previously described. To that end, the stimulation voltage is scanned. For each excitation value, a real printing test is done with a message implementing extreme charge voltages (in this example, a printing height of 32 points, leading to charge voltages in the vicinity of 280 V, each charged drop being followed by at least one guard drop, constitutes an extreme situation). The experimental stimulation range corresponds to the excitation voltage interval for which printing is visually correct (each drop is placed in the right location).

Figure 28A:
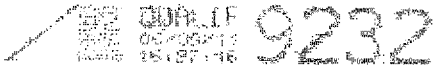
FIGS. 28A-28D show the printing quality in the different zones.
Figure 28B:
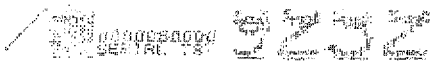
Figure 28C:
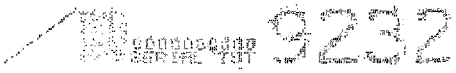
Figure 28D:
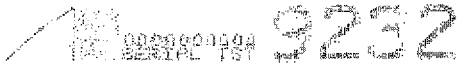

FIGS. 28A-28D show the printing qualities in the different zones:

FIG. 28A shows correct printing in the range,

FIG. 28B is a printing for a stimulation adjustment substantially before the entry point Pe (see notations of FIG. 3); the charge transfer caused by the slow satellites is then significant enough for the preceding guard drop to be deflected toward the medium (with impacts under the characters);

FIG. 28C shows a deterioration of the placement of the most deflected drops for stimulation just after the exit point Ps;

FIG. 28D relates to the case of stimulation substantially after the exit point Ps.

The quality deterioration appears on the most deflected, and therefore most charged drops. These drops take on a lower charge quantity than the normal, they are poorly deflected and undergo translation toward the bottom of the message.

This deterioration is also related, as seen before, to the nature of the break-off, which favors the tearing of material at the tail of the drop in formation at the exit from the proper printing zone and which generates slow satellites at the entry of that zone, due to an under-stimulation. It will be recalled that when a break-off is of poor quality, a charge transfer occurs:

- the highly charged drop loses charges in favor of the following drop, particularly if the latter is not charged, since an electrostatic field then exists generated by the charge difference carried by the two drops, which favors the tearing out of material or the formation of slow satellites. The highly charged drop having lost charges does not reach the correct position, and the printing is not correct;
- the uncharged or weakly charged drop acquires additional charges, which can lead to a sufficient deflection to interfere with the printing.

From the preceding, one determines that the suitable printing conditions have been obtained when no charge transfer occurs between a drop G1 charged, at least, at the value producing the greatest desired deflection in the printed patterns and the following drop G2 that is weakly charged. The charge voltage of G1 will therefore depend on the concerned head type and the desired maximum deflection.

To evaluate the charge quantity transferred between two consecutive drops G1 and G2, the measuring method may for example comprise the following steps:

- positioning the stimulation level at the desired measurement reference and applying the deflection field to the printing head,
- creating the charge conditions for any drop G1 to be charged at a high charge voltage, in a line of uncharged drops, and observing the deflection of the drop G2 that immediately follows G1:
- if the charge transfer does not take place, the impact on the deflection of G2 is nil;
- in case of charge transfer, the drop G2 is deflected and the value of the charge transfer is characterized by the voltage Xtr one gives an isolated drop G3 so that it has the same deflection as G2.

As seen above, the drop G2, even with a charge command at 0 V, is given a charge, called historic charge, related to the electrostatic charge created by the drop G1, which immediately precedes it and which acts as a charge electrode at the break-off moment of G2. This historic charge corresponds to approximately 10% to 12% of the charge of G1 and has the opposite sign from the latter (for the printer configuration used for this study). For example, for G1 charged by the charge electrode at VG1=300 V and G2 at VG2=0 V, G2 will, in spite of everything, be given a charge equivalent to a charge voltage of −33 Volts.

If the deflection field is present, as provided during the evaluation of the transferred charge, G1 will be deflected according to the applied charge voltage, but G2 will also be assigned a deflection in the opposite direction, not according to the applied charge command.

To cancel out this effect in the measurements, a charge voltage is applied for G2 that offsets the historic charge (VG2=+33 V in the example above), and the deflection of G2 will then be nil.

Figure 29A:
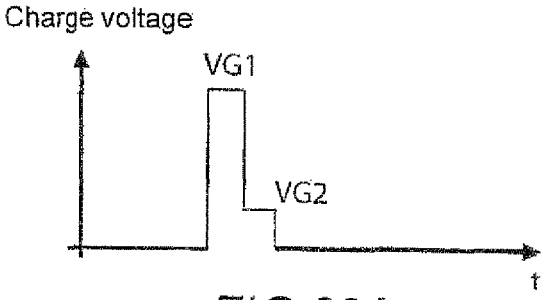
FIGS. 29A-29B are a charge voltage diagram of the drops G1 and G2 and the break-off modification phenomenon in the presence of an environmental direct charge voltage, respectively.

The charge voltage diagram for drops G1 and G2 is illustrated in FIG. 29A. The effect of the historic charge on the following drops G2 is left out, as the very weak deflection of those drops leads them into the gutter.

Regarding the determination of the charge phase, explained in the introduction of this application, relative to document EP 0 362 101, was the method for determining the charge phase used previously. This method is called "0 V environment phase detection," as the test drops are emitted in a line of uncharged drops (0 V). The test drops are charged at a low voltage (~10 V) so that, when the deflection field is present, their deflection always leads them into the gutter. On the other hand, their charge voltage has a sign opposite those provided for the printing, so that their deflection brings them closer to the sensor and improves the signal-to-noise ratio of the signal.

As will be seen later, the phase can be influenced by a highly charged environment. To determine the phase under these conditions, the initial method was adopted: the measurement occurs in the absence of the deflection field and the measurement line is made up of a sequence of drops charged at a high voltage, creating the electrostatic environment, in which the test drops charged at a low voltage are inserted. The second method is called "phase detection in a highly charged environment."

For the study configuration and the type of head used, the charge voltages are determined experimentally:

- the environment voltage is in practice in the vicinity of 200 V;
- and that of the measuring drops is in the vicinity of 80 V below the previous one.

This makes it possible to avoid the tearing out conditions of the material and provide a signal-to-noise ratio and performance equivalent to the 0 V environment phase detection method. The same electronic measurement chain can then be used for both methods.

It is also possible to implement a charge transfer simulation method between any two successive drops G1 and G2, charged with particular voltages. For example, if, for a correct stimulation, G1 is charged at 300 V and G2 at 0 V, the simulation of a charge transfer of 20 V leads to charging G1 at 280 V and G2 at 20 V. However, in order to check the charge, the stimulation reference is placed beforehand in the correct printing zone.

Therefore, in practice, one starts by determining the experimental stimulation range (for example using the method described above), then one places the stimulation reference in the middle of that range; G1 and G2 can then be charged to the desired values: VG1 and VG2 for a situation not involving a charge transfer, and VG1-Xtr and VG2+Xtr for a simulated situation of a charge transfer equivalent to Xtr Volts.

The methods described above will also be implemented hereafter. The value of the different parameters (charge voltages, break-off distances, break-off/coalescence distance, transferred charge quantity, etc.) that have already been given and that will be given hereafter, depend on the type of head used. The type of printing head is characterized by a drop size, a stimulation frequency, a jet speed, a distance between drops in the jet, a nozzle/charge electrode distance, a break-off/entry of the sensor distance, and others. The configuration used for the following experiments will be called "study configuration," which corresponds to the following primary characteristics:

- drop diameter: approximately 100 μm
- stimulation frequency: Fstim=62.5 KHz
- jet speed: Vj=20 m/s
- distance between two consecutive drops in the jet: λ=320 μm
- distance between the nozzle and the location, in the electrode, below which all of the break-offs (for all inks and temperatures combined) are at least in zone A of the curve BS=f(VS): $BL_{min}$=7 mm
- distance between break-off point and entry of the sensor: d≈30 mm
- maximum charge voltage for a deflection of 32 drops: 300 V (if it involves the charge voltage of G1: VG1).

Furthermore, the above steps are carried out by using, among others, the measurement methods above:

- showing the non-optimal choice of the charge phase in a charged environment when the phase is determined in an uncharged environment;
- experimental determination of the charge transfer for different inks and at several temperatures as a function of the piezoelectric excitation voltage;
- analysis of the variable behavior of the method previously described;
- study of the characteristics of the line of measuring drops to optimize the positioning of the coalescence relative to the sensor.

First, it is possible to show the poor choice of the charge phase in a highly charged environment, when the phase is determined in an uncharged environment.

In the first part of the description, the phase was determined in a "0 V" environment, and the sequence of measurement voltages for detecting the tearing out of material (illustrated in FIG. 6) comprised a measuring drop charged at a low voltage in the middle of drops (environment) continuously charged at a high value. The measuring drop was charged with the previously determined phase and a charge window duration at 50% of the stimulation period.

An observation of the break-off was done using video means and synchronized lighting on the piezoelectric frequency. Views of the break-off at a fixed location, in the charge electrode, for several environment voltages (0, 100, 200, and 300 V), show that not only the shape of the break-off, but also the moment of the break-off, are modified as a function of the charge. It is in particular possible to see that the more the voltage increases, the more:

- on the one hand, the tail of the drop thickens with a refinement of the filament connecting the two drops before break-off;
- and, on the other hand, the break-off moment advances in time. It appears that this phenomenon is more or less sensitive for certain inks and probably as a function of the temperature.

Figure 29B:
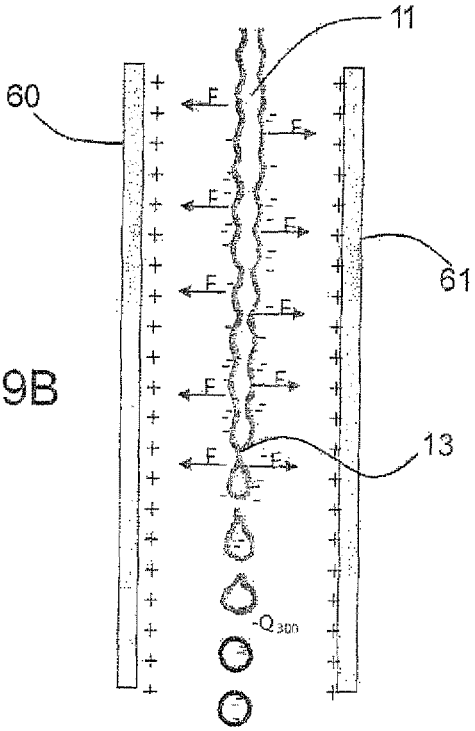

FIG. 29B illustrates the modification phenomenon of the break-off in the presence of a continuous environment charge voltage. In this situation, the electrodes 60, 61 are brought to a constant potential (here positive). The jet 11 that has not yet broken off becomes negatively charged to achieve electrostatic equilibrium. The proximity of charges with opposite signs creates forces F perpendicular to the jet that increase the effectiveness of the periodic disruptions of the stimulation. The break-off moves on the stimulation curve as if one had increased the piezoelectric excitation voltage.

Two consequences can be inferred from these observations:

- the charge phase is modified as a function of the charge voltage of the environment, and it is therefore desirable to detect the optimal phase in a charged environment for performing a charge transfer test (where the measuring drop is charged). This is the purpose of the method for determining the charge phase in a highly charged environment, described above;
- the risk of having an unstable break-off at a very high environment charge, due to the undetermined break-off of the very fine filament connecting the drop to the jet, can also lead to a poor charge of the measuring drop that would distort the conditions of the charge transfer test. From this perspective, observation shows that the value of 300 V for the environment voltage is too high for certain inks and/or temperatures.

The effect of the instability of the charge is further increased by the partial duration of the charge window. A charge at 100% of the stimulation period is preferable from this perspective.

It is possible to determine the charge transfer experimentally as a function of the piezoelectric excitation voltage.

As has been seen in the printing tests in FIGS. 28A-28D, the deterioration of the printing quality amounts to a downward shift of the impacts created by the most deflected drops, and possibly the printing of an unexpected impact due to a weakly, but not sufficiently, deflected guard drop. This situation can be reproduced with a highly charged isolated drop followed by an uncharged drop. In that case, the environment is uncharged (0 V). The aim here is to quantify the charge quantity transferred by a highly charged isolated drop toward the following drop for a set of inks and a certain temperature range (particularly situated toward the bottom; 3 temperatures are tested: ambient temperature, 15° C. and 5° C.)

The tests are done with a printer in the study configuration. Three inks are tested, which belonged to 3 of the 4 groups of inks in table I above: EN1 of Gel, EN2 of Ge4, and EN3 of Ge3. The inks of each of groups 1 and 2 having very similar behaviors, group 2 is not represented.

The charge transfer test for an ink at a given temperature consists of establishing the curve of Xtr as a function of the stimulation voltage expressed in steps of the D/A converter, for example for 4 charge voltages of G1: 200, 250, 300 and 330 Volts. This test may be done following the steps below:

- warming up the printer (in a climatic control chamber for temperatures 15° C. and 5° C.);
- measuring the experimental stimulation range using the method described above. This range appears in the graphs of FIGS. 30-33B between two vertical lines (it corresponds to zone B as defined in the first part of the description);
- scanning the stimulation voltage; for each value of the piezoelectric voltage, the charge phase is determined in a 0 V environment, then the transfer charge quantity is evaluated, using the method described above, repeating the measurement successively for the voltages of G1 provided above. The voltages of G2 are positioned to cancel out the historic charges as also explained above.

Figure 30:
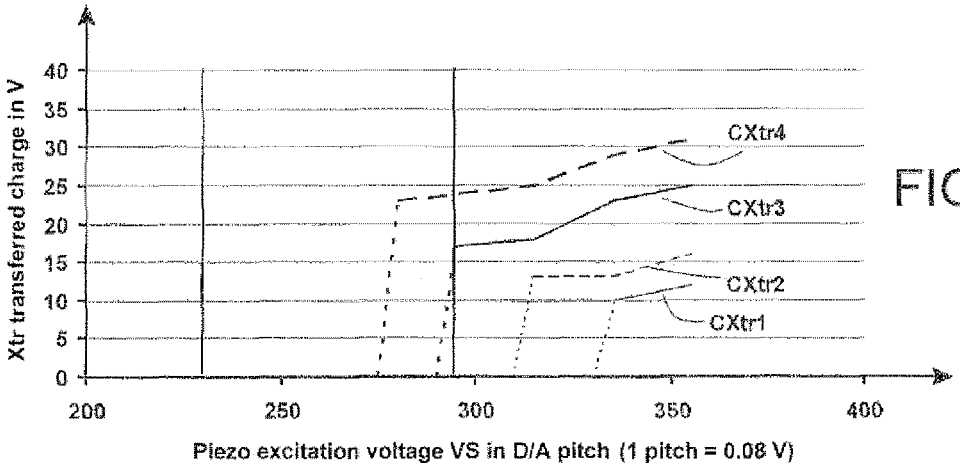
FIGS. 30-38B are curves of the evolution of the transferred charge as a function of various parameters.

Initially, the interest related to the charge transfer at the exit of the stimulation range; the scanning of the stimulation was limited to the vicinity of the exit point Ps. The graph of FIG. 30 shows the array of charge transfer curves obtained for ink EN1 at ambient temperature. Curves CXtr1, CXtr2, CXtr3 and CXtr 4 respectively correspond to the 4 voltages of G1 (200, 250, 300 and 330 Volts) and G2 (20 V, 25 V, 33 V and 40 V), voltages that offset the historic charge.

The same references CXtri (i=1–4) are used in FIGS. 31A-33B to designate the same charge voltage conditions for G1 and G2 as above.

In FIG. 30, one can see that:

- the charge transfer Xtr increases with the increase in the value of the charge of G1: Xtr (charge of G1=330 V)>Xtr (charge of G1=200 V), Xtr evolving between 10 V and 30 V;
- the higher the charge voltage of G1, the more the tearing out appears for a low piezoelectric voltage. This is consistent with the printing tests shown in FIGS. 28C and 28D: when the piezoelectric reference increases, the message deteriorates first for the strong deflections, then gradually for the weaker ones;
- the appearance of the tearing out for a drop charged at 300 V corresponds to the end of the real printing range determined experimentally. This is consistent with the maximum charge amplitude of the drops of the test message used to determine the stimulation range experimentally. In fact, the 32α position corresponds to a drop charged at approximately 280 V.

Figure 31A:
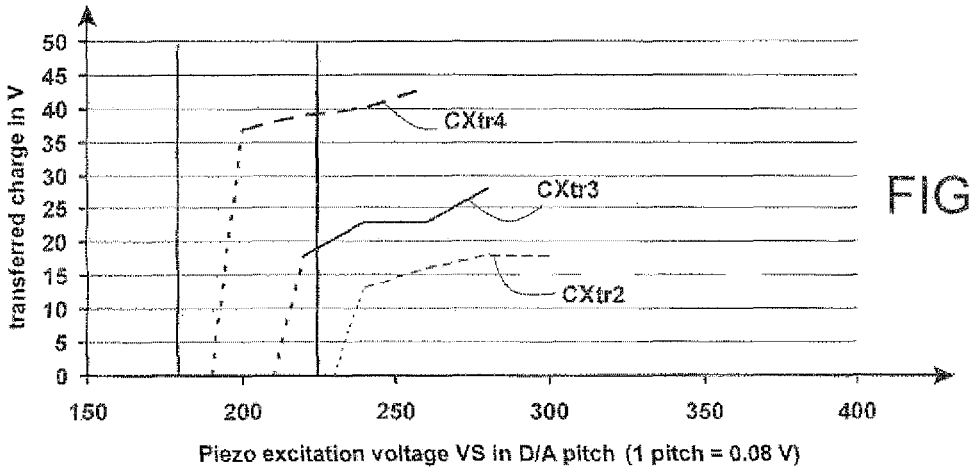
Figure 31B:
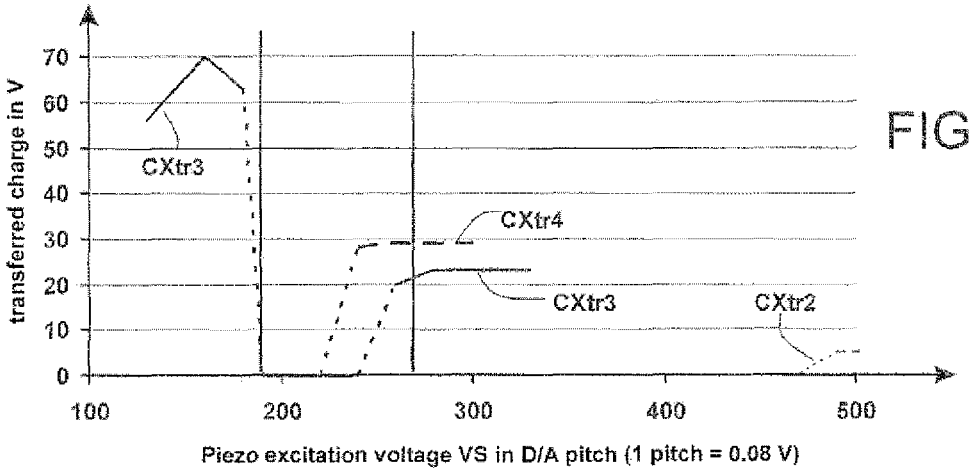

The graphs of FIGS. 31A-31B show the charge transfer measured for the same voltages of G1 and G2 as above, at two other temperatures for ink EN1 (FIG. 31A: 15° C.; FIG. 31B: 5° C.)

During low-temperature tests, it was observed that a charge transfer is present before Pe (entry point into the proper printing range). The presence of slow satellites, just before the entry point into this stimulation range, was mentioned already above; these satellites are capable of transferring charges from one drop to the next. They had not been shown in the first method in the 1$^{st}$ part of the present application, because of a non-optimal charge of the drops, which results from a defective charge phase detection. This behavior of the charge transfer measurement makes it possible to locate the entry point into the stimulation range with the same means as for the range exit point.

The charge transfer at the entry point of the range was studied during the low-temperature test (5° C.) of inks EN1 and EN2. The average transfer (average of the non-zero XTR) at the range entry point was quantified for a voltage of VG1=300 V at 5° C. (FIG. 31B for EN1 and 32*c* for EN2): Xtr is then close to 60 V (value greater than the measured transferred charge at the range exit point Ps). This measurement is consistent with the observation of the printing (FIG. 28A) done with a piezoelectric reference close to the range entry point $VP_e$. The charge transfer is high enough for there to the printing of an additional drop.

Figure 32A:
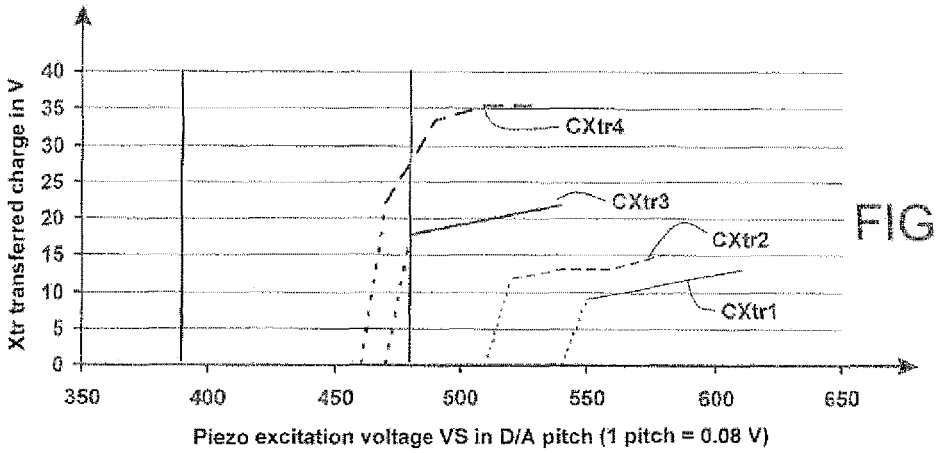
Figure 32B:
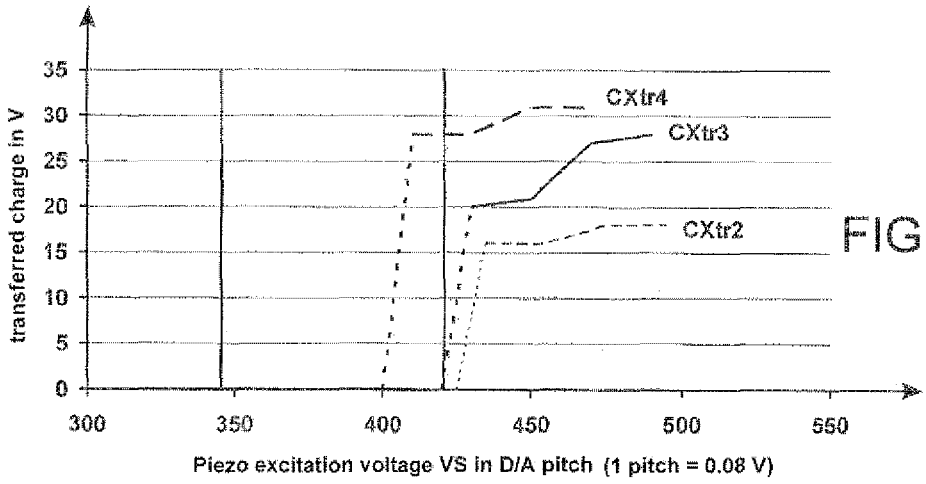
Figure 32C:
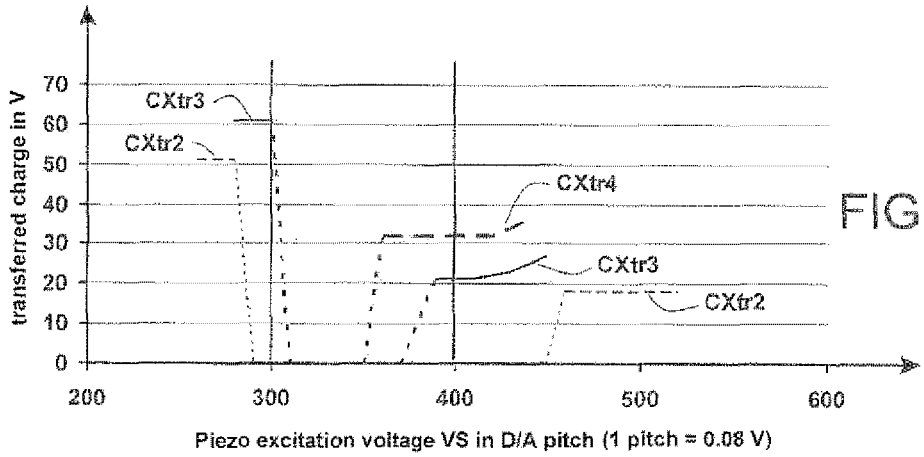
Figure 33A:
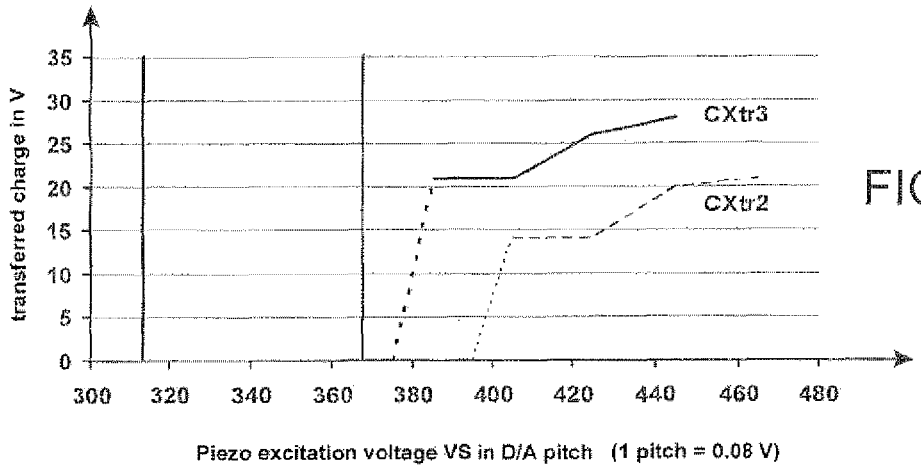
Figure 33B:
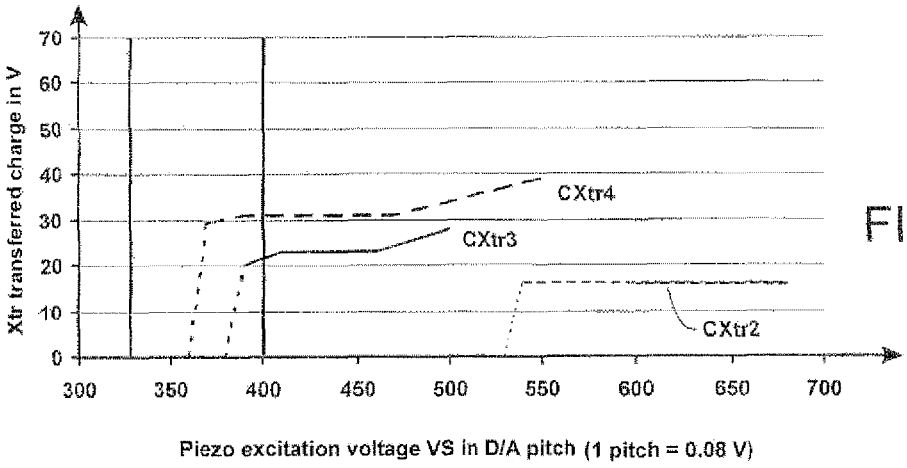

The graphs of FIGS. 32A-32C, respectively 33A-33B, show the charge transfers measured for ink En2 (FIG. 32A: ambient temperature; FIG. 32B: 15° C.; FIG. 32C: 5° C.), respectively En3 (FIG. 33A: 15° C.; FIG. 33B: 5° C.). The analysis done on ink En1 is therefore confirmed by the results on inks En2 and En3.

Figure 34:
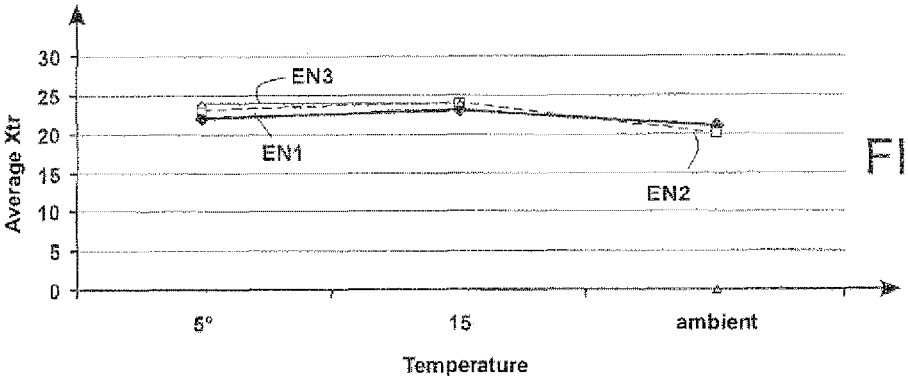
Figure 35:
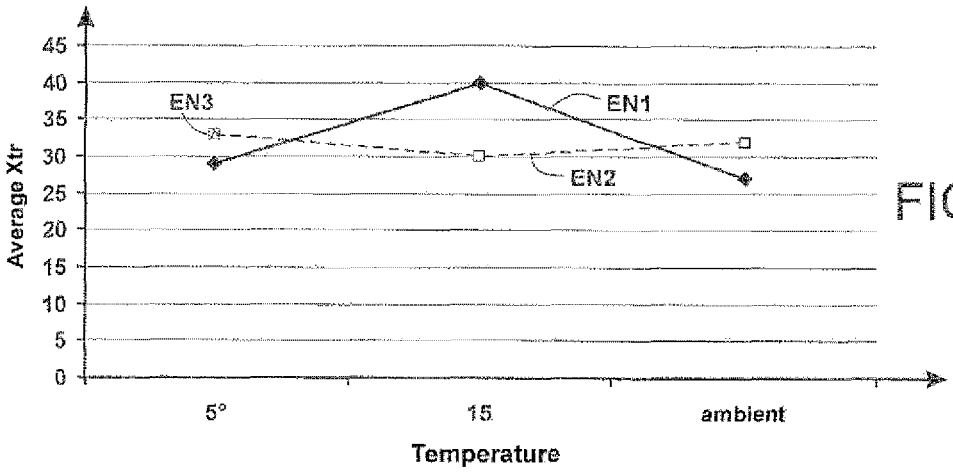
Figure 36:
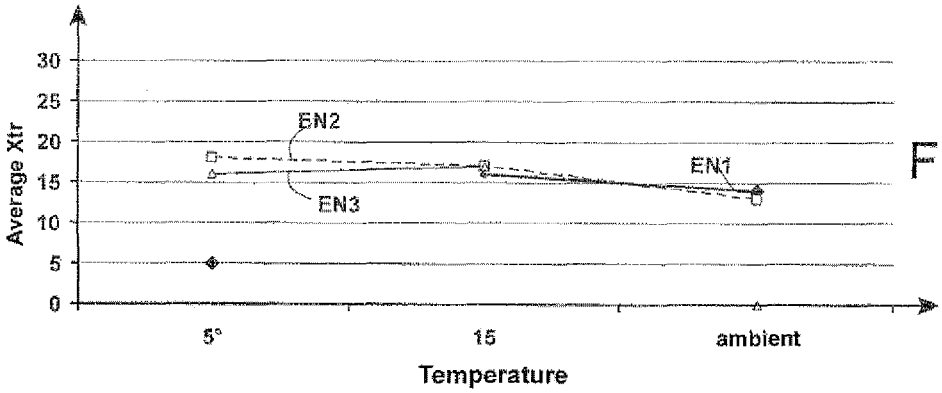

The results of the analysis of the average transfer, in proper printing range exit point, for G1=300 V, are shown in FIG. 34, the curves (identified by the corresponding ink, as also in FIGS. 35-36) giving the average transfer for each ink as a function of the three tested temperatures. One can see that the three inks behave identically. The average transfer Xtr evolves between 20 V and 24 V. It is not very sensitive to temperature. It can be noted that at ambient temperature, it is slightly weaker.

The analysis of the average transfers at the range exit point for drops charged at 330 V and 250 V (see FIGS. 35 and 36) confirms this analysis.

The results of the analysis of the average transfer, at the proper printing range entry point, for G1=300 V, only concern two measurements done at 5° C. The average transfer corresponds to 63 Volts for EN1 and 61 Volts for EN2. For G1=250 V, a single measurement is available for ink EN2. The value of the transfer then corresponds to 50 Volts.

One can see that:

- the transferred charge level depends on the charge of the drop;
- the transfer at the range entry point is greater than that at the range exit point;
- the phenomenon is stable with the temperature;
- between the three inks, the transferred charge levels are similar for a given charge voltage of G1.

Figure 37:
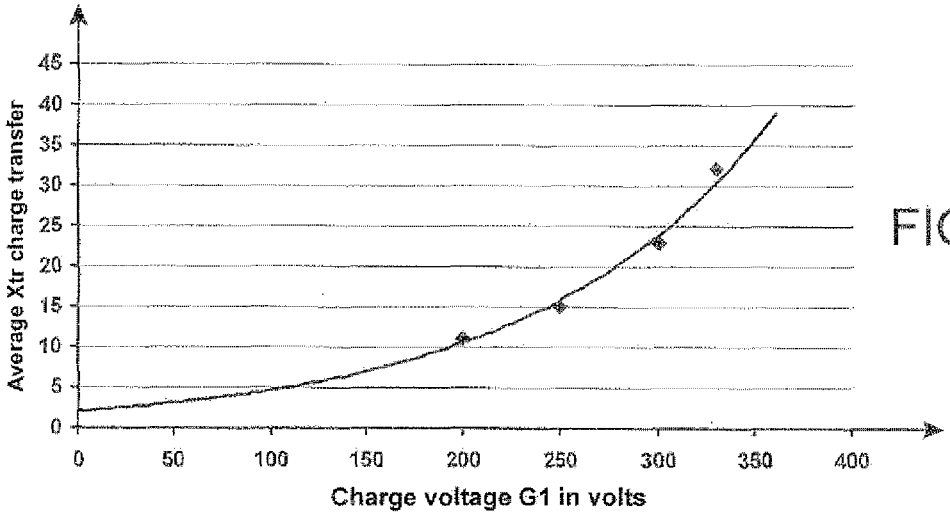

If one considers the charge transfer at the range exit point averaged over the three inks and the three temperatures as a function of the voltage of G1, one obtains table II below and the trend curve of FIG. 37.

TABLE II

| Charge G1 (in V) | Charge G2 (in V) | Xtr (in V) Average charge transfer (average of the measurements of the three inks at all temperatures) |
|---|---|---|
| 330 | 40 | 32 |
| 300 | 33 | 23 |
| 250 | 25 | 15 |
| 200 | 20 | 11 |

One can see that the evolution is not linear; it is close to an exponential evolution.

To refine the study, the charge transfer was quantified in the case of a drop G1=300 V followed by a drop charged between 33 V and 100 V. This situation corresponds to the case where a drop, highly charged, is followed by a drop also intended to be printed, but more weakly charged.

We therefore studied the charge transfer Xtr for inks EN1, EN2, EN3, for the three temperatures already tested, and for VG1=300 V and VG2 successively assuming the values of 33 V, 50 V, 70 V, 100V. Given the historical charge effect explained above, the actual charge taken on by the drop G2 will then respectively be 0 V, 20 V, 40 V and 70 V, corresponding to the applied charge decreased by the voltage due to the historical effect that is, here, approximately 30 V for a voltage VG1 of 300 V.

Figure 38A:
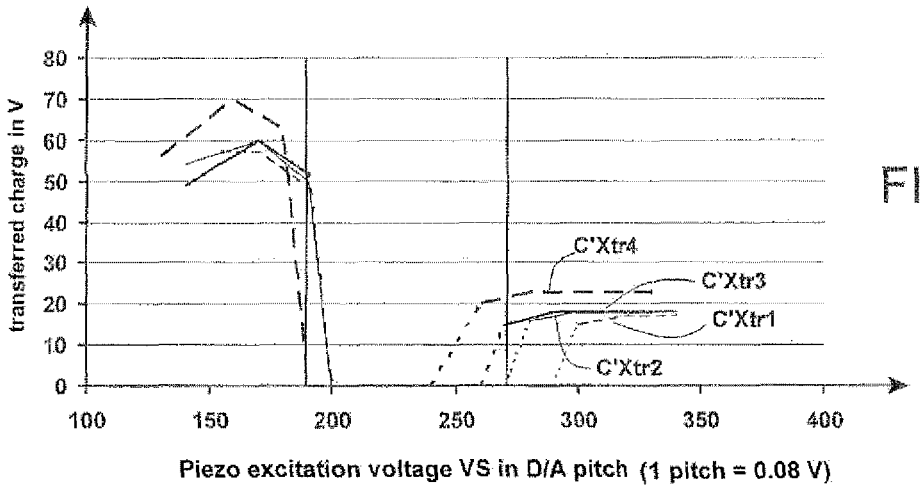
Figure 38B:
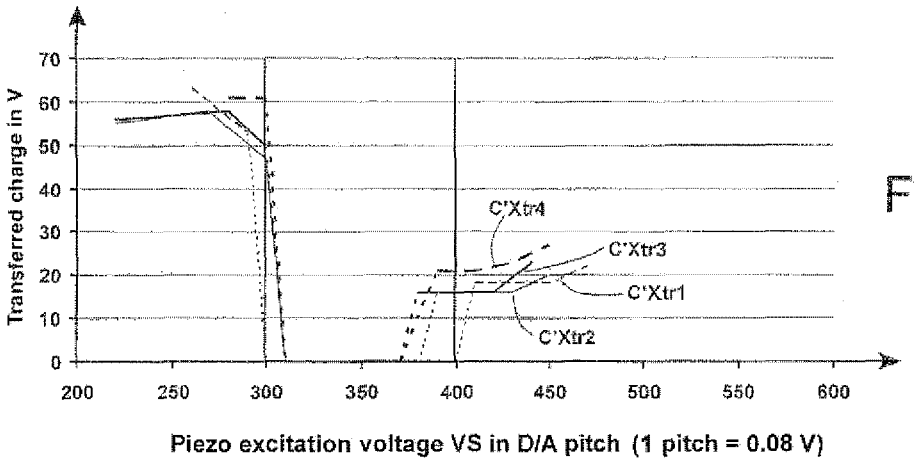

The curves of FIGS. 38A and 38B show examples of charge transfers established at 5° C. for inks EN1 and EN2, respectively. The curves C'Xtr1, C'Xtr2, C'Xtr3 and C'Xtr4 respectively correspond to the values of VG2: 100 V, 70 V, 50 V and 33 V. The experimental actual printing range is delimited by two vertical lines. The results, which were partial for the transfer at the beginning of the range, are summarized in the two tables below.

The following table III brings together the analysis results of the average charge transfer (for three inks, at three temperatures), at the exit point of the proper printing range:

TABLE III

| VG1 | VG2 | Xtr Average charge transfer (average of the measurements for the three inks at all temperatures) |
|---|---|---|
| 300 | 33 | 23 |
| | 50 | 18 |
| | 70 | 19 |
| | 100 | 18 |

One can see that, when the drop G2 is charged between 50 V and 100 V, the charge transfer is weaker by approximately 5 V than when the drop G2 is charged at 33 V.

The following table IV brings together the analysis results of the average charge transfer (three inks at 5° C.), at the proper printing range entry point.

TABLE IV

| Charge G1 | Charge G2 | Average charge transfer (average of the measurements for three inks at 5° C.) |
|---|---|---|
| 300 | 33 | 62 |
| | 50 | 55 |
| | 70 | 54 |
| | 100 | 56 |

Here again, one can see that, when the drop G2 is charged between 50 V and 100 V, the charge transfer is weaker; the value here is 7 V.

The above study of the behavior of the charge transfer makes it possible to observe the following points:

- the transferred charge quantity depends on the voltage of the highly charged drop G1. Under the conditions of the study configuration of the printer, and for the maximum charge voltage used for printing (300 Volts), the transferred charge quantity Xtr is in the vicinity of 20 Volts (between 15 V and 30 V) at the range exit point and 55 Volts at the range entry point, in all of the studied cases;
- the transferred charge quantity depends very little on the temperature or the type of ink used.

Therefore, a method making it possible to discern between the absence of transfer and the presence of a charge transfer corresponding to at least Volts (or 15 V), can be used, to determine the stimulation range that guarantees proper printing. The exact value of the charge transfer also depends on the configuration of the printer.

In the first method explained at the beginning of this document, the phase was determined in a 0 V environment and the charge of the test drops done in a charged environment (300 V) and with a partial duration (50%) of the charge window. We saw above that these conditions could lead to an uncertain mastery of the charge of the test drops. With a determination of the phase in a charged environment and a charge at 100% of the charge window, the correct charge of the test drop is guaranteed, but the signals at the output of the sensor 6 are no longer capable of discriminating between the absence or presence of a tearing out of material, characteristic of the quality of the break-off.

To analyze the problem, we observed the measurement group between the break-off and the gutter, with synchronized video means, and we simulated, using the method explained above, the presence or absence of a charge transfer in the vicinity of 20 Volts, which should appear during a tearing out of material at the stimulation range exit point. Here, the transfer simulation is done under the conditions of the first method, i.e., in an environment charged at 300 V, with N1 drops before G1 and G2 and N2 drops after G1 and G2 all charged at 300 V. As a reminder, the measurement group is the group of drops disrupted by the jet producing a signal on the sensor 6, as explained in the first part of the description.

A first test with ink EN1 and at ambient temperature yields the following results:

- without charge transfer, the coalescence is situated at 15.6 mm from the break-off;
- with charge transfer at 20 V, the coalescence is situated at 17.5 mm from the break-off.

In both cases, the coalescence occurs well before the sensor, which is situated approximately 30 mm from the break-off, and the signal coming from the sensor remains reliable (as in FIG. 13); it is therefore not possible to discriminate between the two cases. Furthermore, the coalescence only moves by 2 mm. However, one is looking for the detected charge transfer to lead to an absence of coalescence or to the formation of a coalescence after the sensor.

Figure 39:
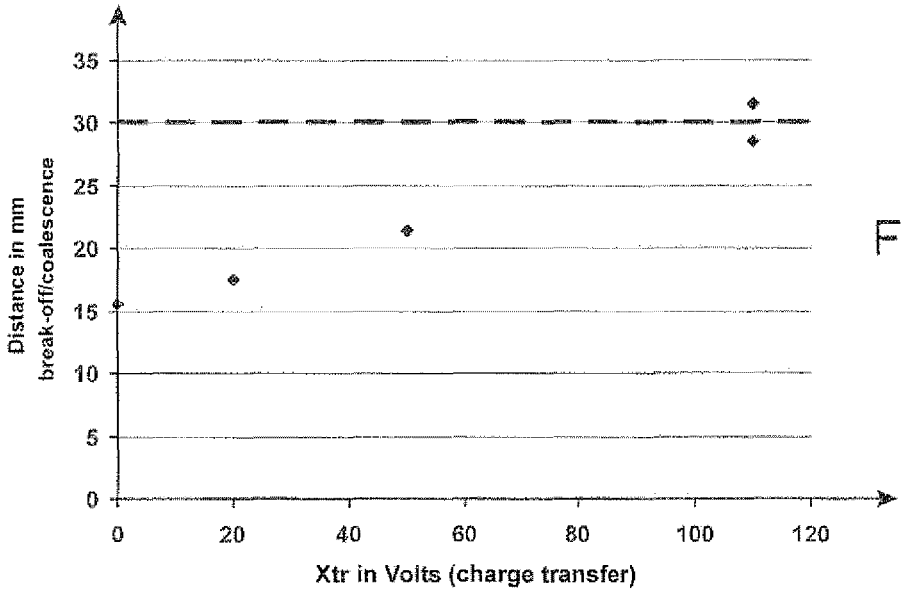
FIGS. 39 and 42 show the evolution of the distance between break-off point and coalescence location as a function of the transferred charge and the voltage V1, respectively.

A second test consisted of gradually increasing Xtr (with the same simulation method) and measuring the break-off-coalescence distance. The results are shown in the curve of FIG. 39. One can see that the coalescence reaches the sensor for a charge transfer corresponding to 110 V. In this case, VG1=190 V, VG2=110 V, the environment (the N1 drops before and the N2 drops after the measuring drops G1, G2) being at 300 V.

A verification was done for the three inks at the three temperatures already tested. The following table V gives the coalescence distance for two transfer cases (0 V and 20 V), then the transfer Xtr making it possible to move the coalescence after the entry point of the sensor.

TABLE V

| Ink | T° C. | "Break-off/ coalescence" distance in mm Xtr = 0 V | "Break-off/ coalescence" distance in mm Xtr = 20 V | Xtr (in V) making it possible to have the coalescence after the sensor |
|---|---|---|---|---|
| EN1 | ambient | 15.6 | 17.5 | 110 |
| | 15° | 16.9 | 18.1 | 110 |
| | 5° | 16.9 | 18.7 | 110 |
| EN2 | ambient | 15.2 | 17 | 110 |
| | 15° | 15.6 | 16.6 | 115 |
| | 5° | 15.4 | 17.3 | 110 |
| EN3 | ambient | 15.2 | 17.2 | 100 |
| | 15° | 17 | 18.4 | 110 |
| | 5° | 16.9 | 18.9 | 110 |

The data in this table confirms the above observations.

The preceding makes it possible to understand the reasons why the charge transfer detection, described in the first part of the document, was not optimal in all circumstances: the determination error of the charge phase was leading to an erroneous charge of the test drop that was not at 0 V, as was assumed, but probably approximately 100 V. The coalescence was then positioned in the vicinity of the sensor and the charge transfer of 20 V, caused by the tearing out of material, was then allowing it to move toward the sensor while causing an attenuation of the signal and therefore the detection of a charge transfer.

Figure 40:
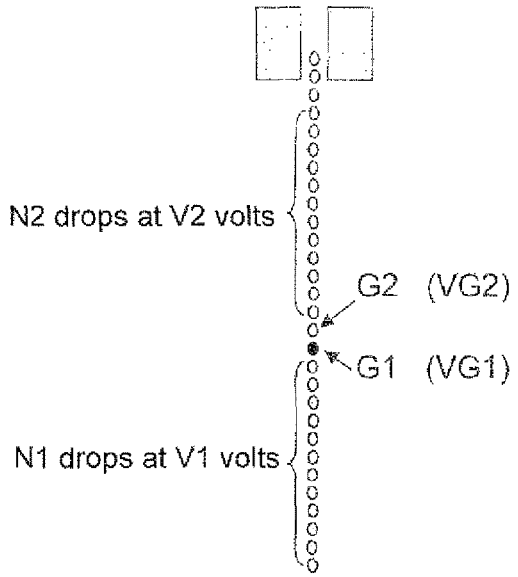
FIG. 40 and FIGS. 41A and 41B illustrate a line of drops and a measurement voltage sequence applied to a line of drops, 2 drops being at VG1 V and VG2 V, respectively, and being preceded by N1 drops charged at V1 V and followed by N2 drops charged at V2 V.
Figure 41A:
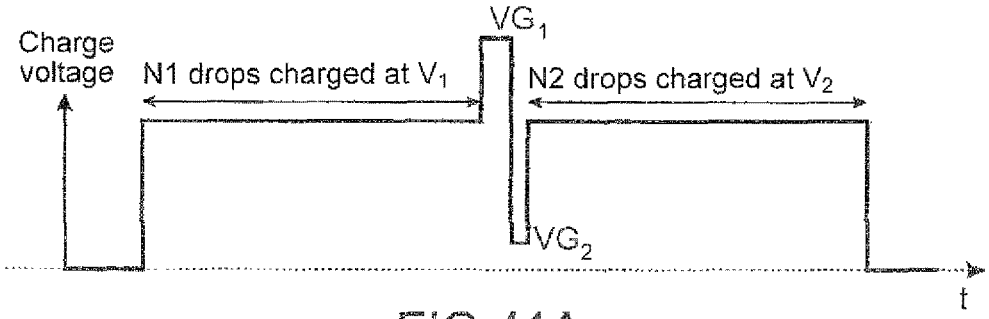

The preceding considerations lead to proposing a new configuration for a line of measuring drops making it possible to optimize the positioning of the coalescence relative to the sensor. This configuration is illustrated in FIGS. 40 and 41A.

In fact, it appears that the tearing out of material phenomenon is primarily influenced by the two drops involved in the transfer: one highly charged drop G1 followed by a weakly charged drop G2. The other highly charged drops create a electrostatic environment making it possible to detect the charge transfer.

This configuration comprises, in the following order:

first, N1 drops, charged at a voltage V1;

then, at least two measurement or test drops G1 and G2, respectively charged VG1 and VG2;

then N2 drops, charged at a voltage V2, which can be equal to V1.

The values of N1 and N2 can be determined as in the first method described in this application. N1 and N2 here are equivalent to 50 in this study configuration.

In the configuration illustrated in FIG. 40, 41A: V1<VG1, V1>VG2, and V1=V2.

Figure 41B:
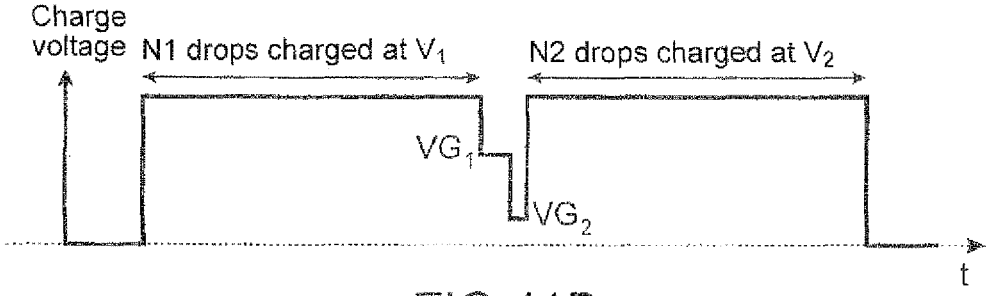

However, for another type of situation where one is interested in weaker maximum charge voltages, it is possible to have other relative values of the voltages, for example in the case of the configuration like that illustrated in FIG. 41B, where one has, as in the previous configurations, a first set of N1 drops, then two test drops G1, G2 and a second set of N2 drops, but where V1>VG1>VG2, and V1=V2.

The second test of the preceding experiment shows that the break-off-coalescence distance increases when the charge voltage difference between G1 and G2 decreases, as mentioned in FIG. 39. However, VG1 is determined by the desired maximum deflection (300 V in the study conditions, but it would also be possible to have 180 V for example), therefore the charge voltage difference can only be adjusted by VG2. By adjusting the charge voltage of G2, one adjusts the position of the coalescence.

Figure 50:
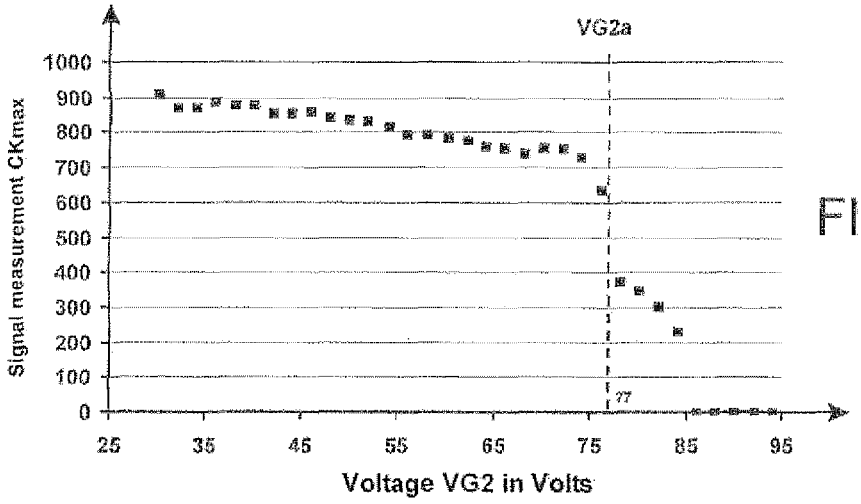
Figure 51:
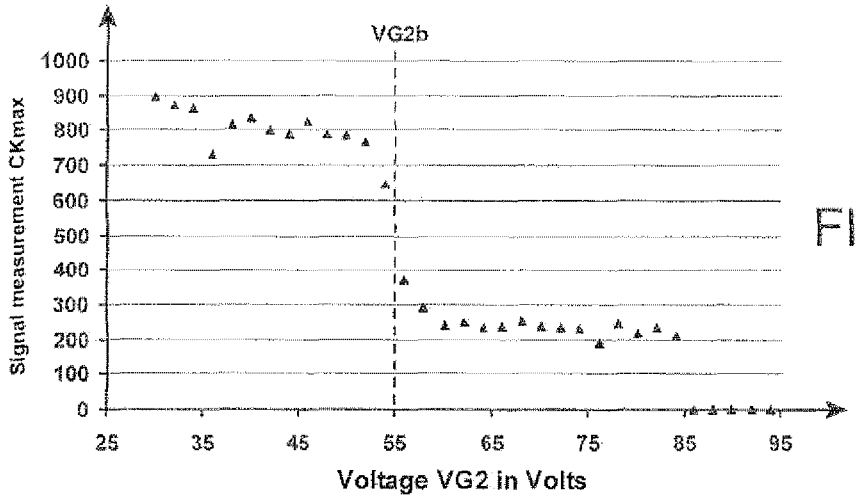

Several aspects can be inferred from this that may be used hereafter, individually or in combination, and implementing a line of measuring drops as in FIGS. 40-41B:

in the absence of a charge transfer, VG2 (charge of drop G2) is preferably adjusted so that the coalescence occurs just before the sensor; the sensor then provides, in general, a significant signal;

with the above adjustment, the presence of a charge transfer decreases the charge difference between G1 and G2 by a value equivalent to, for example, approximately 20 V, which moves the coalescence away from the break-off to push it into, or after, the field of the sensor; the signal of the sensor then weakens;

comparing the signal to a threshold makes it possible to detect the charge transfer. As we will see, the adjustments and the threshold depend on the ink used and the working temperature. For the practical implementation of the detection of the stimulation range, the adjustment of VG2 will be done and the value of the above threshold will be determined, preferably automatically;

the stimulation reference is positioned to be certain it is within the proper printing range, so as to control the charge of the drops;

the line of measuring drops can be configured to simulate an operation without charge transfer: with N1 and N2 environment drops charged at V1, VG1 is set by the desired maximum deflection, VG2 is a variable parameter;

it is possible to establish a first curve A (one example of which is presented in FIG. 50), giving the amplitude of the signal of the sensor as a function of VG2 increasing from a low value (for example 30V). The coalescence, initially created upstream of the sensor, will move gradually away from the break-off until it reaches, then exceeds the entry point of the sensor. The signal on the curve will assume a high value, then will drop upon arrival of the coalescence in the sensor. This signal drop occurs at a value of VG2=VG2a;

the line of measuring drops can then be configured to simulate an operation with the charge transfer equivalent to Xtr=20 V: V1 keeps the same value as before, and VG1 is decreased by Xtr: VG1'=VG1−Xtr and the charge voltage of G2 assumes the value of VG2'=VG2+Xtr with VG2 a variable parameter;

a second curve B is established (an example of which is shown in FIG. 51), giving the amplitude of the signal of the sensor as a function of VG2 increasing from a low value (for example 30V). The coalescence will be moved downstream of the jet due to the simulated transfer. It will move gradually away from the break-off until it reaches, then exceeds, the entry point of the sensor. The signal on the curve B will react in the same way as for the curve A, it will assume a high value, then drop upon arrival of the coalescence in the sensor. This signal drop will occur earlier than for curve A, at a value of VG2=VG2b;

the operational value VG2op of VG2 is located before VG2a on the curve A because, in the case where the transfer does not occur, the signal is high; VG2op is located after VG2b on the curve B: in case of transfer, the signal weakens. For example, VG2op is chosen as median value of VG2a and VG2b (other choices are possible);

the signal level threshold $CX_{tr}$ making it possible to detect a charge transfer is positioned between the level corresponding to VG2a on curve A and the level corresponding to VG2b on curve B, for example in the middle of these two values (other choices are also possible here).

Figure 52:
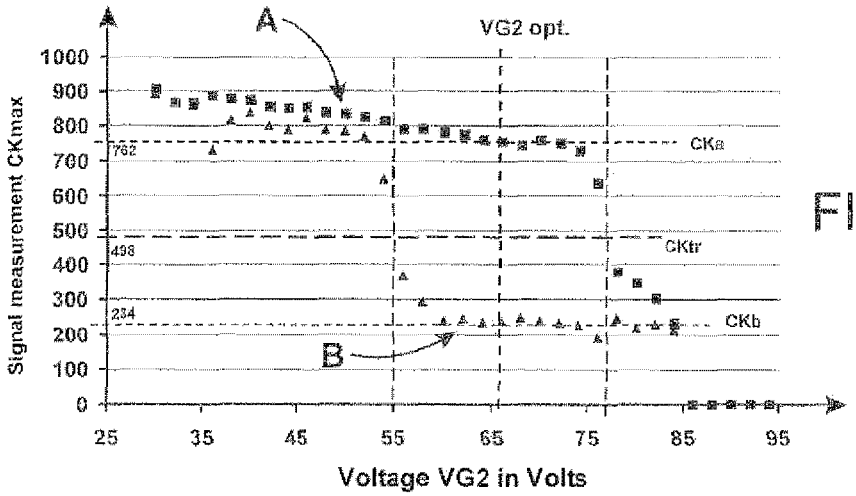

FIG. 52 shows curves A and B superimposed. In this example, V1=195 V, VG1=300 V, VG2a=77 V, VG2b=55 V and VG2op=66 V. The threshold $CK_{tr}$~498.

The value of Xtr=20 V is, as determined experimentally above, that of a transfer at the exit point of the stimulation range; other values can be used as a function of the behavior of particular inks.

A charge transfer with a more significant value will be better detected with the same adjustment of VG2. Therefore, the charge transfer greater than the equivalent of 50 V, which is created by the slow satellite at the entry point of the stimulation range, can be detected using the same method and the same adjustments as for the exit point of the range.

By creating substantial electrostatic forces between the drops of the jet, the charge level of the N1 drops of the downstream environment and N2 drops of the upstream environment participate in the rearrangement of the drops in the measuring group (drops on either side of G1 and G2 in the jet) and in the formation of the coalescence. As already indicated above, the charge levels of the drops of the upstream and downstream environments can be different, without changing the principle of the invention. In general, they are taken here to be identical, with value V1.

Tests of the influence of V1 on the break-off/coalescence distance have been performed. Three configurations were tested:

Environment 1: V1=300 V;

Environment 2: V1=250 V;

Environment 3: V1=150 V.

Figure 42:
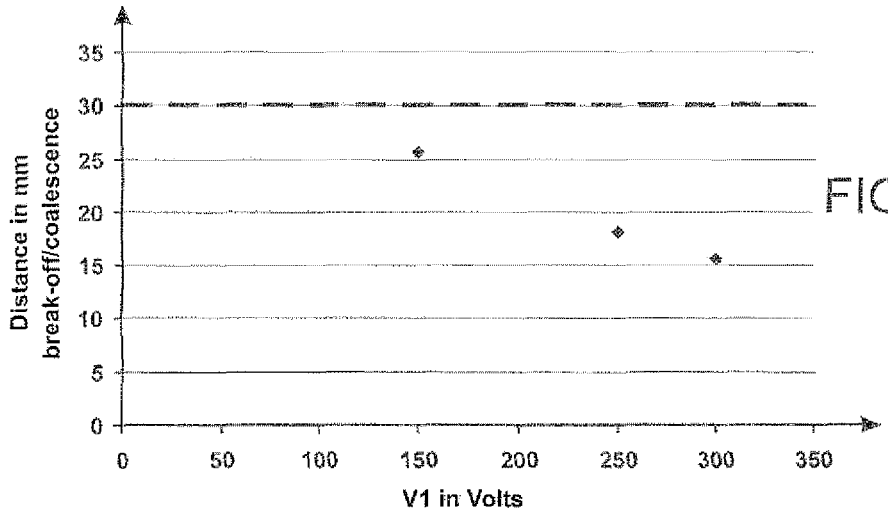

FIG. 42 shows, for ink EN1, the distance d between the break-off point and the coalescence, as a function of the environment voltage $V_1$, for VG1=300 V and VG2=0 V. One will note that the decrease of $V_1$ makes it possible to bring the coalescence closer to the sensor, but a voltage of 150 V is not sufficient to locate the coalescence at several mm from the sensor, for example approximately 2 mm.

Figure 43A:
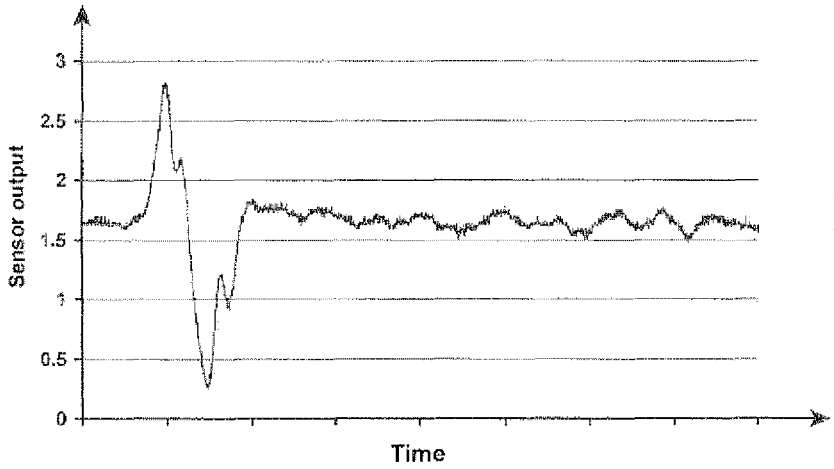
FIGS. 43A-43C show the evolution of the output signal from the sensor as a function of time, for various situations.
Figure 43B:
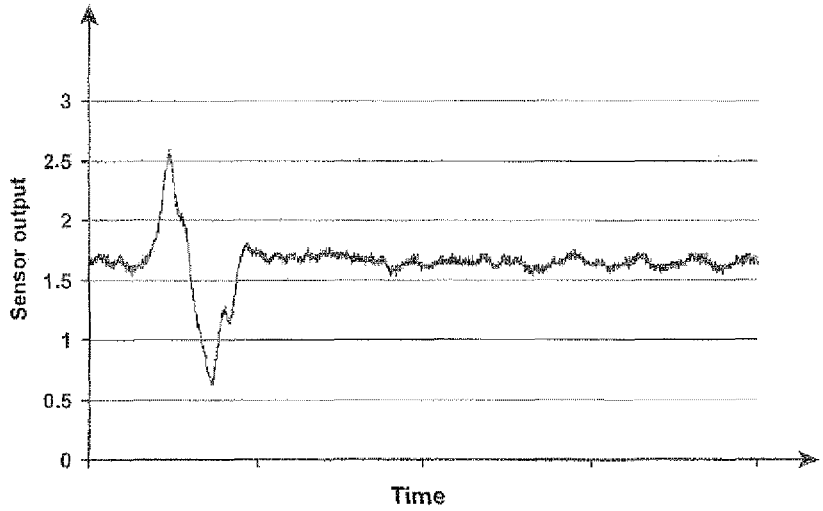
Figure 43C:
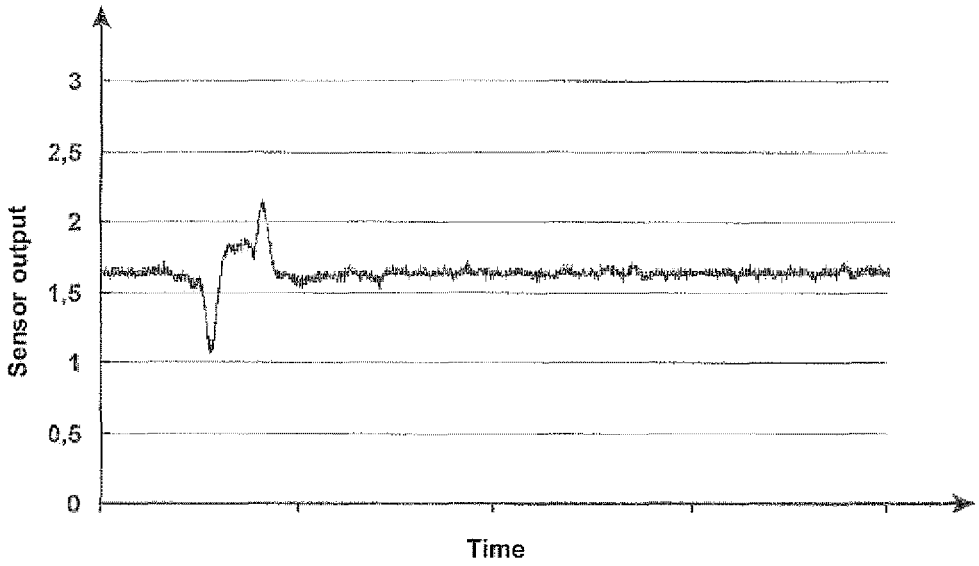

FIGS. 43A, 43B, 43C show the current signal observed immediately at the exit point of the sensor 6 in the three environments indicated above.

These signals are processed by appropriate means, for example means for amplifying a signal coming from the sensor 6, means for digitizing that signal, means for denoising it by digital filtering, means for looking for the maximum thereof among the digital samples resulting from the previous filtering. It is therefore possible to obtain a value representing the maximum amplitude of the signal (height of the current peaks). The output from the processing means gives a value called CKmax, comprised between 0 and 1000 representing a peak height comprised between 0 and a value chosen to best meet all of the situations encountered in the implementation of the method.

In FIGS. 43A-C, one can see that the amplitude of the signal decreases when V1 decreases. This preferably leads to choosing a compromise between:

- a high enough amplitude of the current signal, guaranteeing a minimum signal/noise ratio, to allow reliable processing by the aforementioned means,
- an amplitude of the current signal that is not too high, to avoid the deterioration of the results provided by the cited means, due to saturations of internal functions.

One can also see that for an environment of 150 V (FIG. 43C), the current peaks are reversed relative to the signals produced by the other two environments, and become relatively unusable by the aforementioned means. This can be explained by the modification of the electrostatic signature of the measuring group passing in front of the sensor. This modification is caused by the evolution of the relative position and the charge of the drops in the measuring group when the charge of the environment drops decreases. This leads to selecting a value of V1 greater than the value that causes the inversion of the peaks in the signal from the sensor. This value is greater than 170 Volts for the study configuration of the printer.

Tests have shown that the preceding observations are valid for all three inks (EN1, EN2, EN3) and all three temperatures (ambient, 15° C., 5° C.)

One can see from the preceding that it is possible to determine, for the amplitude of the signal or what is equivalent, for CKmax, a compromise value $CK_c$ satisfying all of the constraints expressed above:

- V1 is preferably chosen to be low so as to contribute to bringing the coalescence and the sensor closer together, but high enough to prevent the inversion of the peaks of the sensor signal (>170 V here);
- furthermore, V1 is preferably limited in level to prevent the amplitude of the signal of the sensor from exceeding a value beyond which there is a risk of saturation of the processing means (depending on the study configuration).

Since the maximum level of the signal or CKmax also depends on the charge of G1 and G2, as seen above, one can say that a preferred value of V1 makes it possible to have a value of CKmax equal to or approaching the compromise CK, once VG1 and VG2 are determined.

Figure 44:
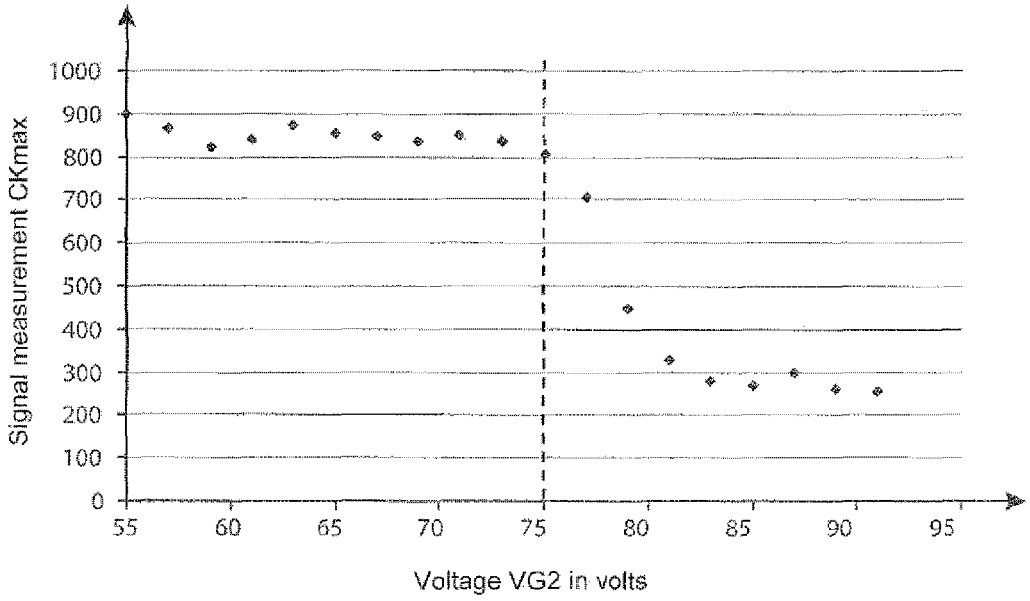
FIGS. 44 and 47-54 show the evolution of the signal CKmax as a function of various parameters.

But the values of V1 and VG2 are interdependent. Tests have been conducted to evaluate the optimal values of the voltages V1 and VG2: these tests consist of situating oneself experimentally in the operational stimulation range, freezing V1 in the line of measuring drops, and establishing the curve giving CKmax as a function of VG2. One example of such a curve is provided in FIG. 44 (where V1≈200 V). CKmax is high (CKmax=900) for the low values of VG2 (the coalescence occurs before the sensor) then, from a value of VG2=VG2x (75 V in the example of FIG. 44), the curve quickly weakens (the coalescence enters the sensor) as far as a value of CKmax=approximately 400. This curve gives two indications:

- the maximum level of CKmax that one wishes to keep below a value to avoid the saturation of the processing means;
- the value of VG2 that places the coalescence just before the sensor; a charge transfer will cause the value of CKmax to fall.

It emerges from this that, for the study configuration of the printer selected the tests, the optimal value for the voltage V1 is situated in the vicinity of 200 V. The value of VG2x was determined as explained above for the three inks EN1, EN2, EN3 at the three temperatures: ambient, 15° C. and 5° C. Table VI provides the results:

TABLE VI

| Ink | Temperature | VG2x |
|---|---|---|
| EN1 | Ambient | 65 |
| | 15° C. | 70 |
| | 5° C. | 70 |
| EN2 | Ambient | 70 |
| | 15° C. | 70 |
| | 5° C. | 70 |
| EN3 | Ambient | 65 |
| | 15° C. | 75 |
| | 5° C. | 75 |

The results of the tests show that, when the voltage of the environment drops V1 is set, VG2x is relatively insensitive to the nature of the inks and the working temperature. This observation makes it possible to define a line of measuring drops with a predetermined pair V1, VG2 (for example, 200 V and 65 V here), usable irrespective of the inks and the temperature, in a method for determining the stimulation range by scanning.

Such a method is similar to that described in the first part of the document; it comprises:

- applying successive stimulation reference values;
- and for each value, emitting lines of measuring drops and measuring CKmax.

The stimulation range will correspond to the references where CKmax has a high value.

The above method makes it possible to frame the stimulation range approximately and may fail in difficult situations where the stimulation range is very narrow. One then seeks the optimal values of V1 and VG2, making it possible to adjust the detection method of the charge transfer so as to guarantee the reliability of that detection.

Figure 45A:
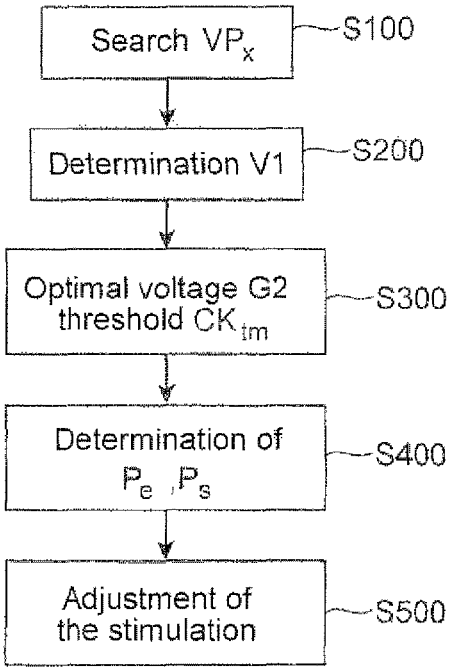
FIGS. 45A-45C and FIGS. 46A and 46B show steps for carrying out a method according to the invention.
Figure 46A:
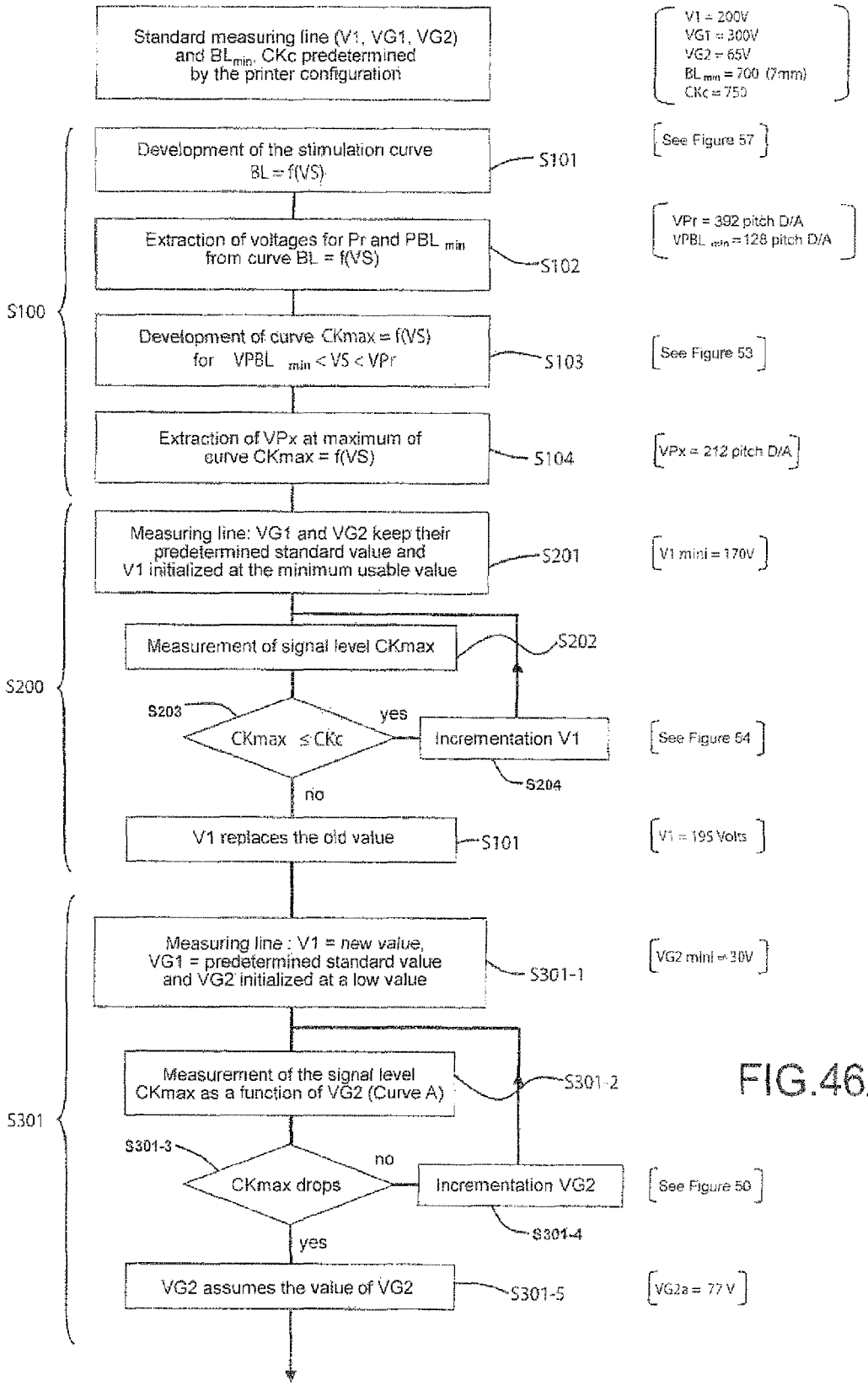
Figure 46B:
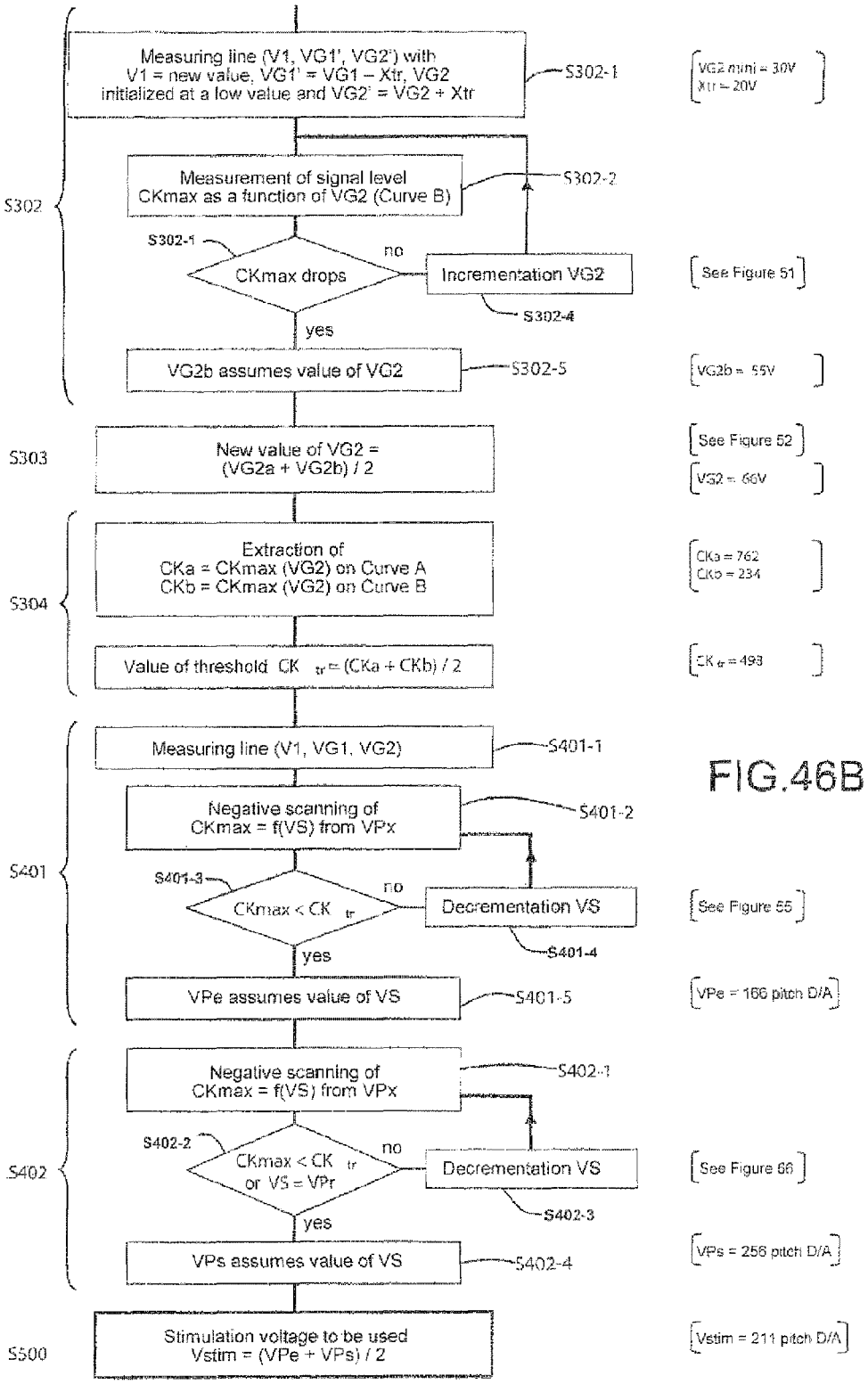

Based on the studies and experiments done above, a method for determining the stimulation range allowing proper printing is proposed. It may comprise the following steps shown diagrammatically in FIG. 45A (a method example repeats the steps described below in FIG. 46; certain steps are indicated only in that FIG. 46):

- step S100: Preliminary search for a stimulation voltage VPx situated in the proper printing stimulation range;
- step S200: Determination of the optimal charge voltage V1 of the N1 and N2 environment drops of a line of measuring drops that will be used;
- step S300: Determination of the optimal charge voltage of G2 and the threshold $CK_{tr}$ on the level of the sensor signal making it possible to discriminate between the presence or absence of a charge transfer.
- step S400: Determination of the entry Pe and exit Ps points of the operational stimulation range;

step S500: Adjustment of the stimulation to a piezoelectric voltage situated between the voltages VPe and VPs.

The following paragraphs detail aspects of the above steps. The explanation will be based on a processed example (FIGS. 47 to 54) corresponding to the study configuration.

Figure 45B:
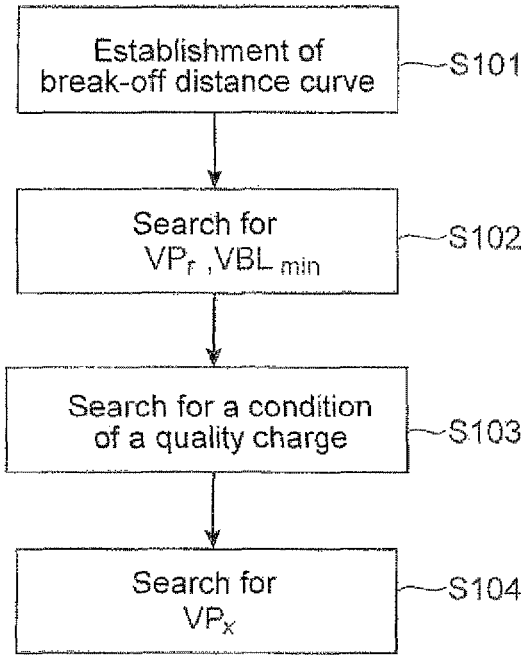
Figure 47:
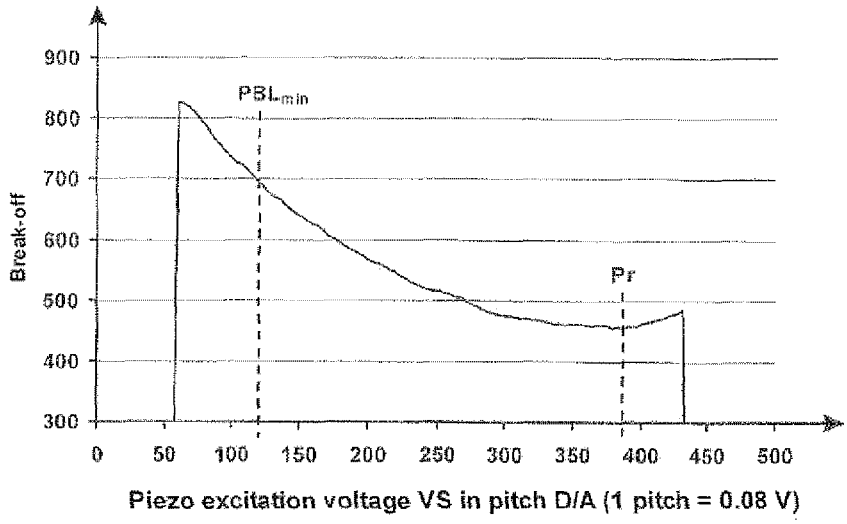

First, to carry out step S100 (search for VPx), it is possible to link the following sub-steps S101-S104 (shown diagrammatically in FIG. 45B):

S101: Establishment of the break-off distance curve BL as a function of the stimulation voltage VS, as described in the first part of this application (this step uses weakly charged test drops, in a 0 V environment). FIG. 47 shows the stimulation curve obtained for the processed example;

S102: One extracts, from the break-off distance curve, the value of the stimulation voltage at the turning point VPr (392 on the curve of FIG. 47) and that $VBL_{min}$ (128 on the curve) corresponding to the distance $BL_{min}$ below which one has experimentally observed that one or several inks, at several temperatures, have their break-off at least in zone A as defined at the beginning of this application and in FIG. 15. It is thus possible to approximately define a point, substantially to the left of the exit point Ps. $BL_{min}$ depends on the study configuration of the printer and is, in the example used here, 7 mm. This value is illustrated in the real curves of FIGS. 15, 22-24.

Figure 48:
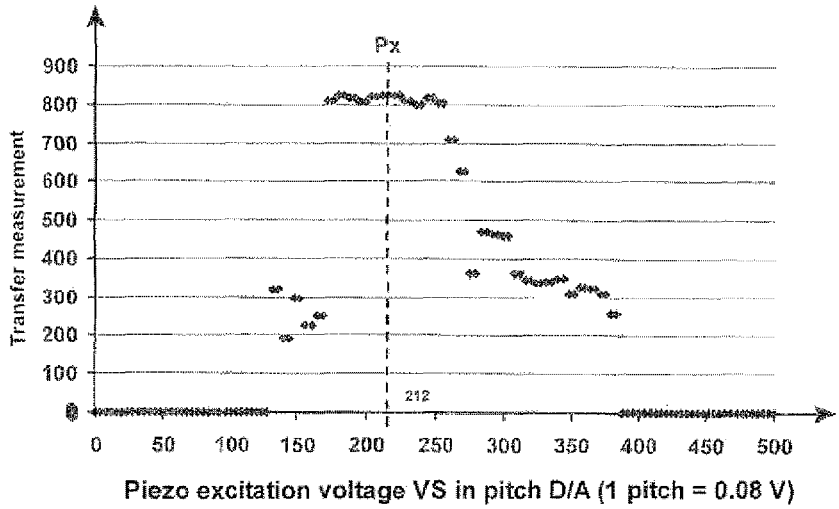

S103 (or search for a quality charge condition): the charge of the line of measuring drops is configured with, for example, V1=200 V, VG1=300 V and VG2=65 V, which are satisfactory values for several inks and several temperatures in the study configuration, as shown in table VI above. The stimulation is coarsely scanned (with a large pitch) between $VBL_{min}$ and VPr while emitting the measuring line defined above and measuring the sensor signal. The corresponding curve is shown in FIG. 48;

S104: The maximum value of the signal is sought, it corresponds to the stimulation value VPx. VPx=212 in the processed example (see FIG. 48). VPx is in the operational stimulation range and makes it possible to correctly charge the drops. The stimulation is positioned on VPx hereafter.

Figure 49:
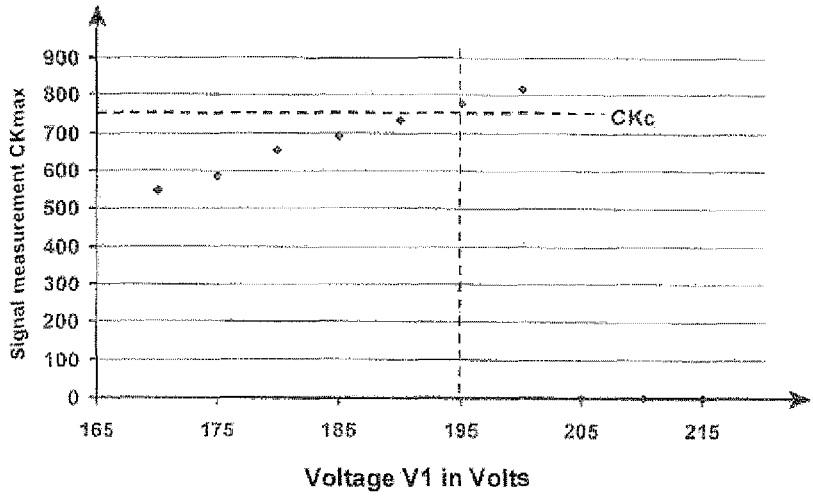

Step S200 (auto-adaptation of V1), illustrated by FIG. 49, can be carried out through the successive emission of lines of measuring drops, with the same values of VG1 and VG2 as before, but with increasing values of V1 from a starting value (minimum usable value) taken, in the considered example, to be 170 V (so as to have a correctly formed signal as seen before). The signal level is measured (S202). The value of this level increases with V1; the implementation or scanning of V1 (S204) is stopped when the signal exceeds an arbitrary threshold value $CK_c$ (see the test CKmax<Ckc in step S203), for which the processing means operate without saturation ($CK_c$ is chosen in the processed example to be 750). This value, thus determined, is kept for the rest of the method (S205). In the example of FIG. 49, the new value of V1, obtained through this auto-adaptation, is 195 V.

Figure 45C:
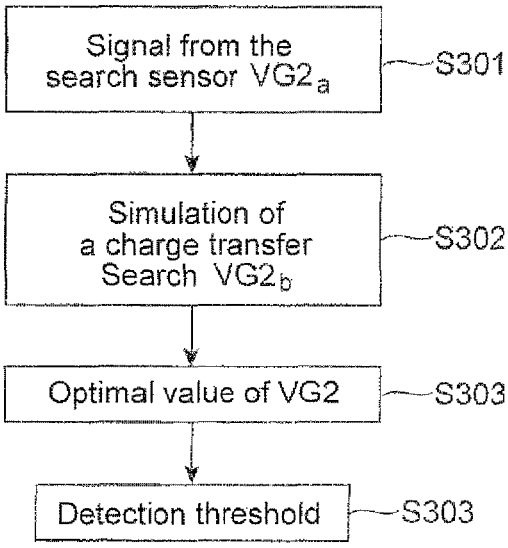

Step S300 (auto-adaptation of VG2 and the detection threshold for a charge transfer) may repeat aspects already described above and for example comprises the steps diagrammatically illustrated in FIG. 45C:

for example, in a first sub-step S301, one successively emits lines of measuring drops (of the type of FIGS. 41A and B) (S301-1) and measures the signal level of the sensor, in fact the level of CKmax as a function of VG2 (S301-2). VG2 is incremented as long as CKmax remains high (steps S301-3 and 301-4). The charge of the line is done with the values of V1 and VG1 previously defined, but with increasing values of VG2a, from a low value (for example 30V), until the drop of the sensor signal in VG2 (77 V on the curve of FIG. 50). One then takes the value of VG2 for which the signal drops (S301-5).

S302: the line of measuring drops is configured (S302-1) to simulate a charge transfer of Xtr Volts (20 V here); the same method as in S301 is carried out: V1 remains unchanged, VG1 becomes VG1'=VG1−Xtr and for VG2, initially low, the value actually applied will be VG2'=VG2+Xtr. VG2 is incremented as long as CKmax increases (steps S302-2 and 302-4). The signal level is read as a function of increasing VG2 and its value VG2b is identified when the signal drops (S302-2; VG2b=55 V in FIG. 51).

S303: The optimal value of VG2 is determined as being, for example, the median value between VG2a and VG2b (65 V in FIG. 52, which superimposes the data from FIGS. 50 and 51, respectively identified in FIG. 52 by A and B);

S304: The detection threshold $CK_{tr}$ for a charge transfer can be chosen from this data; it is, for example, the median value between the sensor signal levels of the data A and B for the optimal value of VG2. This value is $CK_{tr}$=498 in FIG. 52.

Step S400: Determination of Pe and Ps: The charge of the line of measuring drops is now determined optimally: for the study configuration and for the ink/temperature pair concerned by the auto-adaptation of V1 and VG2. It will be applied for the rest of the method.

Figure 53:
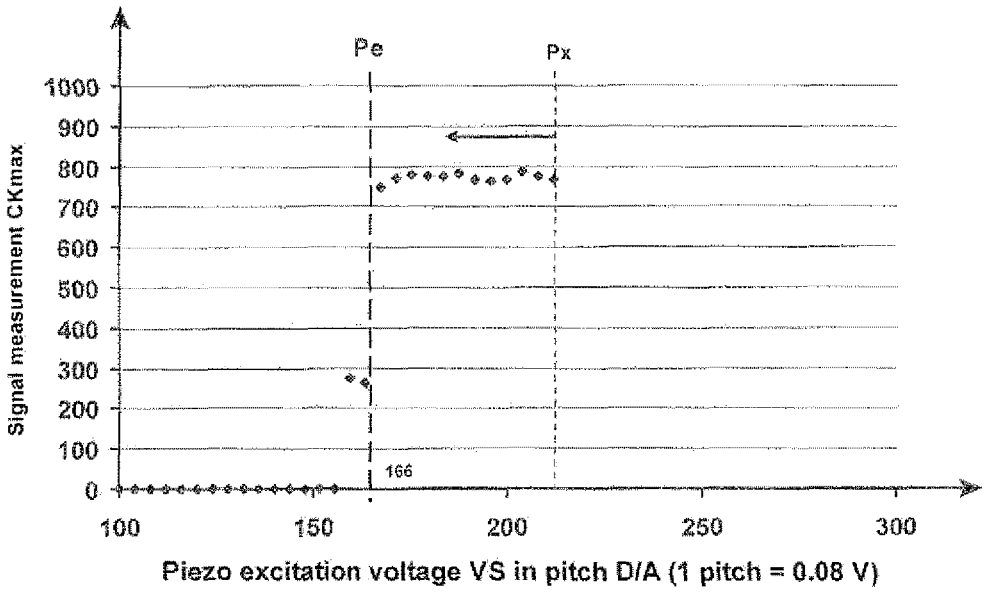

S401: a measuring line is generated (S401-1) and scanning is done of the stimulation level, in the decreasing direction (S401-2), from VPx, which guarantees a correct charge of the drops upon starting the scanning. At each stimulation value, one emits a line of measuring drops (of the type of FIGS. 41A and 41B) and compares the results of the sensor measurement with the threshold $CK_{tr}$ (S401-3). If the signal is greater than $CK_{tr}$, the value of VS is decremented (S401-4). The signal passes below the threshold when the charge transfers produce, the first slow satellites appear. Pe is positioned just at the moment where the threshold is exceeded (S401-5). FIG. 53 illustrates the step where VPe is equivalent to 166 in the processed example.

Figure 54:
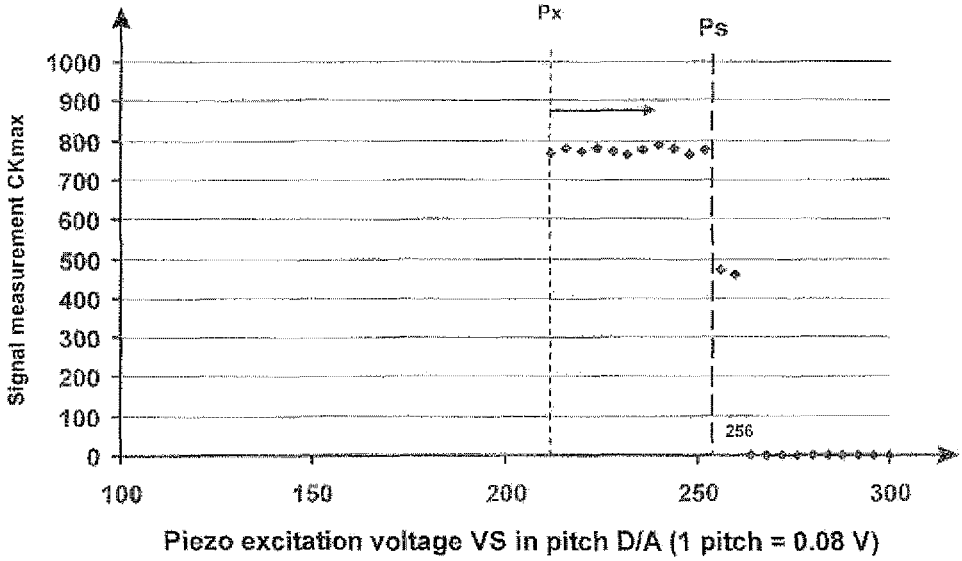

S402: scanning is done of the stimulation level, in the increasing direction, from VPx (S402-1), until, at most, the voltage of the turning point VPr. The stimulation value is gradually incremented (S402-3): at each stimulation value, one emits a line of measuring drops and compares the results of the sensor measurement with the threshold $CK_{tr}$ (S402-2, S402-3). The signal goes below the threshold when the charge transfers produced by the tearing out of materials appear. Ps will then be positioned just at the moment where the threshold is exceeded (S402-4). In the case where VPR is reached without the threshold being exceeded, the scanning stops and Ps will be likened to Pr (the turning point). FIG. 54 illustrates this step, where VPs is equivalent to 256 in the processed example.

Step S500: Adjustment of the stimulation: The stimulation voltage Vstim is adjusted between the values VPe and VPs found above, for example at the median value (211 in the processed example).

With this new method, Pe is determined with the same means as for the determination of Ps; the linear laws, which were explained above to determine VPe, are no longer necessary.

The methods described above can be implemented using a device like that of FIG. 27, including the means 100, 110, 120.

Some of the examples provided above relate to a case where one implements a so-called "large character" head, which leads to a certain given sizing of the different parameters (break-off/sensor entry distance, intervals for V1, VG1, VG2, etc.).

It is also possible to work with a smaller head, called "small character," which uses the same stimulation range detection technology. There are other parameter values in that case, however.

Table VII indicates the typical values for each of these heads.

TABLE VII

| | "Large character" head | "Small character" head |
|---|---|---|
| Break-off/sensor entry distance | >20 mm | >15 mm |
| Interval for V1 (environment) | 150 to 300 volts | 100 to 200 volts |
| Interval for VG1 | 170 to 300 volts | 125 to 200 volts |
| Interval for VG2 (above the historical voltage) | 40 to 90 volts | 20 to 60 volts |
| VG1-VG2 | >150 volts | >100 volts |

What is claimed is:

1. A method for determining the quality of a break-off of an ink jet of a CIJ printing machine, method comprising:

generating a first line of N1 drops, all charged by at least one charge electrode, at a same voltage $V_1$;

then generating at least one drop $G_1$, charged by the at least one charge electrode, at a second voltage ($VG_1$), followed by at least one drop $G_2$, charged by the at least one charge electrode, at a third voltage ($VG_2$) lower than $V_1$;

then generating a second line of N2 drops, all charged by the at least one charge electrode, at a same voltage $V_2$; and measuring, via an electrostatic sensor, the charge variation of a jet of non-deflected drops including at least the first line of drops and the second line of drops, separated by the drops $G_1$ and $G_2$, during the passage of that jet in front of the sensor.

2. The method according to claim 1, further comprising comparing the charge variation with a threshold value to determine whether a coalescence of the drop $G_2$ and the drop $G_1$ occurs upstream of the detector, or downstream of the entry thereof.

3. The method according to claim 1, the drop $G_1$ and/or the drop $G_2$ being charged, by the at least one charge electrode, with a cyclical ratio comprised between 30% and 100%.

4. The method according to claim 1, the distance (d) between the break-off point of the drops and the upper part of the sensor being at least equal to 15 mm or to 20 mm.

5. The method according to claim 1, wherein N1 and N2 are such that the first line of drops and the second line of drops have a length greater than the length of the sensitive zone of the electrostatic sensor.

6. The method according to claim 1, wherein $V_2=V_1$.

7. The method according to claim 1, wherein $VG_1=V_1$.

8. The method according to claim 7, wherein $|VG_1-VG_2|\geq V'$, V' being a minimum value, with $V'\geq 100$ V or 150 V.

9. The method according to claim 1, wherein $VG_2<V_1<VG_1$.

10. The method according to claim 1, wherein:

$150\ V\leq V_1\leq 300\ V$, $VG_1>V_1$ and $40\ V\leq VG_2<90\ V$, or:

$100\ V\leq V_1\leq 200\ V$, $VG_1>V_1$ and $20\ V\leq VG_2\leq 60\ V$.

11. The method according to claim 1, the voltage $VG_1$ being comprised between 125 V or 170 V on the one hand, and 200 V or 300 V on the other hand.

12. A method for determining a piezoelectric input (VPe) and/or output (VPs) voltage of the proper printing range of a CIJ printing machine, the method comprising:

selecting at least each of the voltages $V_1$, $V_2$ and $VG_1$, $VG_2$, implementing a method according to claim 1.

13. A method for determining a piezoelectric output voltage (VPs) of the proper printing range of a CIJ printing machine, the method comprising:

selecting at least each of voltages $V_1$, $V_2$ and $VG_1$, implementing a method of claim 1, varying the voltage $VG_2$ in a voltage range comprised between 40 V and 90 V or between 20 V and 60 V.

14. A continuous ink jet-type printing machine, this machine including:

a drop generator configured to generate:

a first line of N1 drops, all charged by at least one charge electrode, at a same voltage greater than or equal to a first voltage $V_1$, at least one drop $G_1$, charged by the at least one charge electrode, at a second voltage ($VG_1$), then at least one drop $G_2$, charged by the at least one charge electrode, at a third voltage ($VG_2$) lower than $V_1$, then a second line of N2 drops, all charged by the at least one charge electrode, at a same voltage $V_2$, a sensor configured to measure the charge variation of a jet of non-deflected drops including at least the first line of drops and the second line of drops, separated by the drops $G_1$ and $G_2$, during the passage of the jet in front of the sensor.

15. The machine according to claim 14, also comprising means for comparing the charge variation with a threshold value for determining whether a coalescence of the drop $G_2$ and the drop $G_1$ occurs upstream or downstream of the entry of the measuring means.

16. The machine according to claim 14, the drop $G_1$ and/or the drop $G_2$ being charged with a cyclical ratio comprised between 30% and 100%.

17. The machine according to claim 14, the distance (d) between the break-off point of the drops and the upper part of the sensor being at least equal to 15 mm or to 20 mm.

18. The machine according to claim 14, wherein N1 and N2 are such that the first line of drops and the second line of drops have a length greater than the length of the sensitive zone of the electrostatic sensor.

* * * * *